United States Patent [19]

Rikker

[11] Patent Number: 4,947,923

[45] Date of Patent: Aug. 14, 1990

[54] METHOD AND APPARATUS FOR EVAPORATIVE PATTERN CASTING

[76] Inventor: Leslie D. Rikker, 15441 Betty Ann La., Oak Forest, Ill. 60452

[21] Appl. No.: 181,443

[22] Filed: Apr. 14, 1988

[51] Int. Cl.[5] ..... B22C 9/04; B22C 15/10; B22C 15/28

[52] U.S. Cl. ..... 164/5; 164/7.1; 164/34; 164/38; 164/39; 164/160.1; 164/167; 164/195; 164/203

[58] Field of Search ..... 164/34, 37, 38, 39, 164/40, 203, 5, 7.1, 160.1, 167, 195

[56] References Cited

U.S. PATENT DOCUMENTS

| | | | |
|---|---|---|---|
| 3,581,802 | 6/1971 | Krzyzanowski . | |
| 3,678,989 | 7/1972 | Krayzanowski . | |
| 4,454,906 | 6/1984 | Musschoot . | |
| 4,544,013 | 10/1985 | Kearney et al. . | |
| 4,565,227 | 1/1986 | Shebuski . | |
| 4,593,739 | 6/1986 | VanRens et al. . | |
| 4,600,046 | 7/1986 | Bailey et al. | 164/34 |
| 4,612,968 | 9/1986 | Ashton et al. . | |

FOREIGN PATENT DOCUMENTS

| | | | |
|---|---|---|---|
| 2622552 | 11/1977 | Fed. Rep. of Germany | 164/34 |
| 55-144359 | 11/1980 | Japan | 164/37 |
| 59-87951 | 5/1984 | Japan | 164/37 |

OTHER PUBLICATIONS

Shulyak, V.S. "Castings Using Gasifiable Patterns," Russian Castings Production (8/68), pp. 356–358.

Dieter, H. B. et al., "Sand Without Binder For Making Full Mould Castings", Brittsh Foundryman (11/68), pp. 413–427.

Shulyak, V. S. "Production of Castings in Dry Sand Moulds Using Gasifiable Pattern", Russian Castings Production (9/70), pp. 435–436.

"Using the Polystyrene Casting Process For Making Patterns", Casting Engineering (Spring 1977), pp. 47–48 and 51.

Giesserei 66, No. 16/17, 8/6/79, p. 602, FIG. 1.

*Primary Examiner*—Richard K. Seidel
*Assistant Examiner*—J. Reed Batten, Jr.
*Attorney, Agent, or Firm*—Kenyon & Kenyon

[57] ABSTRACT

The method and apparatus are based on the use of a casting process in which expendable patterns are made of a low density material, then evaporated by molten metal as the metal advances into the cavity created by the evaporation of the pattern material. The outer supporting material of the cavity is an unbonded granular material of sufficient grain size distribution. This unbonded material is vibrated in defined partial volumes of the whole volume of a holding vessel called a pouring container and compacted to a predetermined density around the expendable pattern so that it fills all cavities of the expendable pattern prior to the introduction of molten metal into the container to displace the pattern. The compacting vibration is performed in several independent zones to achieve uniform compaction and to prevent pattern deformation. The pouring container follows a loop via a conveyor system preferably through four operation stations. At a first station, the apparatus inserts the pattern and vibrates and compacts the molding medium around the same. At a second station, the actual pouring of the molten metal into the pattern within the molding medium takes place. Preferably, the gases from the evaporation of the pattern are recovered and rendered environmentally safe. After a cooling period, the pouring container continues to a third station where the final casting is removed from the molding medium. The molding medium is recycled and recovered at a fourth station and the empty pouring container can then be used for a new casting.

95 Claims, 36 Drawing Sheets

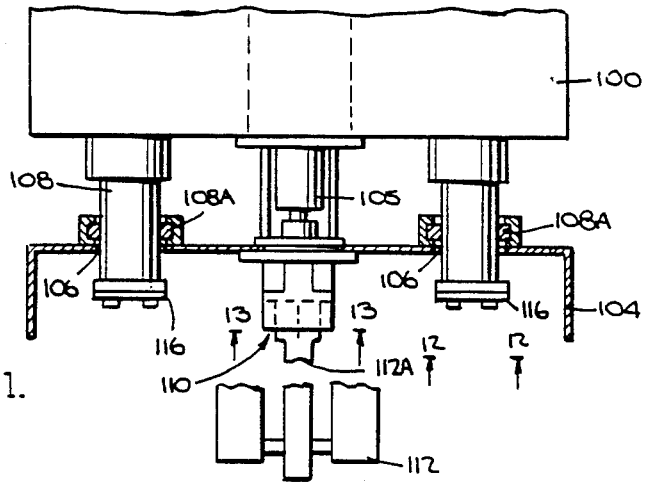
Fig. 11.
Fig. 10.
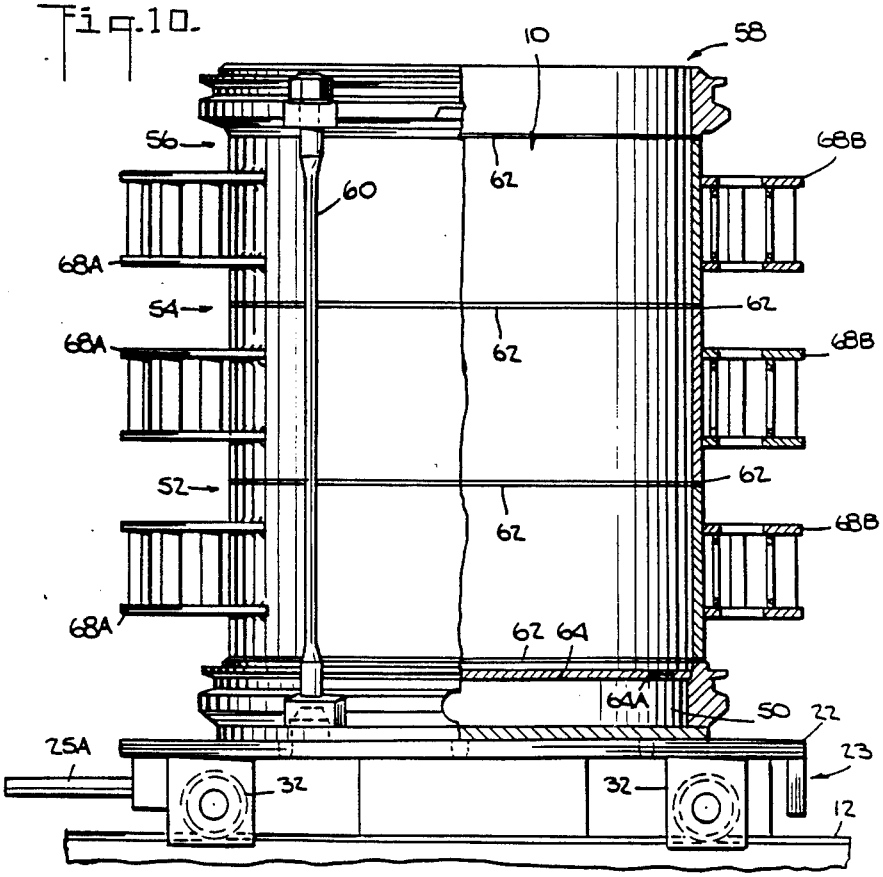

110
112A
114
114
116
122
120
124
118
120
122
10
112
64A
64A
64
64A
64A
64A
198
22
76
20
28
32
12
30
12
32
To 196

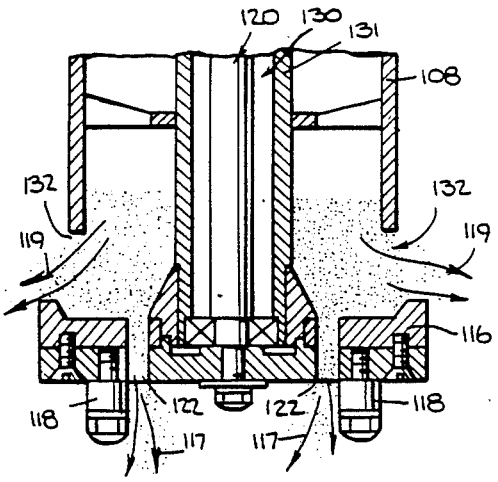
Fig. 18.
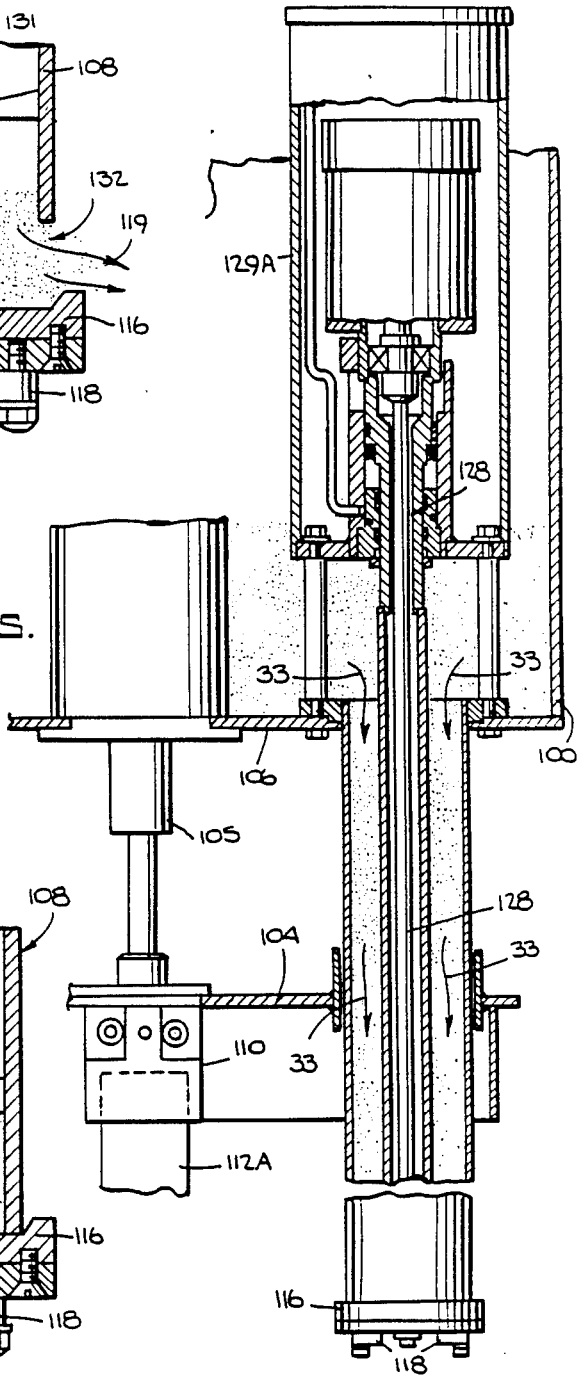
Fig. 15.
Fig. 17.
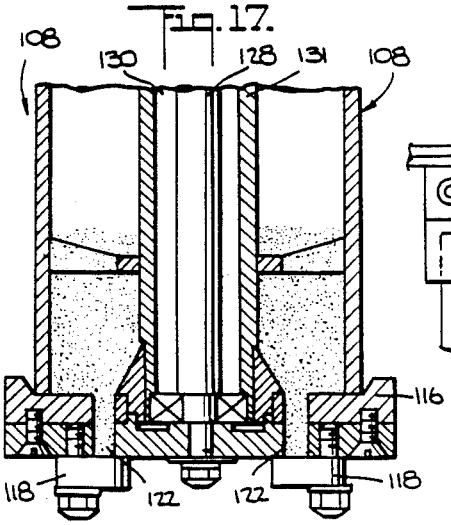

10
Y
X

Y
X

Y
X

Y
X

A
B
C
D
π/2
π
3π/2
2π

402
403A
402A
400
401B
401
410
402A
404
401A
401C
406
10
403
12

402
403A
400
401
410
409
408A
408
404
406
401C
401A
10
402
403
12

Fig. 47.
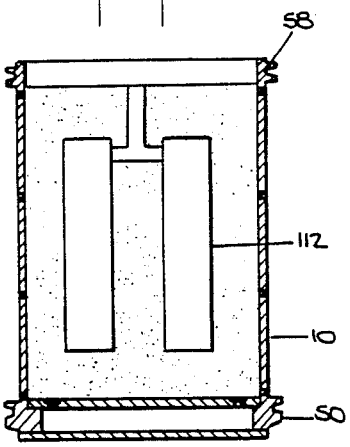
Fig. 48.
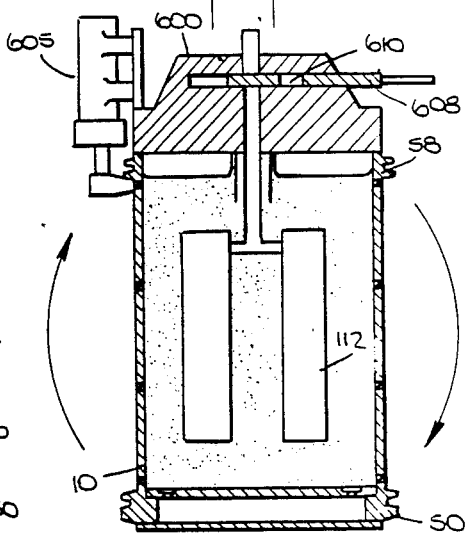
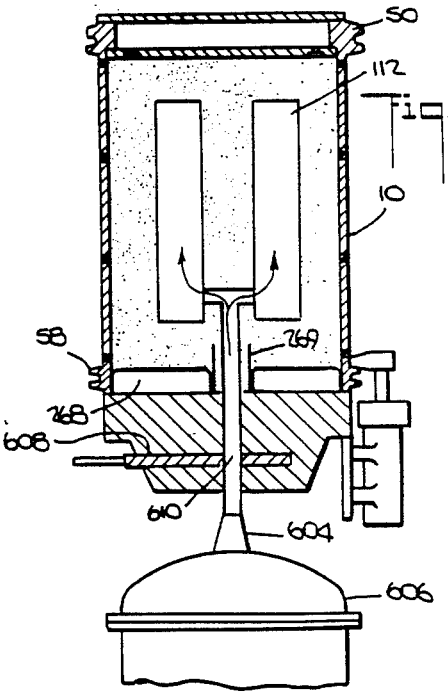
Fig. 49.
Fig. 50.
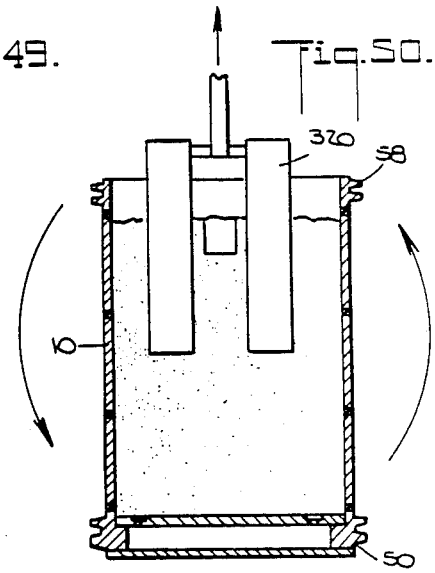

METHOD AND APPARATUS FOR EVAPORATIVE PATTERN CASTING

BACKGROUND OF THE INVENTION

The present invention relates to casting methods and apparatus and, in particular, to evaporative pattern casting methods and apparatus. More particularly, the present insertion of an evaporative pattern into a casting flask or pouring container, packing an unbound molding medium around the pattern in the flask, pouring molten metal into the flask to displace the pattern, treating the resulting gases from the evaporation of the pattern, removing the formed and cooled casting, and recycling the molding medium for further casting.

The evaporative pattern casting process, also known as the lost foam process or the full mold process, is a process for making metal castings in which a pattern made of a material which evaporates or gasifies upon contact with molten metal is inserted into a pouring flask or container and surrounded by a molding medium. The pattern is typically made of a plastic foam material, e.g., polystyrene, and is substantially the same size and shape as the casting to be produced, i.e., it is a positive pattern. The evaporative pattern casting process, whether the pattern is made individually or in mass quantities, is similar in principle in some respects to the lost wax process or precision casting process which, also, has heretofore been used in foundries. A unique feature of the evaporative pattern casting process, however, lies initially in its suggestion that the plastic pattern material can be evaporated by the molten metal itself rather than by the application of external heat before the metal is actually poured. In the evaporative pattern casting process as originally conceived, the pattern was embedded in a molding medium comprising bonded granular particles. See Shroyer U.S. Pat. No. 2,830,343. A second development in the art was the use of dry, unbonded granular molding medium. See Smith U.S. Pat. No. 3,157,924. The evaporative pattern casting process has shown that, in principle, castings can be produced in dry unbonded sand or granular molding material. A third development involves the elimination of a refractory wash coat which normally has been required to be applied to the evaporative pattern. See applicant's U.S. Pat. No. 4,651,798.

Throughout the years, there have been a number of improvements made in the evaporative pattern casting process. For example, a number of patents have been obtained in the evaporative pattern casting art. U.S. Pat. No. 4,593,739 to Van Rens et al. describes a method and apparatus for packing sand around a mold pattern by vibration. U.S. Pat. No. 4,600,046 to Bailey et al. describes a molding apparatus and process including a sand compaction system. A rigid mold flask is adapted to contain a mold pattern and sand. A support is provided for resiliently supporting the mold flask for horizontal movement only of the mold flask as a whole body. U.S. Pat. No. 4,685,504 to Bond et al. discloses a foundry sand feeding apparatus for use in feeding sand to an evaporative pattern casting mold. U.S. Pat. No. 4,454,906 to Musschoot discloses a vibratory method for packing foundry sand into a pattern prior to the pouring of molten metal. In the apparatus according to the '906 patent, the mold flask containing the pattern and sand is first vibrated at a frequency and stroke to produce accelerations in excess of the acceleration due to gravity to cause the sand to penetrate and fill the cavities. The accelerations then are reduced to produce an acceleration less than the acceleration due to gravity to compact the sand in place.

U.S. Pat. Nos. 3,581,802 and 3,678,989 to Krzyzanowski disclose a method and apparatus for making castings in which a body of granular material is confined in a container and a stream of gaseous fluid is introduced into the bottom of the container to impart to the granular material a state at least approaching fluidization. Into the thus agitated granular material a form is introduced consisting of material which is subject to consumption on contact with the molten metal. Gaseous fluid is also used after casting to agitate the granular material for facilitating removal of the finished casting therefrom. U.S. Pat. No. 3,861,447 to Hondo discloses a molding method in which negative or subatmospheric pressure is induced in the filler material in a flask containing an evaporative pattern. U.S. Pat. No. 4,690,201 to Van Rens discloses a lost foam mold pattern and associated method which facilitates suspension of the foam mold pattern assembly. U.S. Pat. No. 4,085,790 to Wittmoser discloses a casting method using a cavityless mold. At least two of the walls of the casting mold are formed by flexible membranes exposed to the atmosphere for creating a more a less isobaric pressure upon the application of suction to the interior of the casting mold. U.S. Pat. No. 4,139,045 to Vitt discloses a casting method and apparatus wherein the gas generated upon evaporation of the pattern is used to create an elevated pressure and a molten metal fills the space initially occupied by the pattern in the presence of the elevated pressure which is greater than atmospheric pressure.

U.S. Pat. No. 4,693,292 to Campbell discloses a method of casting metal articles by feeding molten metal upwardly against the force of gravity from a source of molten metal into a mold cavity where the metal is permitted to solidify within the cavity after which the metal feed is interrupted and the casting is removed from the cavity. U.S. Pat. No. 3,766,969 to Mezby et al. discloses an air breathing flask for a foundry mold. The flask has air breathing walls that are provided with a permeable layer, slotted vents, or screen vents in order to allow gases to escape from the vaporizable pattern. U.S. Pat. No. 3,572,421 to Mesey, et al., discloses a flask and pouring apparatus for casting metals using vaporizable patterns wherein the flask has air breathing walls.

Other patents, relating generally to the casting art, have attempted to recycle foundry byproducts or render them safe. U.S. Pat. No. 4,544,013 to Kearney et al., discloses a method of reclaiming sand used in a method of casting a metal. The method comprises blowing, after a predetermined lapse of time after the pouring of the metal into the mold, a combustion supporting gas into and through substantially the entire volume of the mold to levitate at least a region of the sand adjacent to the casting and to combust volatilized byproducts of the pattern entering the mold, and continuing the blowing of the combustion supporting gas to continue combustion and driving of the gas and byproducts of the combustion out of the mold. U.S. Pat. No. 4,291,739 to Baur discloses a method of manufacturing a hollow casting mold. The method includes the step of forming a casting mold body of a flowable binder-free backfilling material, stabilizing the casting mold body by negative pressure, and providing in the body a lost form of synthetic plastic material, particularly foamed synthetic plastic material. A vacuum pump operates during the casting process to carry away the products of combustion of the foam synthetic plastic material. U.S. Pat. No. 4,408,985 to Anderson et al. discloses a method of fixing hazardous substances in waste foundry sand. Certain dangerous substances are fixed into recyclable waste foundry sand so that they are less likely to leach out into the environment. This method uses a roasting process which causes dangerous substances to form insoluble compounds with the sand. An example is shown where hazardous waste foundry sand which contains acetic acid soluble lead is treated by the method.

U.S. Pat. No. 4,436,138 to Kondo discloses a method and apparatus for reclaiming molding sand. Centrifugal apparatus for removing impurities from the sand by abrasion and entrainment is disclosed. U.S. Pat. No. 4,620,586 to Musschoot discloses a method and apparatus for reclaiming foundry sand. A mold flask containing foundry sand shaped by a pattern to form a cavity into which molten metal has been poured is, after the metal has set, subjected to greatly reduced atmospheric pressure whereby to cause the moisture in the foundry sand to evaporate into water vapor, thereby removing moisture and heat from the sand so that the particles can be reused free of lumps or clumping of sand. U.S. Pat. No. 4,681,267 to Leidel et al. discloses a method of regenerating old casting sand, the sand being subject to rapid heating and extreme turbulence and crushing. U.S. Pat. No. 4,685,973 to Ashton discloses a method of reclaiming foundry sand wherein the foundry sand has been bonded using a sodium silicate binder. U.S. Pat. No. 4,354,641 to Smith discloses an apparatus for removing no-bake coatings from foundry sand and classifying the reclaimed sand. Foundry sand having nobake rigid coatings is discharged against a target to fracture the coatings from the sand grains on impact. U.S. Pat. Nos. 4,203,777 and 4,089,081 to Jacob disclose an apparatus and method for purifying particulate mold material. The sand is passed through layers of steel wool. U.S. Pat. No. 4,149,581 to Adkison et al. discloses a fine particle recycling method and apparatus. Fine particles of molding material are removed as a wet waste and subsequently delivered to a muller for mixing with sand and water in preparing molding material. U.S. Pat. No. 4,130,436 to Hauser et al. discloses a process for reclaiming foundry sand wastes using incremental heating followed by cooling. U.S. Pat. No. 4,113,510 to Richard discloses a process for regenerating foundry sand wherein resin in binder material accumulated around each of the particles is removed. U.S. Pat. No. 3,461,941 to Schumacher discloses a method of handling and cooling foundry sand. Unused sand is mixed with used sand from the breaking up of molds in an effort to reduce the need for cooling apparatus.

Other patents have been obtained for reducing pollution in the foundry industry. For example, U.S. Pat. No. 4,457,352 to Scheffer discloses a system and process for the abatement of casting pollution, reclaiming resin bonded sand, and/or recovering a low BTU fuel from castings. U.S. Pat. No. 4,478,572 to Selli discloses a plant and method for regenerating sand from foundry cores and molds by calcination in a fluidized bed furnace. U.S. Pat. No. 3,646,987 to Schumacher discloses a method for reducing dust pollution in foundries, and U.S. Pat. No. 3,838,732 to Overmyer discloses a contaminant collection system for a shaker table for removing mold sand from metal castings. These patents show especially the problems encountered in attempting to recycle the resin bonded sand used in the prior art techniques such as the green sand process.

Other patents of interest include U.S. Pat. No. 4,609,028 to Van Rens disclosing an evaporative pattern assembly for use in sand casting and U.S. Pat. No. 4,612,968 to Ashton et al. for a method of casting using expendable patterns wherein the pattern has a gas permeable refractory coating thereon. The particulate material is compacted to a maximum bulk density and a vacuum is applied to a compacted particulate material so as to create a sufficient pressure gradient in the compacted material to maintain the integrity of the gas permeable refractory coating. U.S. Pat. No. 4,616,689 to Denis discloses a foundry molding process and mold using a pattern of gasifiable material surrounded by sand free of a binding agent for low pressure precision casting. Molded metal parts are produced by forcing molten metal under low pressure upwardly into a mold chamber. Other patents of interest include U.S. Pat. Nos. 4,633,929 to Santangelo et al., 4,694,879 to Feuring, 4,509,579 to Pirrallo, 4,448,235 to Bishop, 4,482,000 to Reuter, 4,632,169 to Osborn et al., 4,640,333 to Martin et al., 4,657,063 to Morris, 4,673,023 to Winston, 4,691,754 to Trumbauer et al., 4,243,093 to Nieman, 4,640,728 to Martin et al., 3,868,986 to Olsen, 4,240,492 to Edwards et al., 3,496,989 to Paoli, 3,374,827 to Schebler, 3,374,824 to Snelling, 3,498,365 to Wittmoser, 3,889,737 to Olsen and 4,068,704 to Wittmoser.

U.S. Pat. No. 3,314,116 to Wittmoser et al. discloses the use of a refractory coating on an evaporative pattern in the evaporative pattern casting process. The use of a refractory coating is disadvantageous and is sought to be eliminated by the present invention. Such refractory coatings negatively affect proper gas evacuation and can result in casting imperfections.

Although substantial work has been done in the development of the evaporative pattern casting process, the technology still has not yet achieved its full capabilities. The automobile manufacturers have applied the technology for limited applications and in test cases. However, the technology has not heretofore been developed to the point where older, more well known casting processes, such as the green sand process, have been superceded. See, e.g., Modern Casting, Aug. 1981, pp. 36–37.

Nonetheless, the evaporative pattern casting process offers promise of substantial benefits, especially if an unbonded molding material is applied around the evaporative pattern. As originally conceived, see e.g., the Shroyer patent referred to above, the molding medium disposed around the evaporative pattern was bound, i.e., a glue binder material was used to hold the grains of the molding medium together, thus forming, in effect, a negative pattern around the positive pattern when the binder set. This was disadvantageous due to the high costs of molding medium binder treatment and subsequent molding medium cleaning and recovery. The later Smith 3,157,924 patent established that the molding medium could be unbound, but the use of an unbound molding medium has also not been without problems. Chiefly, these problems have been in the area of packing the molding medium into all the internal cavities and corners of the pattern, in preventing deformation of the pattern by the weight of the packed molding medium around the pattern, in preventing shifting of the pattern and molding medium when the metal is poured, and in providing a sufficiently "breathable" molding medium so as to allow escape of the gases generated when the pattern evaporates without disturbing the medium. A molding medium which has recently became available and which offers advantages to the evaporative pattern casting process is described in U.S. Pat. No. 4,651,798, issued to Leslie D. Rikker, the applicant herein.

Furthermore, the evaporative pattern casting process has heretofore had additional problems. For example, the gases generated by the evaporation of the pattern are pollutants which require treatment either to make them harmless or recycle them into useful products. The molding medium itself will become polluted by the escaping gases and provision must be made to clean the medium if it is to be recycled. Recycling is, of course, warranted and beneficial in view of the declining availability of the world's natural resources.

Large amounts of molding medium are required to be packed around the evaporative pattern and, accordingly, recycling of the molding medium offers significant advantages. Needless to say, the known green sand molding technique, for example, does not readily offer the same advantages insofar as recycling is concerned, because that technique employs a binding medium to bond the grains of the molding medium together, making it much more difficult to recycle the molding medium.

For example, when a binder is used it has to be reactivated by water and expensive reconditioning techniques must be applied in order to allow for recycling. Recycling is made even more difficult by cores produced from chemically bonded sand which cannot be easily separated out from the mold after the casting has been poured. These chemically bonded sand grains become mixed with the green sand creating additional reconditioning problems and expensive reclamation and disposal problems for the excess sand that has to be reused. Even more difficult is the recycling of the mold material made from so-called no-bake sand. This type of sand is usually coated with a resin composed of furan, phenolic, or urethane based polymers which, when catalyzed, cause the hardening of the resin. This renders the used sand unreuseable without the extensive grinding up of the molded sand into its original granular structure and the cleaning of the surface of the sand grains so that they will accept new coats of the binding resin.

Furthermore, the prior art techniques do not offer the production advantages which the evaporative pattern casting process, in principle, can enjoy. For example, because the evaporative pattern casting process can use an unbonded molding medium which is merely packed around the evaporative pattern, there is no need for substantial waiting periods for the molding medium to set. Furthermore, there is no need to remove a positive pattern from which a negative pattern is formed prior to metal pouring. There is, of course, no need even to produce a negative mold separate from the positive pattern in advance of metal pouring since the packing of the molding medium around the evaporative pattern accomplishes this objective in one step.

As previously explained, the ability to recycle offers significant production advantages to the evaporative pattern casting method. Also significant is the improved quality of castings which is, in principle, obtainable using the evaporative pattern casting technique because of the elimination of joint and flash lines, the possibility of eliminating the "wash" coat in the present invention which has, in the past, been utilized in the evaporative pattern casting technique between the pattern and the molding medium, and the inherent precision which the process offers due to the fact that the pattern is substantially an exact rendition, in foam, of the casting to be produced. Thus, the evaporative pattern casting process offers significant production advantages so that its application to large quantity casting will not be without substantial rewards, assuming the problems so far encountered in applying the technology can be overcome.

SUMMARY OF THE INVENTION

Accordingly, it is an object of the present invention to provide an evaporative pattern casting process and apparatus.

It is furthermore an object of the present invention to provide an evaporative pattern casting process which resolves the problems which have, in the past, prevented the wide scale application of the technique.

It is furthermore an object of the present invention to achieve a uniform production method for use with the mass production of castings allowing for continuous production of a great variety of shapes, sizes and quantities of castings.

It is a further object to provide for the production of varying castings without the need to change the production method or to stop the casting production line in order to insert the various patterns required and to remove formed castings, thus resulting in a fully automated casting production plant.

It is yet a further object to solve the pressing environmental problems of the foundry industry by minimizing the waste created by the casting process.

It is still a further object to minimize the portion of the molding material that becomes unrecyclable without expensive and extensive treatment.

It is yet still a further object of the invention to allow for the recouping of part of the heat energy released by the molten metal and absorbed by the molding medium.

It is still another object to provide a new and improved method and apparatus for the packing of unbound molding medium around a casting pattern.

It is yet another object of the invention to provide a better and improved method and apparatus for the pouring of molten metal into a pouring flask or container containing the evaporative pattern and molding medium.

It is still another object of the present invention to provide a method by which the molten metal can displace the evaporative pattern in the mold whereby the displacement occurs counter to gravitational forces.

It is yet still a further object of the present invention to provide a method by which the molten metal can displace the evaporative pattern in the mold whereby the displacement occurs counter to gravitational forces and the casting container can be moved prior to the solidification of the molten metal in order to increase production efficiency.

It is yet still another object of this invention to produce on demand castings in varying geometries, metals, and quantities.

It is yet still a further object of the present invention to provide a method and apparatus for treating the gases evolved from the evaporative pattern casting process to make them environmentally safe or into useful products.

It is yet still a further object to provide an evaporative pattern casting process and apparatus which makes use of some of the latest molding media, e.g., that disclosed in U.S. Pat. No. 4,651,798, to Leslie D. Rikker, the applicant herein.

It is still yet a further object to utilize the molding medium of U.S. Pat. No. 4,651,798 in an evaporative pattern casting process and apparatus to improve casting efficiency, for example, by eliminating the refractory wash coat applied to the pattern heretofore required in the evaporative pattern casting process.

Yet still a further object of the present invention is the provision of a known index point for the casting being removed so that the orientation of the casting is predetermined, which facilitates further automatic processing.

The above and other objects of the present invention are achieved by apparatus for forming evaporative pattern castings comprising means for inserting a pattern to be gasified on contact with molten metal of an object to be cast into a container, means for supplying an unbound molding medium into the container and disposing the molding medium around the pattern, the means for disposing comprising means for dispensing the molding medium into the container and means for compacting the molding medium around the pattern in predetermined partial volumes of substantially the total volume of the container, means for displacing the pattern with molten metal thereby forming a metal casting and releasing gaseous material from the evaporation of the pattern, and means for removing the casting, once cooled, from the container. The means for compacting preferably comprises vibrating means which provide balanced vibrational forces in horizontal planes, eliminating any relative vertical movement of the pattern and the container. Preferably, means for removing the unbound molding medium from the container and means for preparing the removed unbound molding medium for disposition around another pattern for forming a further casting are provided.

The above and other objects are also achieved according to the present invention by an apparatus for use in the evaporative pattern casting process comprising means for inserting an evaporative pattern of an object to be cast into a container, means for filling the container and surrounding the pattern with unbound granular molding medium, means for packing the molding medium around the pattern comprising means for vibrating the container in defined subportions of the volume of the container in a predefined sequence while being filled, means for applying a force to an exposed surface of the molding medium in the filled container, and means for rotating the filled container while at the same time vibrating the filled container in defined subportions of the volume of the container.

The above and other objects of the invention are further achieved by a vessel holding the molten metal over the container containing the packed molding medium and pattern, a flexible refractory means disposed over and conforming to an exposed surface of the compacted molding medium in a portion of the container between the exposed surface of the molding medium and the vessel, means for clamping the vessel to the container so that the vessel and container form a locked unit, means for supplying and guiding the molten metal directly into the pattern in the container and for stopping the flow of molten metal so that excess molten metal remains in the vessel, the flexible refractory means clamped between the molding medium exposed surface and the vessel compensating for space between the exposed surface and the vessel, and allowing the hydrostatic pressure of the molten metal to be developed from an upper surface of the molten metal in the vessel when it displaces the pattern. Thus, a sufficient hydrostatic or metallostatic pressure head can be obtained, allowing efficient direct guidance of the molten metal into the mold. The molten metal is thus directed to the mold in a continuous stream, and the pressure head developed in the vessel insures adequate penetration of the molten metal into the mold.

Preferably, a gas evolution measuring probe means is inserted into the compacted molding medium for measuring the rate of gas evolution from the evaporating pattern and means are provided for adjusting the flow rate of the molten metal so that a predetermined gas pressure is maintained within the container. Preferably, the apparatus also includes means for treating the gases resulting from the evaporation of the pattern. Furthermore, means are provided for removing the container from the vicinity of the vessel and for removal of the flexible refractory means. In some casting processes, the controlled removal of the flexible refractory means after the metal pouring operation may allow for increased quality control by eliminating the hot tear problem which occurs when a rapidly cooling metal outer surface goes through a crystallization phase resulting in shrinkage of the casting.

The present invention further provides for a passive cooling zone storage means wherein the poured casting undergoes a cooling time, the cooling time being monitored and controlled so that the metallurgical parameters influenced by the rate of cooling can be precisely controlled and updated in order to refine the controllable aspect of the process.

The above and other objects of the present invention are further achieved by methods for use with the above described apparatus.

Yet a further apparatus and method in accordance with the invention provides for the removal of the cooled casting from the container while the molding medium around the casting is aerated. Since the surrounding molding medium is of unbonded material, a conventional mechanical vibrating shakeout device is not needed for the removal of the casting from the molding medium or for removing the molding medium from the casting. Once removed, the casting may be cleaned by known techniques, for example, shot or sand blasting, water blasting, etc. in a closed system and prepared for machining and/or use.

The invention further provides an apparatus and method for the recycling of the unbonded molding medium. The molding medium may be removed from the container into a transport means, screened for fused particles and impurities and reused once again as the molding medium for another casting.

The invention further comprises an apparatus and method for treating the gases generated by the evaporation of the pattern into environmentally safe products.

According to a further aspect of the invention, the molding medium may be removed by a suction air conveyor from the container after the casting has been removed. The unbonded molding medium may then be screened in order to remove any trapped metal or fused molding medium and the screened medium cooled in a heat recovery system, cleaned and reused in the production of another casting.

In a further embodiment of the invention, the container filled with the evaporative pattern and compacted molding medium may be fitted with a flexible refractory means and cover, turned 180° and molten metal forced upwards through a valve means into the pattern in the molding medium. This results in an operation whereby the pattern is displaced by the molten metal such that the displacement of the pattern by the metal can be more specifically controlled against gravitational forces. Furthermore, the gases formed by the evaporating pattern do not, in this embodiment, percolate through the molten metal because the metal is flowing upwardly while the generated gases at the same time are rising ahead of the advancing molten metal. This results in a purer, higher quality casting. This is especially significant in the manufacture of iron or steel castings. The valve means can be operated so as to close off the supply of molten metal into the pattern at the proper time while simultaneously turning off the pumping source forcing the metal into the mold thereby allowing the container to be rotated into its upright position while the casting is still molten or semi-molten, thus saving production time and increasing efficiency.

Other objects, features, and advantages of the invention will be apparent from the detailed description which appears below.

BRIEF DESCRIPTION OF THE DRAWINGS

The present invention will be described in greater detail in the following detailed description with reference to the drawings in which:

FIG. 11 is a detailed front view of the pouring container at the pattern insertion and molding medium dispensing and packing station shown in FIG. 5;

FIG. 16 is a detailed cross sectional view of the molding medium dispensing device shown in FIG. 15 when in its dispensing position;

FIG. 17 is a detailed sectional view of the molding medium dispensing device shown in FIG. 15 in its closed position;

FIG. 19 is a side view of the pouring container and the vibrating device shown in FIG. 4;

FIG. 31 is a sectional view of the molten metal pouring vessel in position above the filled and compacted pouring container shown in FIG. 30;

FIG. 32 is a sectional view of the molten metal pouring vessel shown in FIG. 31 placed on top of the pouring container;

FIG. 43 is a side view of the molding medium recovery and recycling station of the apparatus shown in FIG. 41 while the pouring container is being rotated;

FIG. 47 is a sectional view of a pouring container holding a pattern and compacted molding medium for use with an alternative embodiment of the invention for supplying the molten metal into the pouring container;

FIG. 48 is a sectional view of the pouring container having an a attachment allowing molten metal to be pressure fed into the pouring container shown in FIG. 47;

FIG. 50 is a sectional view of the container showing the removal of the casting in the alternative embodiment shown in FIGS. 47–49.

DETAILED DESCRIPTION

Figure 1:
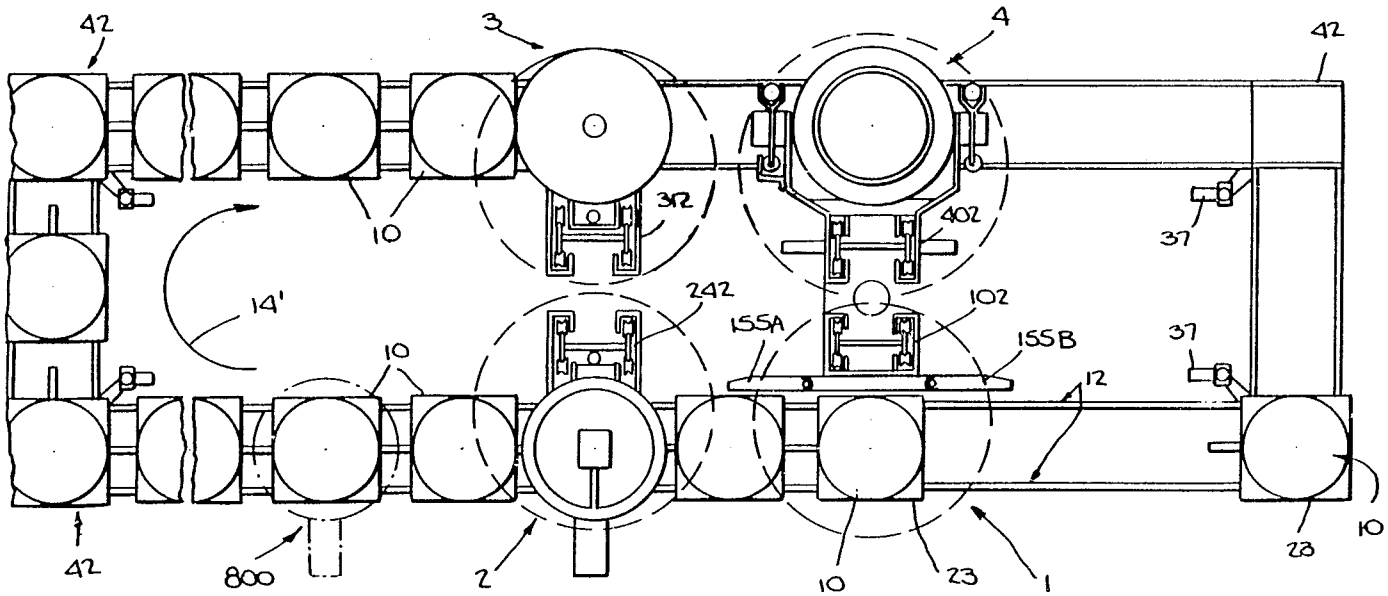
FIG. 1 is a top view of one embodiment of the evaporative pattern casting apparatus according to the invention showing the four stations of the apparatus including a pattern insertion and molding medium dispensing and packing station, a metal pouring station, a casting removal station and a molding medium recovery and recycling station.

With reference now to the drawings, apparatus for evaporative pattern casting according to the invention are shown. In FIG. 1, a top view of the basic layout of the apparatus is shown. The apparatus may comprise four basic operation stations as shown. Station 1 is the pattern insertion and molding medium dispensing and packing station, station 2 is the molten metal pouring station, station 3 is the casting removal station and station 4 is the molding medium recovery and recycling station. A pouring box or pouring container 10 is transported on a cart 23 through the four stations along two rails 12 of a conveyor system which form a closed loop through the four stations. In this specification, the container 10 is generally described as a "pouring container" because it receives the molten metal ("pouring") which displaces the evaporative pattern disposed therein.

As shown, the conveyor system may be arranged as a rectangular loop, with turntables 42 located at each corner for direction changing. In FIG. 1, a plurality of pouring containers 10 are shown to the left forming an open loop 14. These containers each hold an individual casting or casting cluster which is undergoing a cooling period prior to removal of the casting or cluster at station 3. Varying cooling times for different metals and alloys can be accommodated by arranging suitable bypass or spur tracks in the conveyor system.

The pouring container 10 is shown in greater detail in FIGS. 4, 11, 14, and 17. The container 10 is received on a base 22 of a cart 23 having wheels 32 received on rails 12. The container preferably is circular in shape and preferably is formed of a plurality of sections including a hollow lower section 50, three middle sections 52, 54, and 56 and a top section 58. All five sections are connected together by bracing clamping members 60 connecting top section 58 to lower section 50. Four elastic membranes 62 (e.g., rubber) are provided to isolate the three middle sections from each other and the upper 58 and lower 50 frame sections. Furthermore, the lower section 50 includes a perforated base 64 preferably comprising a metal plate having apertures 64A containing porous plugs made of an incompressible material such as a sintered bronze, which allows gas to permeate into and out of the molding medium contained within sections 52, 54 and 56 but prevents the molding medium from falling into the section 50. Each middle section includes two vibrator connectors 68A, 68B disposed on opposed surfaces thereof adapted to receive respective ones of vibrating devices 168A, 168B to be described later.

The container 10 may comprise additional sections separated by plastic membranes, as required depending on the size of the container and/or casting. Furthermore, the container may have other than a circular cross section, although a circular cross section is preferred in the illustrated embodiment wherein external vibrating compacting devices are used, as will be explained in detail later.

The conveyor system for the pouring container 10, shown in more detail in FIGS. 6, 7, 8, 9, and 10, includes a third rail 20 which is disposed adjacent the two rails 12. The base 22 for receiving the pouring container 10 includes a switching mechanism 24 operated by a lever 24A and an electrical pickup mechanism 26 which picks up electricity from contact strips 28 mounted along the third rail 20. The base 22 receiving the pouring container 10 further includes an electrical motor 30 which powers the wheels 32 supporting the base 22 for the pouring container 10. A remotely activated switching mechanism 34 mounted at various points along the third rail 20 cuts off the electrical current flowing to the motor 30 when the lever 24A of switching mechanism 24 comes into contact with a cam 36 operated by the mechanism 34. This stops the pouring container 10 at various points along the rails 12 allowing the various operations to take place. Such a switching mechanism 34 is also disposed at corners of the rectangular conveyor system, allowing sensing of the presence of the container 10 at the particular corner, thereby permitting rotation of the container by a turntable 42 at the corner. After an operation or direction change at a corner takes place, the mechanism 34 is activated, thereby moving switching lever 24A and allowing electrical current to flow to motor 30 so that the pouring container 10 can move on to the next operation along the casting line.

Figure 6:
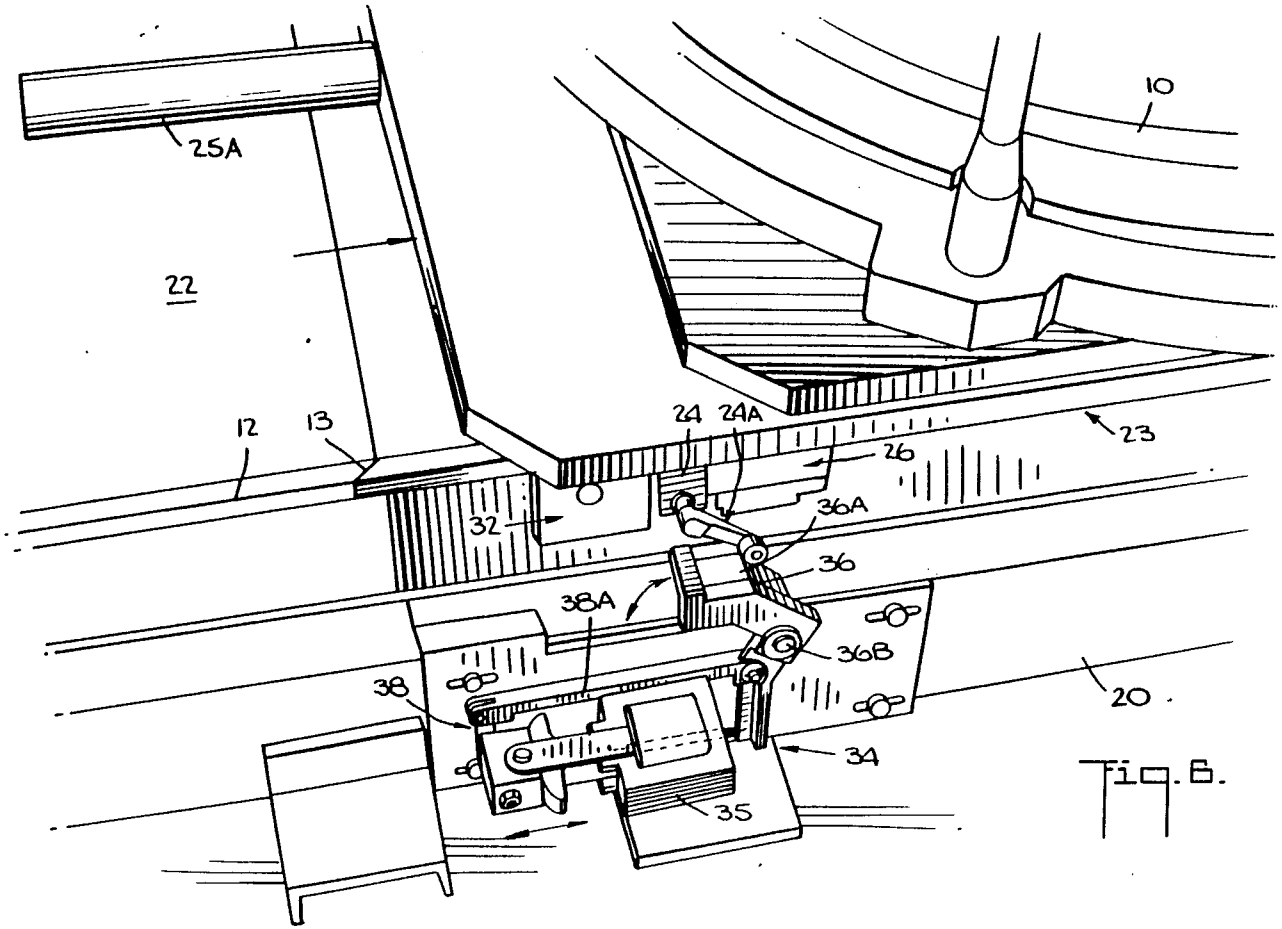
FIG. 6 is a detailed perspective view of a part of the conveyor system for the pouring container.
Figures 7, 10:
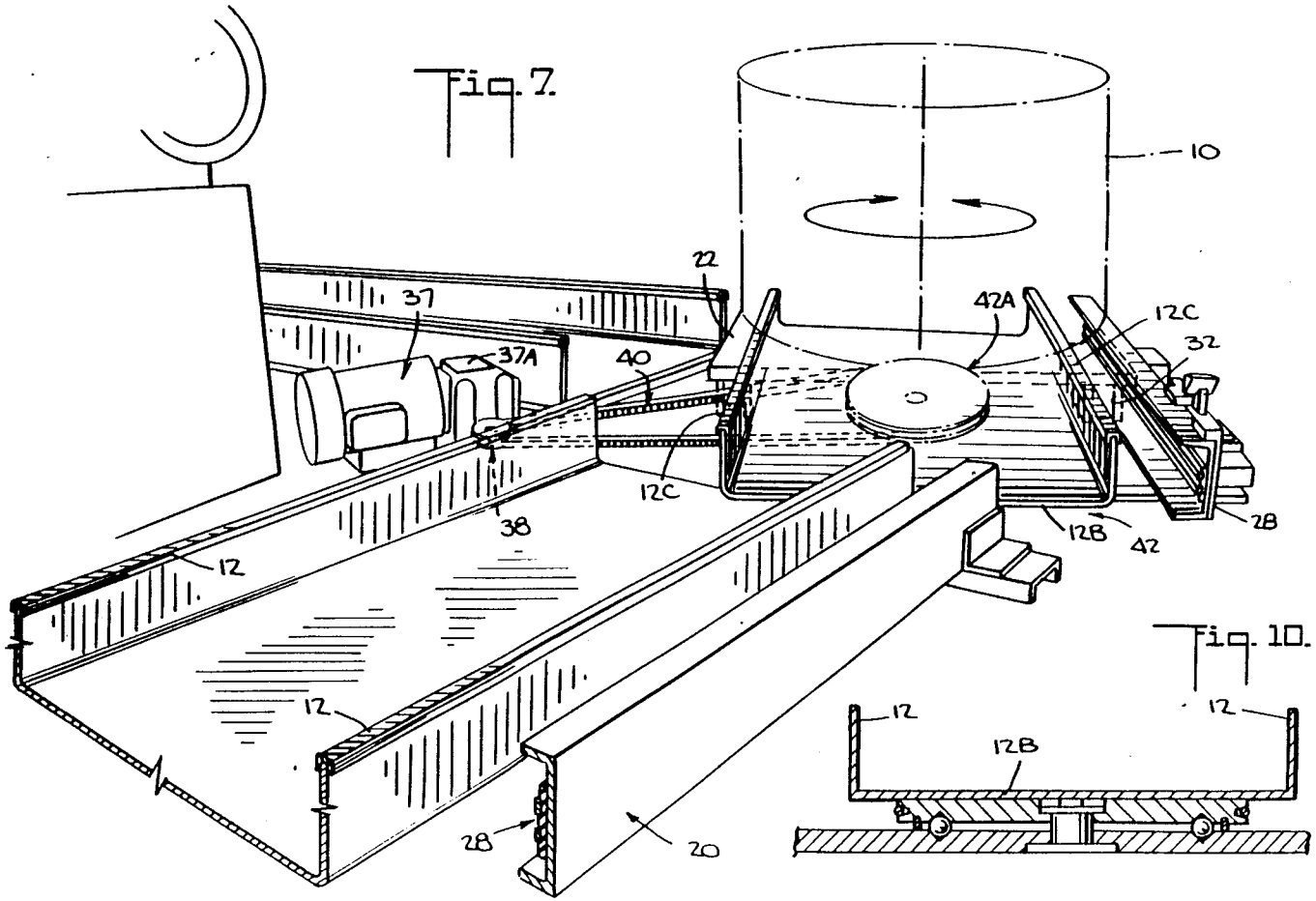
FIG. 7 is a detailed perspective view of a portion of the conveyor system for the pouring container shown in FIG. 1.
FIG. 10 is a cross sectional view of a portion of the conveyor system taken along line 10—10 of FIG. 9.

As shown in FIG. 6, switching mechanism 34 comprises a solenoid 35 which operates a mechanical linkage 38. Linkage 38 operates cam 36. Cam 36 is shown in the activated position in FIG. 6 so that base 22 carrying pouring container 10 will be stopped once lever 24A rides to the top 36A of cam 36. To allow further movement of base 22, solenoid 35 is remotely activated so that arm 38A moves to the right, thereby pivoting cam 36 about pivot point 36B in a counter-clockwise direction and allowing lever 24A to move downwardly in a clockwise direction, thus providing electrical power to motor 30.

Figure 8:
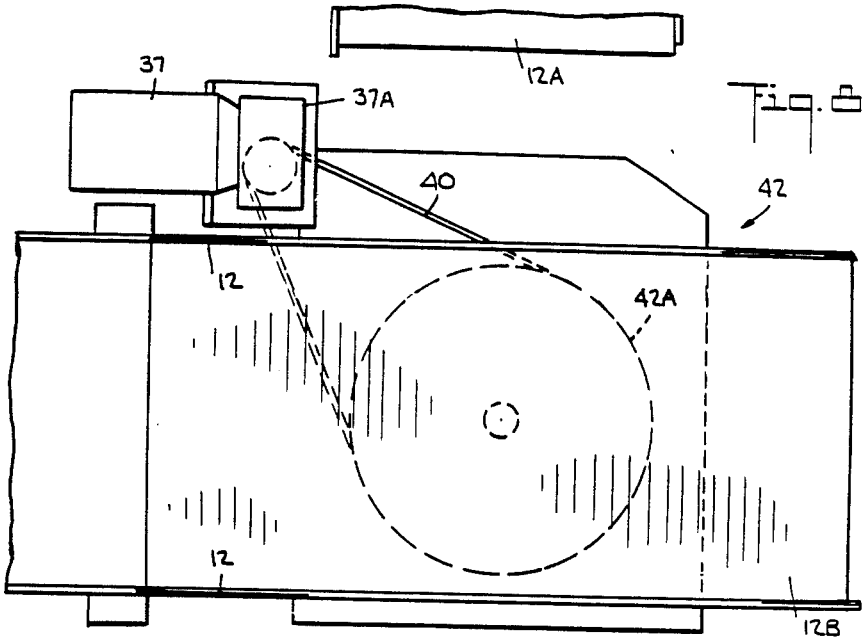
FIG. 8 is a top view of a portion of the conveyor system shown in FIG. 7.
Figure 9:
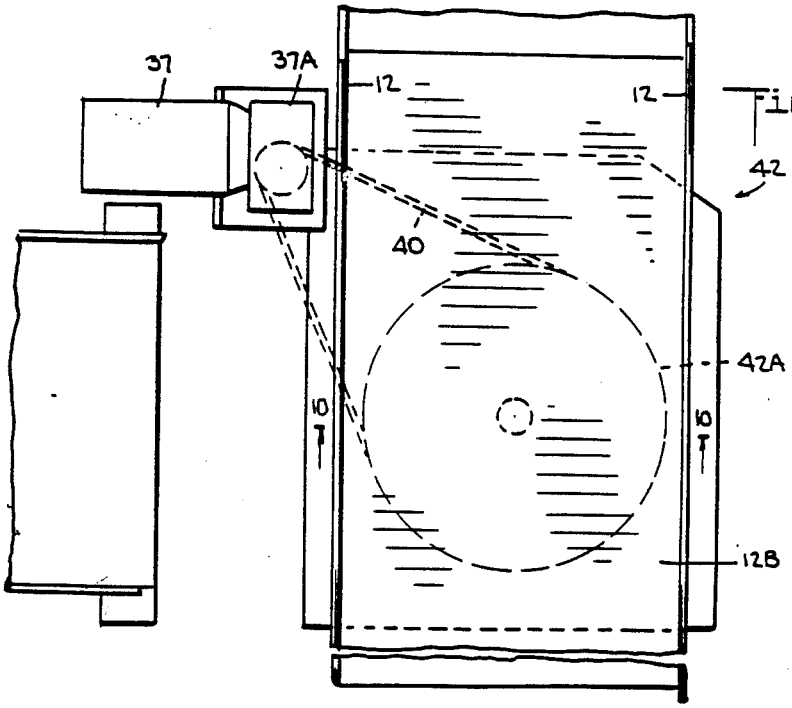
FIG. 9 is a top view of a portion of the conveyor system shown in FIG. 7 after it has been turned 90 from the position shown in FIG. 8.

In the embodiment illustrated, the casting line is generally in a rectangular shape as shown in FIG. 1. The four straight sections of rails 12 comprising the rectangle are connected by a turntable 42 as shown in FIGS. 8 and 9 in more detail at each one of the four corners. As shown in even greater detail in FIG. 7, this turntable system consists of an electric motor 37 which drives a pulley or sprocket 38 through a suitable transmission 37A. Pulley or sprocket 38 moves a belt or chain 40 to turn a second pulley or sprocket 42A coupled to the turntable 42 upon which a section of the two rails 12 and the third rail 20 are mounted.

When a pouring container 10 reaches the end of a straight section of the rectangular loop, a switching mechanism 34 already described switches off the electrical power to the cart motor 30, thus bringing it to a halt. The turntable electrical motor 37 is then turned on and it proceeds to rotate the turntable 42 by 90° thus allowing the rotated two rails 12 and the third rail 20 to join with the next straight section of rail 12A as shown in FIG. 9. To facilitate orienting the rails 12, preferably they are made with angular cut mating sections, as shown at 13 in FIG. 6.

As shown, for simplicity, rails 12 may comprise a single piece of channel-like material 12B having appropriate rail surfaces 12C attached thereto.

The movement of the pouring container 10 is monitored by a computer controlled console as the pouring container 10 moves through the four operation stations. The computer control unit may comprise, e.g., any one of a number of computers, for example, an IBM PC-XT or PC-AT, as will be understood by a person of skill in the art.

The rectangular conveyor loop described offers advantages in efficiency and space saving. Such a system, including the turntables described, also offer advantages such as the ability to provide spur tracks where, e.g., castings can be stored for cooling after pouring, thus preventing interference with other foundry operations.

Of importance in the overall design of the conveyor system is that it be smooth operating, especially after compaction of the molding medium around the evaporative pattern in the container and during and after displacement of the pattern by the molten metal. These steps will be explained in greater detail below.

Each cart 23 includes a bumper rod 25A for sensing impact of the cart 23 with another cart 23 in the system. Rod 25A is coupled to a sensor switch, which, when actuated, indicates that the cart 23 has impacted another cart, thus deactivating the cart motor and stopping the cart.

Figure 2:
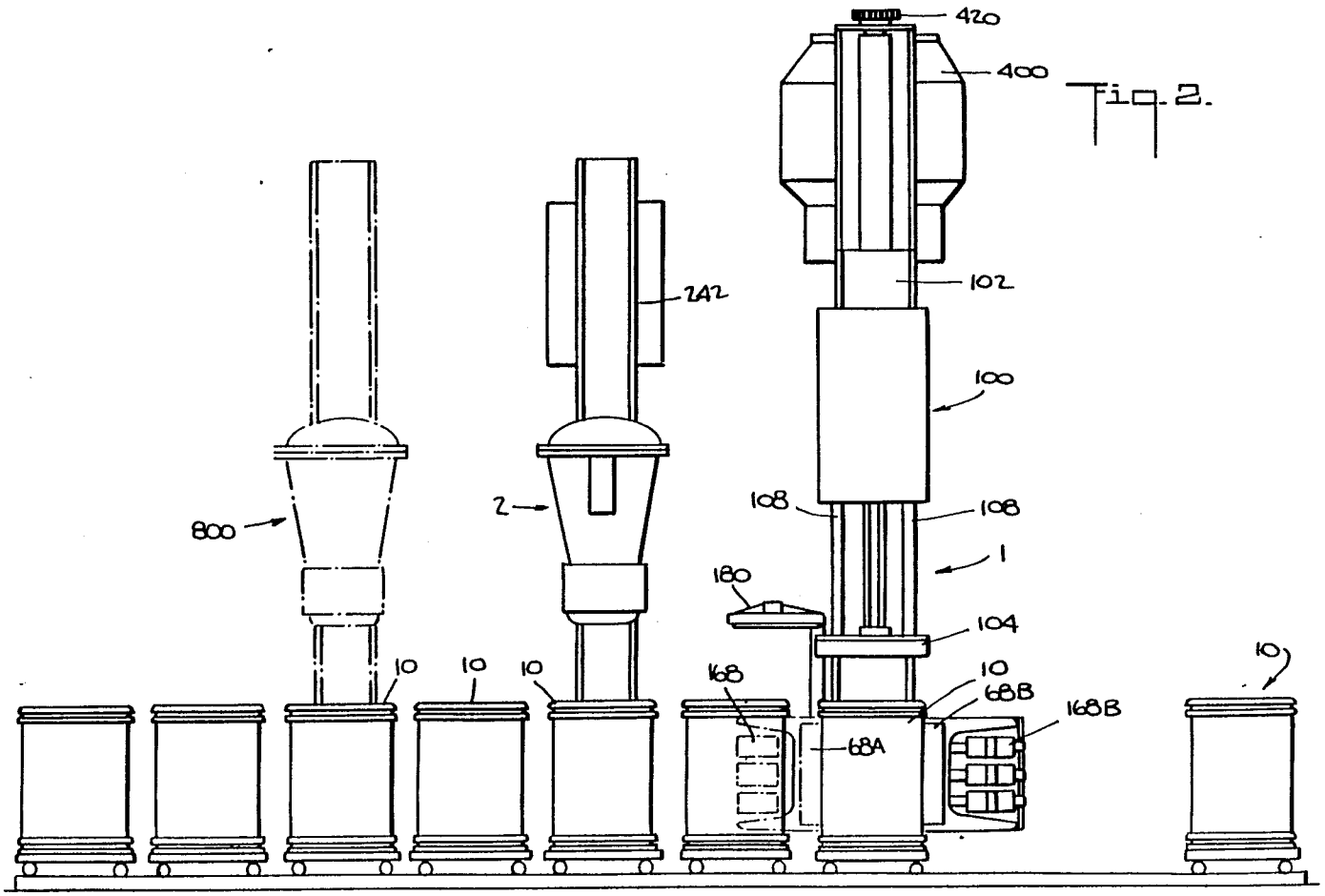
FIG. 2 is a front view of the pattern insertion and molding medium dispensing and packing station and molten metal pouring station of the apparatus shown in FIG. 1.
Figures 12, 13, 14:
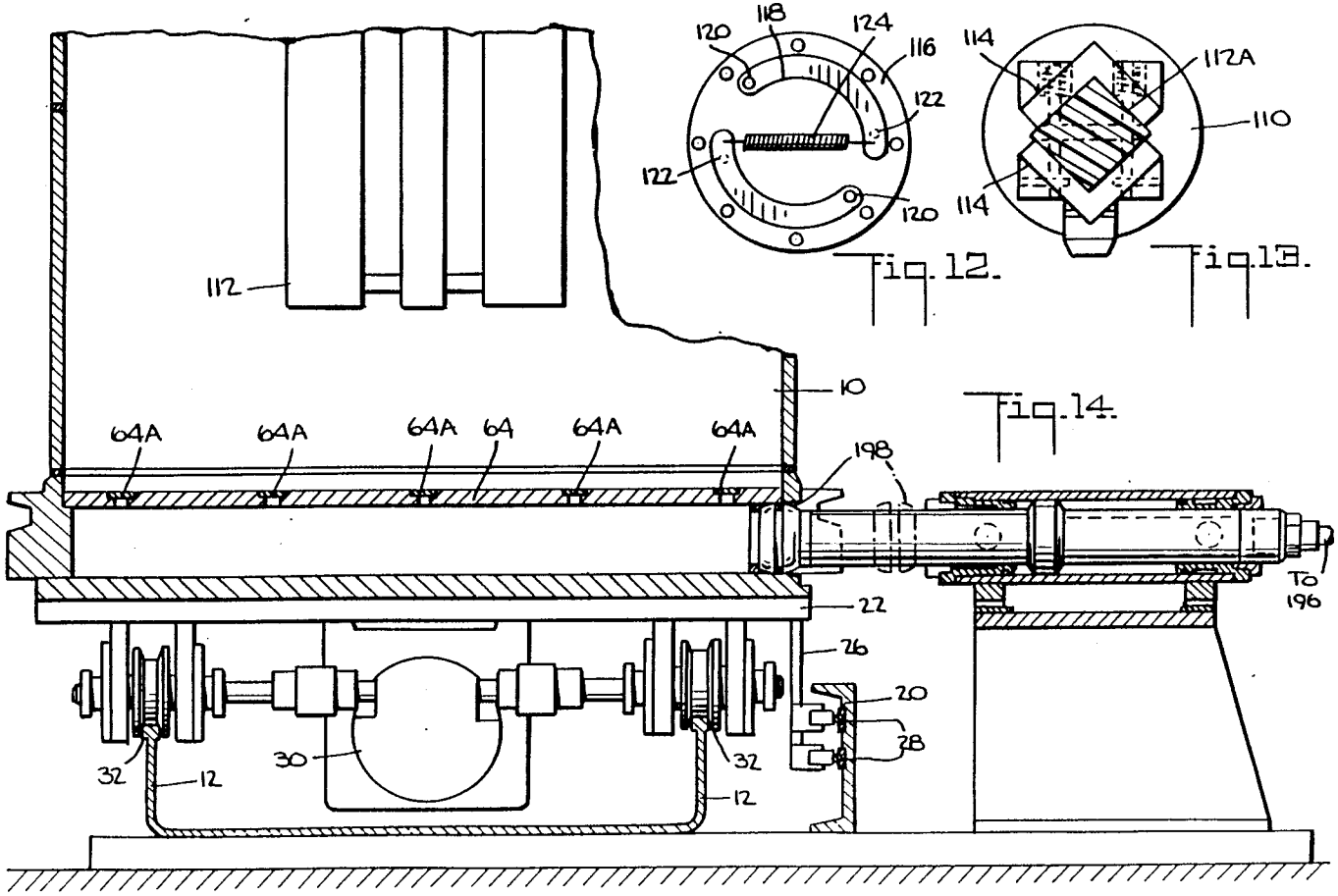
FIG. 12 is a detailed bottom view of the molding medium dispensing mechanism shown generally in FIG. 11.
FIG. 13 is a detailed bottom view of the pattern holding device shown generally in FIG. 11.
FIG. 14 is a detailed cross sectional view showing the pouring container conveyor system shown generally in FIG. 1 and a vacuum applying system shown generally in FIG. 4.
Figure 17A:
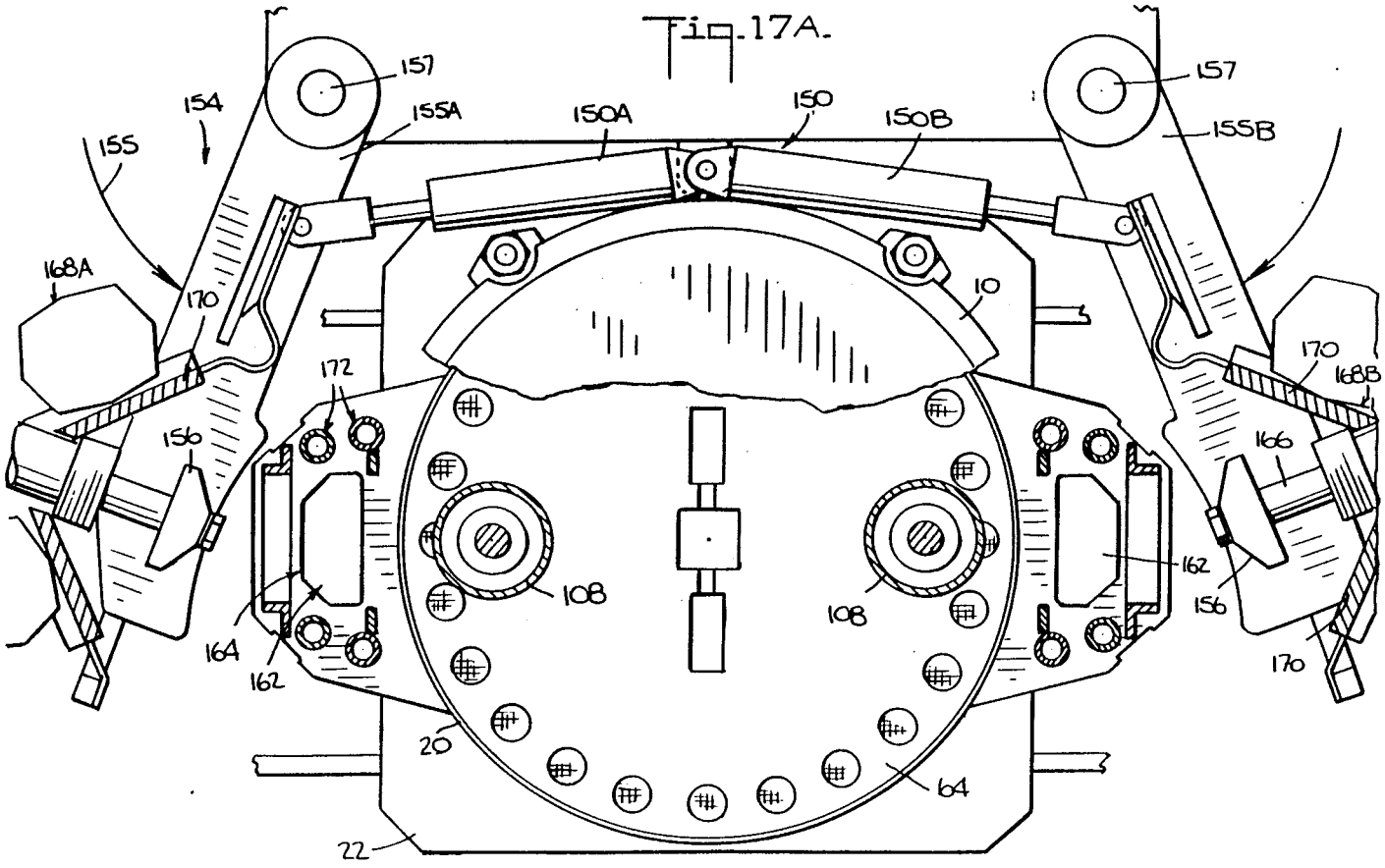
FIG. 17A is a top view of the pouring container at the pattern insertion and molding medium dispensing and packing station and the vibrating device shown in FIG. 4 with the vibrating device disconnected from the container.
Figure 18:
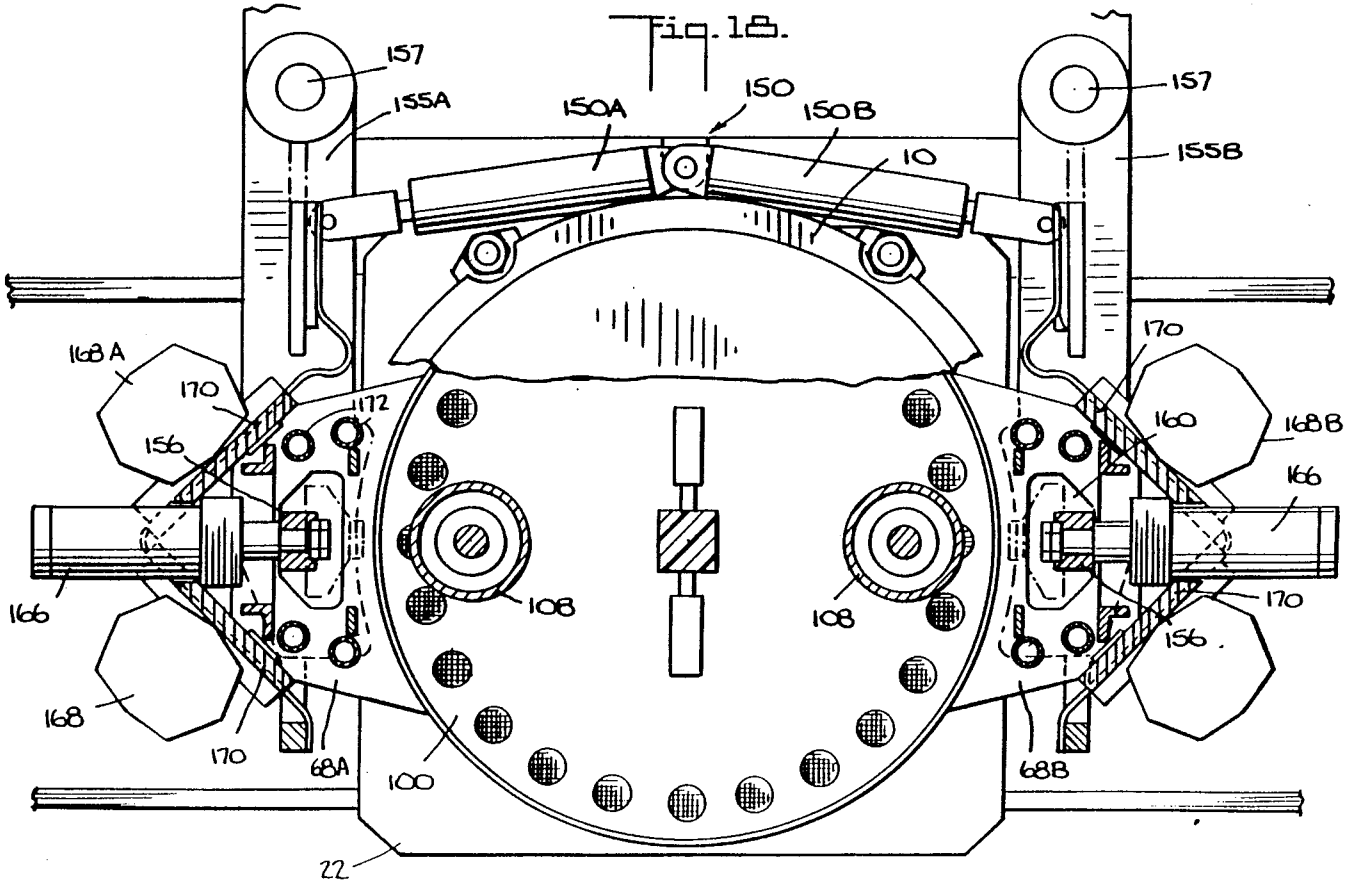
FIG. 18 is a top view of the pouring container at the pattern insertion and molding medium dispensing and packing station and the vibrating device shown in FIG. 4 with the vibrating device attached to the container.

A front view of operation stations 1 and 2 is shown in FIG. 2. In operation station 1, the pouring container 10 is brought to a stop by means of a switching mechanism 34 located beneath the molding medium hopper 100. Molding medium hopper 100 may be filled with the molding medium described in U.S. Pat. No. 4,651,798 to Rikker, the applicant herein. Other conventional molding media suitable for evaporative pattern casting may also be used. As further shown in FIGS. 3 and 5, the molding medium hopper 100 is mounted for vertical movement along a beam 102. A hydraulic ram 101 can be provided for effecting such movement. A top 104 for coupling to the upper frame 58 of the pouring container 10 is mounted to the bottom of the molding medium hopper 100. A hydraulic ram 105 movably couples the top 104 to hopper 100. Two hollow tubular members 108 extend from the bottom of hopper 100 slidably through two holes 106 in the top 104 fitting over the upper frame 58 of the pouring container 10. The top 104, as shown in FIGS. 11 and 13, includes a gripping chuck 110 for holding the evaporative pattern 112 of the object to be cast in its jaws 114, (see FIG. 13) preferably by a sprue 112A formed with the pattern. As shown, jaws 114 may comprise two L-shaped clamping members between which the sprue 112A of the pattern is received. The sprue 112A, as will be explained later, also forms the leader by which molten metal is fed to the pattern in the subsequent metal pouring step.

Once the cart 23 is positioned at station 1, the pattern 112 clamped in the jaws 114 is lowered into the container. The jaws 114 maintain a fixed orientation of the pattern in the container, which is important for later automatic processing of the formed casting. Once the pattern has been disposed in the container, it is held there by jaws 114 while molding medium is dispensed into the container around the pattern. The dispensing of molding medium will now be explained.

The lower end of tubular members 108 includes a base plate 116 and two arc-shaped members 118 which are pivotally attached at one end 120 to the base plate 116. These arcshaped members 118 cover holes 122 in the base plate 116. Base plate 116 is coupled to a shaft 128 of a motor 129. Shaft 128 is also vertically movable in addition to being rotatable. When shaft 128 is still, holes 122 are covered by members 118. When, however, shaft 128 attain a rotational velocity which overcomes the force of the spring 124 holding the arc-shaped members 118 over the holes 122, the members 118 centrifugally pivot about pivot points 120 and allow the molding medium to fall through the holes 122 into the container 10 as shown by arrows 117.

Openings 122 allow the molding medium to be dispensed into the container 10 downwardly. Rotation of base plate 116 also allows the molding medium to be spread laterally in container 10, thus aiding in scattering the medium around and into any passageways in the pattern.

In addition to the described action, shaft 128 is also vertically movable, thereby forcing base plate 116 downwardly, forming an additional opening 132 to aid in dispensing of the molding medium, as shown by arrows 119.

Figure 15:
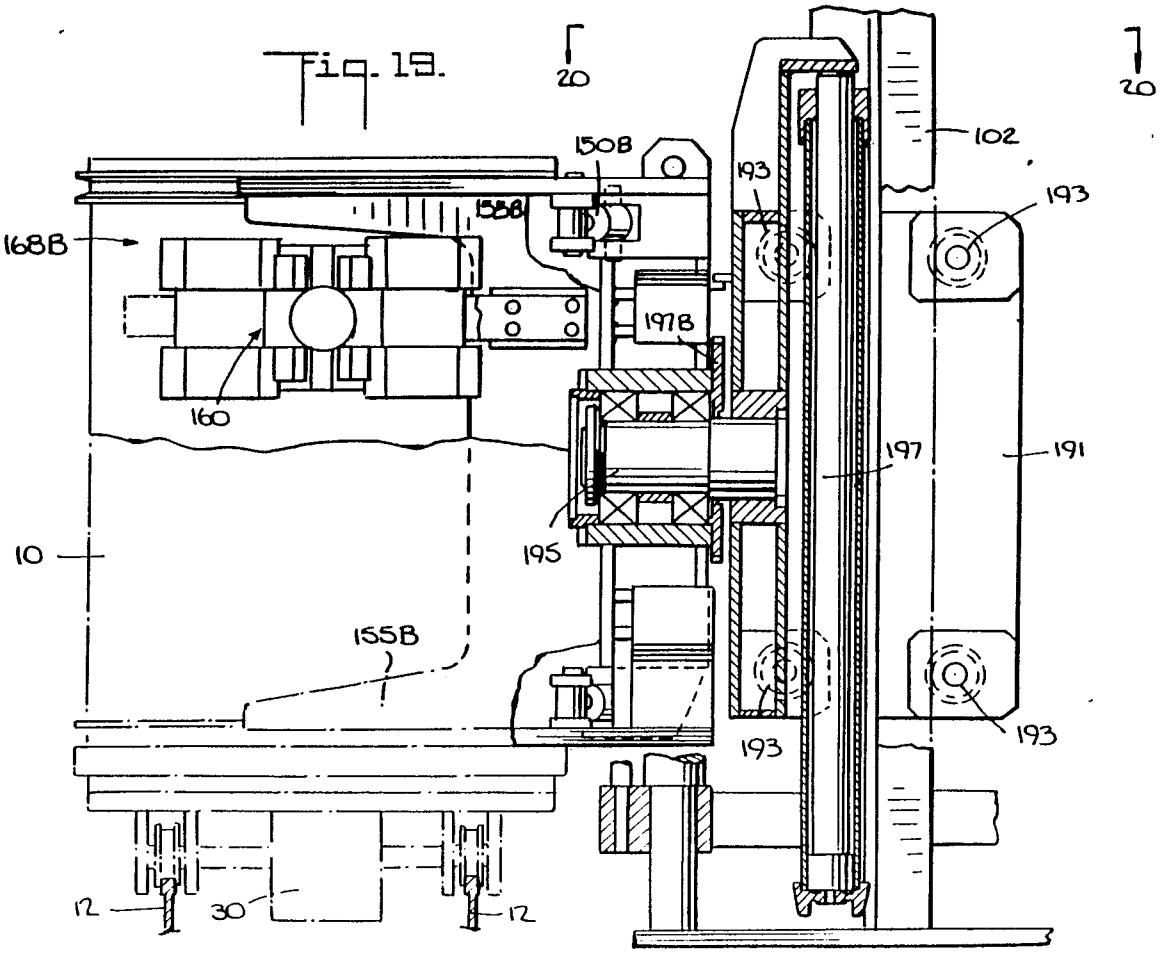
FIG. 15 is a cross sectional view of the molding medium dispensing device of the pattern insertion and molding medium dispensing and packing station shown generally in FIG. 3.

FIGS. 15, 16, and 17 show in detail the path of the molding medium from the hopper 100 down through the tubular members 108 and through the two openings 122 in the base plate 116 and the opening 132. Shaft 128 is mounted in a hollow area 130 within the center of each member 108. Molding medium travels down members 108 through the area between the outer surface of member 108 and an inner tube 131, as shown by arrows 133 in FIG. 15. FIG. 17 shows the bottom plate 116 in a closed position relative to members 108. Rotation of base plate 116 by shaft 128 aids in spreading the molding medium into all areas of the container 10. Motor 129 is disposed in a sealed container 129A located in hopper 100.

As shown in FIGS. 17A–20, once the pouring container 10 is in position at operation station 1, a hydraulic system 150 comprising a pair of hydraulic rams 150A and 150B connects left and right vibrator groups 168A and 168B with vibrator connections 68A and 68B disposed on the pouring container 10. Each vibrator group 168A, 168B comprises three pairs of vibrators disposed on a respective arm 155A, 155B pivoted about a pivot point 157. Each pair of vibrators is disposed side by side in a horizontal plane at one of three levels each corresponding to the vibrator connector points 68A, 68B. The vibrators 168A, 168B preferably are disposed at angles converging toward each other at a point located near the center of the connections 68A, 68B. Such an arrangement aids in concentrating the vibrational forces into the container. Also, the vibrational forces from the two vibrators forming a pair on each side are synchronized with each other and with the corresponding vibrator pair on the opposite side. Thus the vibrator pair on one side generates a force in one direction while the vibrator pair on the opposite side directs a corresponding force in the opposite direction. For example, if the vibrator pair on one side generates a force to the left, the vibrator pair on the other side generates a force to the right. Thus, both left and right vibrator pairs generate forces directed respectively into or away from the container 10 at the same time. This provides balances vibrational forces, as will be explained further below.

Figure 4:
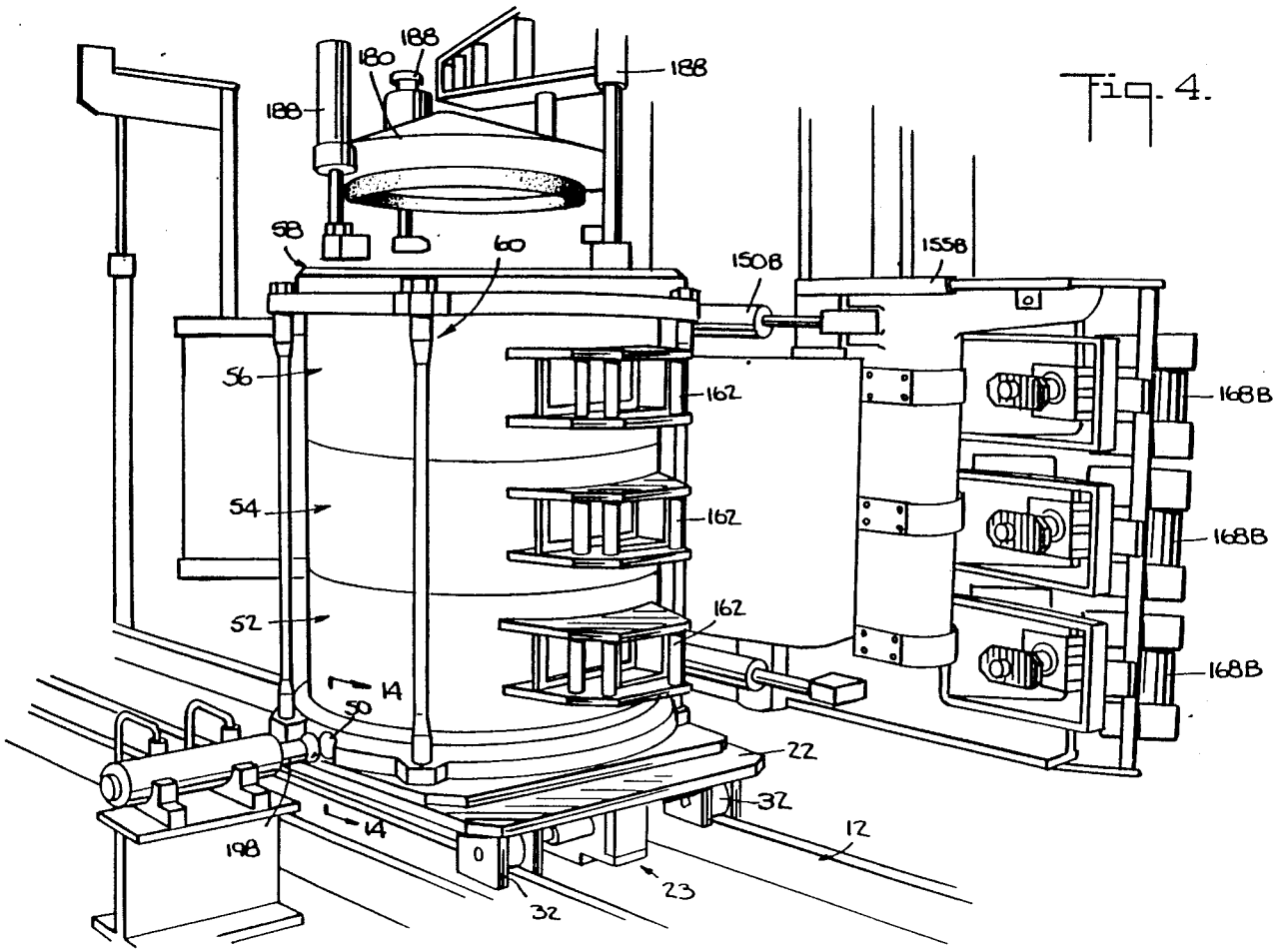
FIG. 4 is a more detailed perspective view of the pouring container for receiving the evaporative pattern and molding medium, a compensating cover for the container and a vibrating device shown only generally in FIG. 2.

The connecting mechanism of each vibrator pair 168A, 168B comprises a rotatable head 156 which, when horizontal, fits into space 162 of the vibrator connection points 68A, 68B (see FIG. 4). Once the head 156 is inside the space 162, it is turned to a vertical orientation and pulled back against surface 164 by hydraulic ram 166 which forces vibrator surfaces 170 up against the vibrator connection points 68A, 68B. See FIG. 18. Also at this time, as shown in FIG. 14, a coupling connection 198 is made to the lower hollow section 50 of the pouring container 10 by means of a suitable electrical, air or hydraulically powered device. This connection 198 can be coupled to a vacuum pump 196 in order to create a vacuum inside the pouring container 10 by withdrawing air via perforated base 64 as the molding medium is being dispensed from the members 108.

Figure 22:
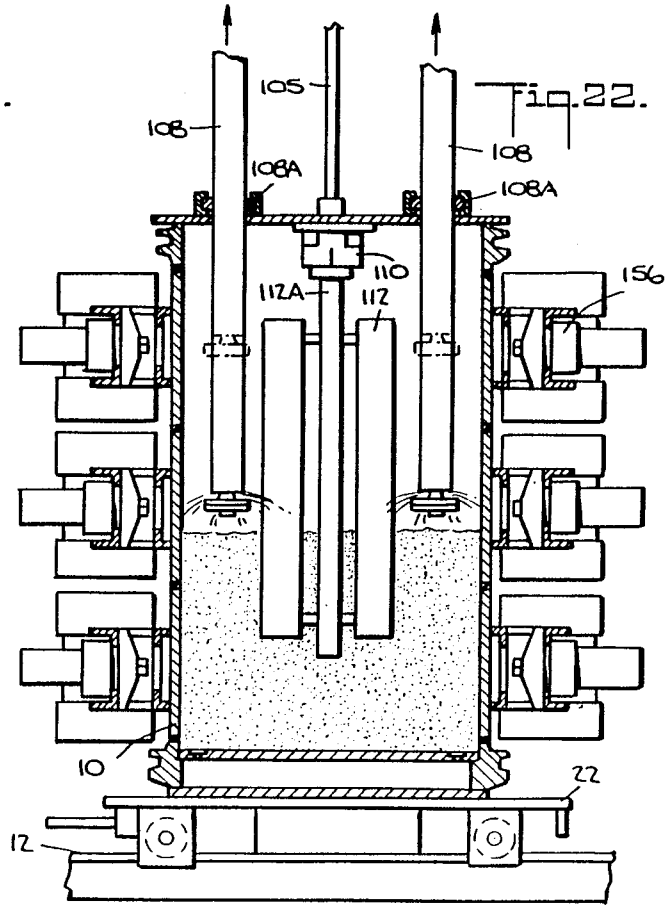
FIG. 22 is a sectional view of the pouring container and the vibrating device shown in FIG. 21 while the molding medium is being dispensed and packed around the pattern inside the pouring container.
Figure 21:
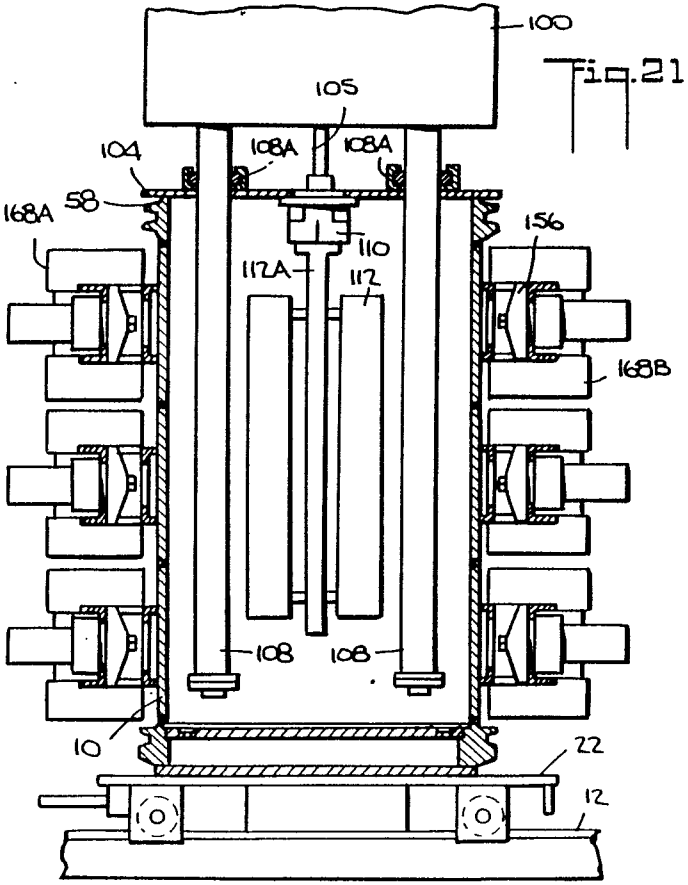
FIG. 21 is a sectional view of the pouring container and the vibrating device shown in FIG. 4 after the pattern and the molding medium dispensing device shown in FIG. 3 have been initially inserted into the container.
Figure 23:
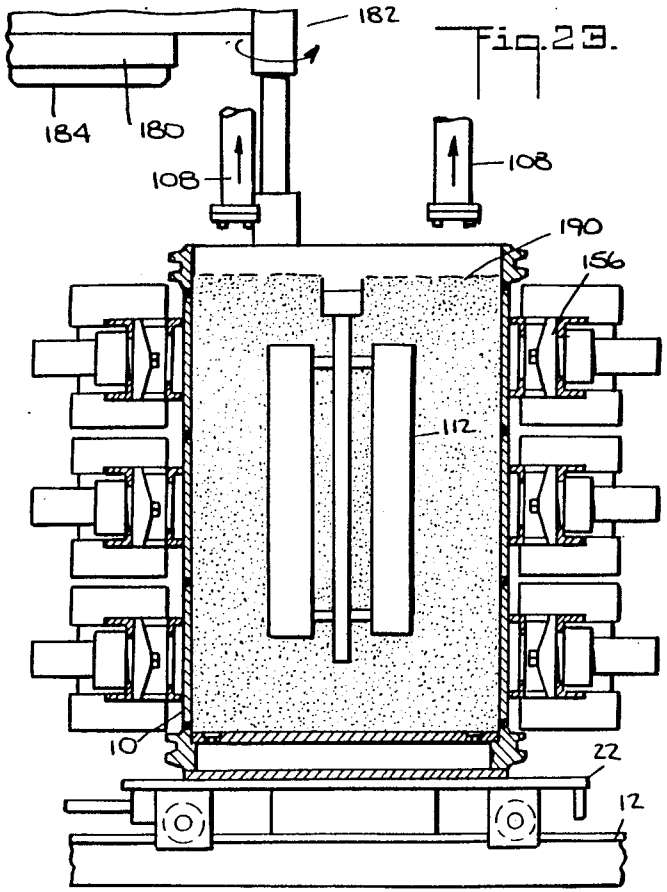
FIG. 23 is a sectional view of the pouring container and the vibrating device shown in FIG. 21 after the pouring container has been filled with molding medium.

The filling of the pouring container 10 with molding medium is shown in detail in FIGS. 21–23. The molding medium hopper 100 and the top 104 of the pouring container 10 are lowered down along beam 102 until the top 104 contacts the top 58 of the pouring container 10. The tubular members 108 are slidably movable with respect to the top 104 in a vertical direction in bearing surfaces 108A and continue into the pouring container 10. As the bottom of members 108 reach the bottom of the pouring container 10, the base plate 116 is forced downward and rotated by shaft 128. As heretofore explained, the rotation forces arc-shaped members 118 in an outward direction allowing the molding medium to fall underneath the base plate 116 through holes 122. The downward movement of base plate 116 also allows the medium to escape through opening 132. As the molding medium fills the pouring container 10, a rotational torque sensor attached to shaft 128 senses the height of the molding medium as it begins to rise in the pouring container 10 since the rotation of the shaft 128 is slowed by the rising medium. The members 108 along with hopper 100 are moved upwards ahead of the rising molding medium based on the sensed torque. Alternatively, members 108 can move upwardly in relation to hopper 100, with hopper 100 remaining motionless. As members 108 move upwardly, dispensing molding medium, jaws 114 continue to hold pattern 112 in a fixed orientation in the container 10.

As each of the three sections 52, 54, and 56 of the pouring container 10 are filled with the molding medium, each corresponding left and right pair of vibrators 168A, 168B for that section are simultaneously turned on in order to compact the molding medium as that section of container 10 is being filled. Once a section is filled, the corresponding vibrators 168A and 168B for that section are turned off and the vibrators I68A and 168B for the next section are turned on as the next section is filled. This is termed "planar" compaction herein, since it is done consecutively in a series of defined portions of the total volume of the container 10 corresponding to each section of container 10. The vibrational compacting forces are essentially directed in horizontal planes, thus avoiding any relative vertical displacement of the pattern and the container. The rubber membranes 62 between the separate sections and upper and lower frames of container 10 serve to insulate each section so that the vibrational forces are localized in one volume corresponding to that particular section being vibrated. After the pouring container 10 is filled to the top 58 and the compaction in each of the sections performed, the rotation of shaft 128 is stopped and the base plate 116 is pulled up in order to close space 132, the holes 122 having been closed by return of the arc-shaped members 118 to their idle position. Jaws 114 are released and the molding medium hopper 100, the tubular members 108, and the top 104 are moved, upwards out of the area immediately above the pouring container 10 along beam 102. The connection 198 is also disconnected at this time.

The so-called "planar" compaction of the molding medium wherein the molding medium is vibrated horizontally in a plurality of volume zones in sequence has an advantageous effect. In addition to vibrating the molding medium essentially in horizontal planes to prevent relative displacement of the pattern and container and so that it compacts closely and fills all spaces and passageways in pattern 112, including internal cavities such as engine block cooling and oil galleries, planar compaction prevents deformation of the lightweight and easily deformed pattern 112. Deformation of lengthy patterns is a serious problem in the evaporative pattern casting process. Such deformation is caused by excessive compaction in the lower portions of the container 10 as opposed to the upper portions. If the entire container is vibrated as a unit, the lower portions will be compacted excessively compared to the upper portions, resulting in the compacted molding medium crushing the pattern near the bottom. This can make an entire production run of castings useless if casting tolerances are exceeded.

The present invention solves this problem by vibrating and thus compacting in defined volume zones. Thus, the molding medium in the lower areas of container 10 will not be unduly compacted compared to the molding medium in the upper areas and substantially no deformation will result. The use of elastic membranes 62 between the sections of container 10 helps to isolate vibrational forces in a particular zone.

Figure 30:
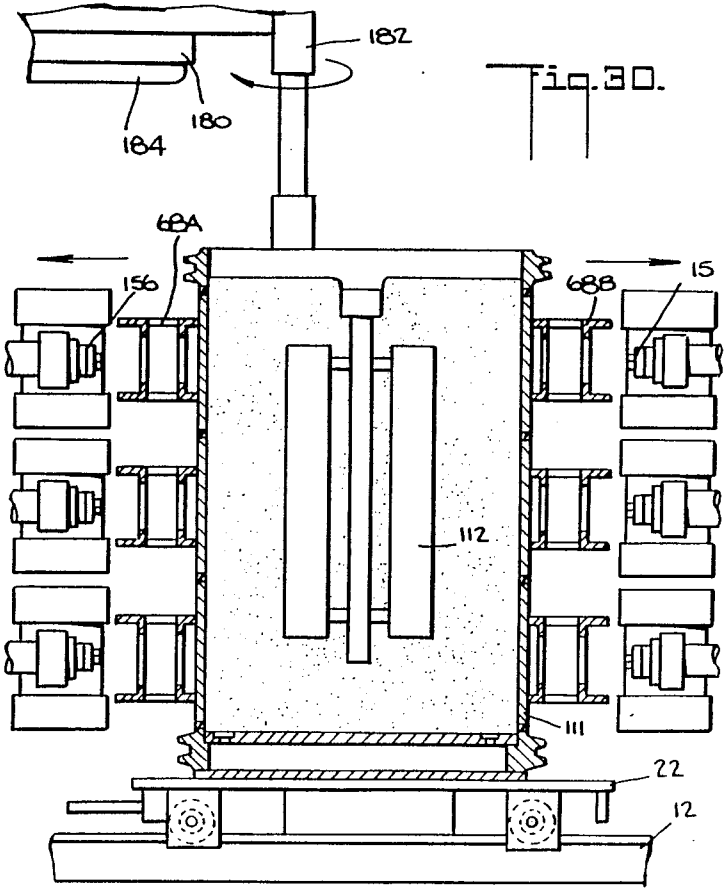
FIG. 30 is a sectional view indicating the disengagement of the vibrating device from the pouring container shown in FIG. 29.
Figures 30A, 30B, 30C, 30D, 30E:
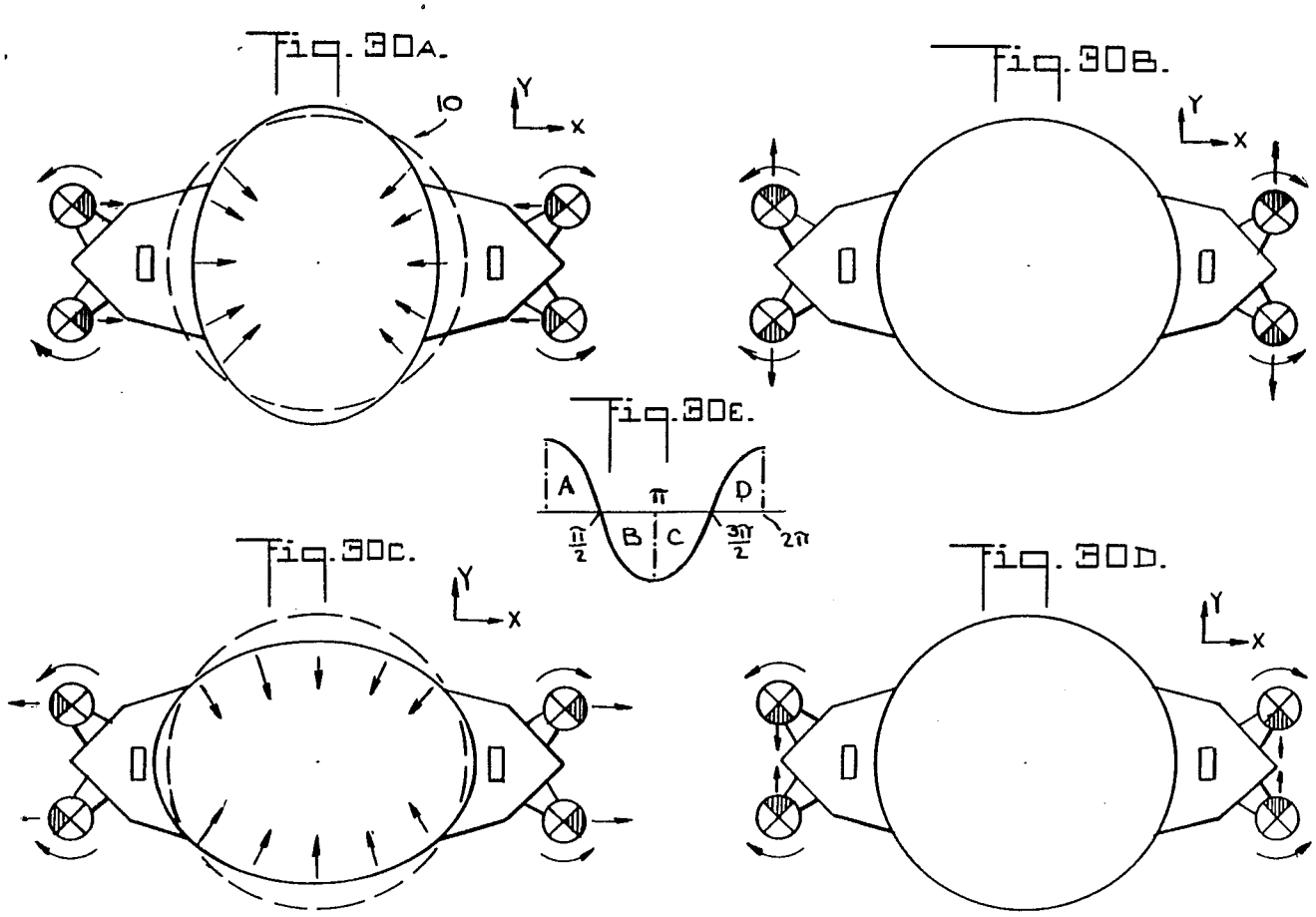
FIGS. 30A, 30B, 30C and 30D show schematically how the external vibrational forces are supplied to the container, showing the effects of the vibrational force on an exaggerated scale.
FIG. 30E represents the oscillation of the vibrations shown in FIGS. 30A, 30B, 30C and 30D.
Figure 30F:
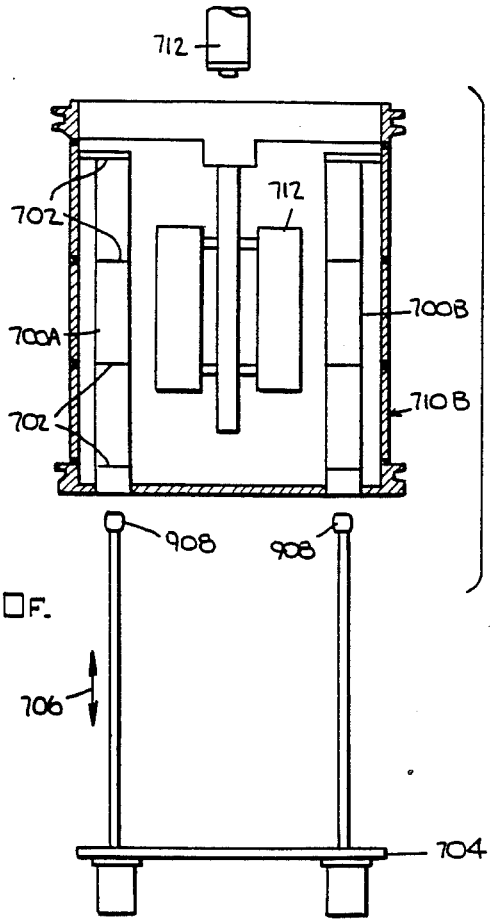
FIG. 30F is a sectional view of an alternative embodiment of the pouring container of the present invention wherein the vibrator apparatus are disposed within the container itself.
Figure 30G:
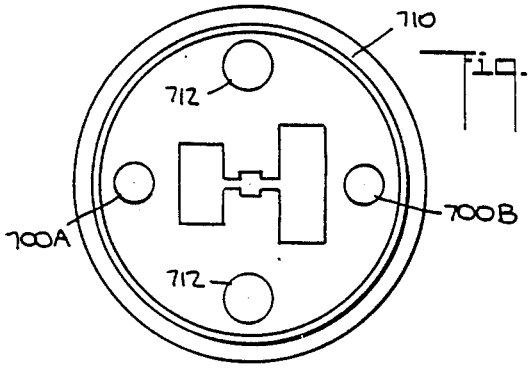
FIG. 30G is a top view of the alternative embodiment of the pouring container with internal vibrator apparatus shown in FIG. 30F.
Figure 30H:
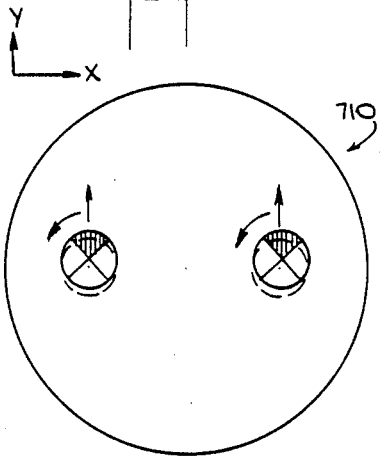
FIGS. 30H, 30J, 30K and 30L show schematically how the internal vibrational forces are supplied to the container, showing the effects of the vibrational force on an exaggerated scale.
Figure 30J:
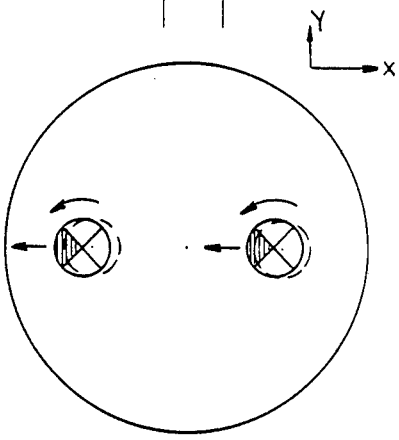
Figure 30M:
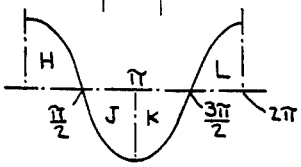
FIG. 30M represents the oscillation of the vibrations shown in FIGS. 30H, 30J, 30K and 30L.
Figure 30K:
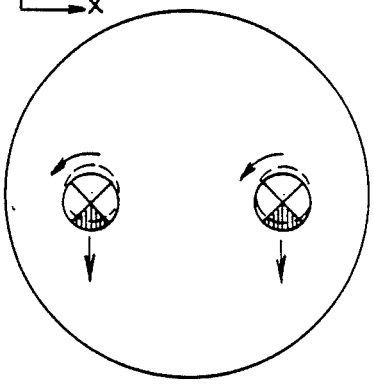
Figure 30L:
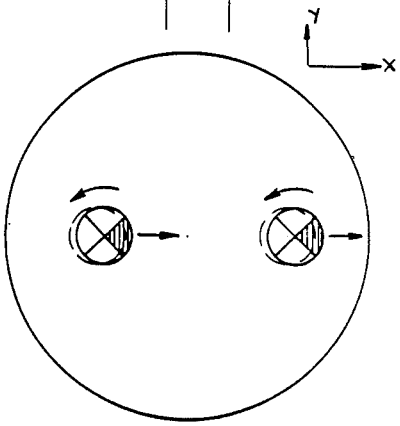
Figures 91, 92:
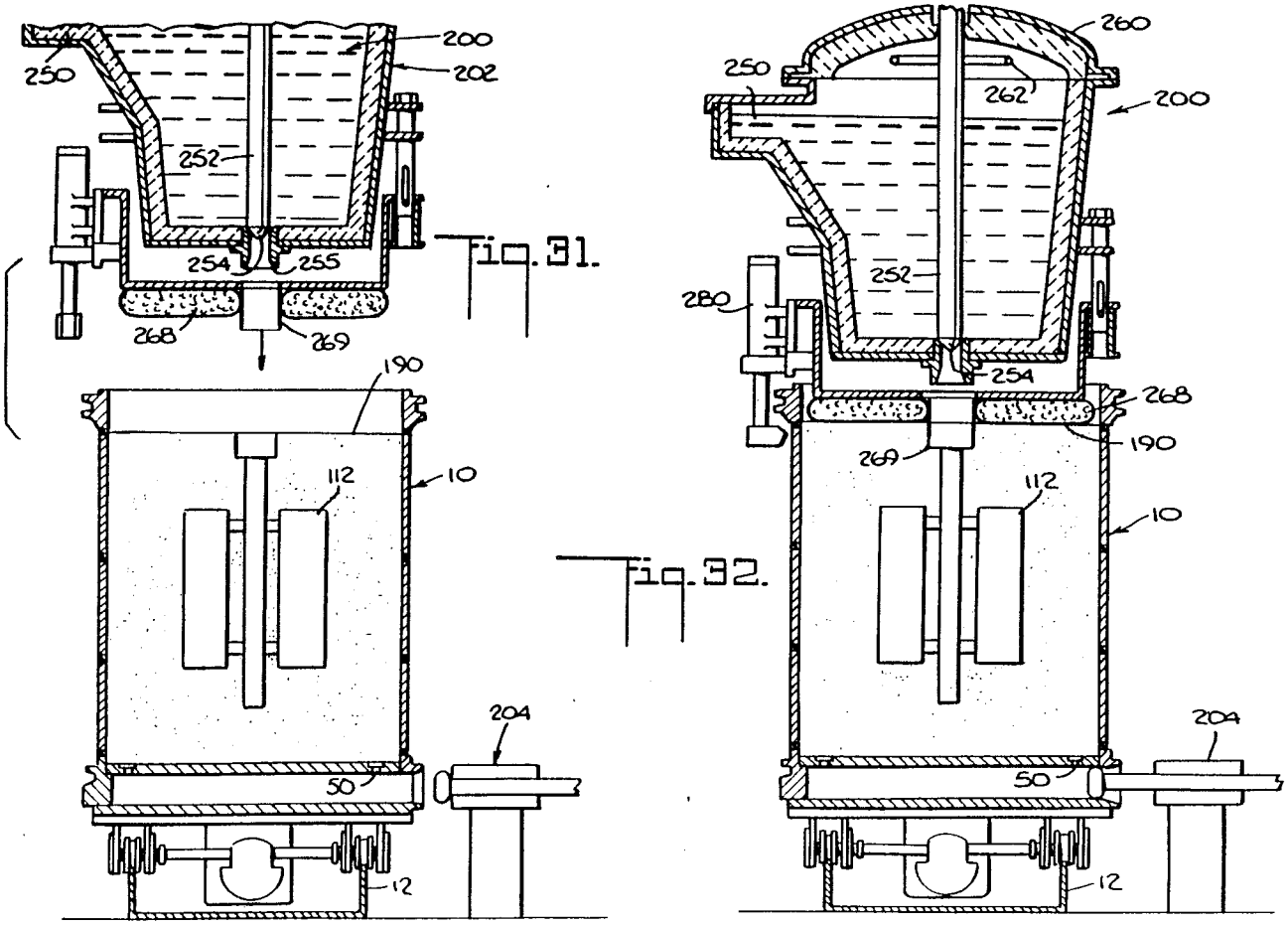
Figure 33:
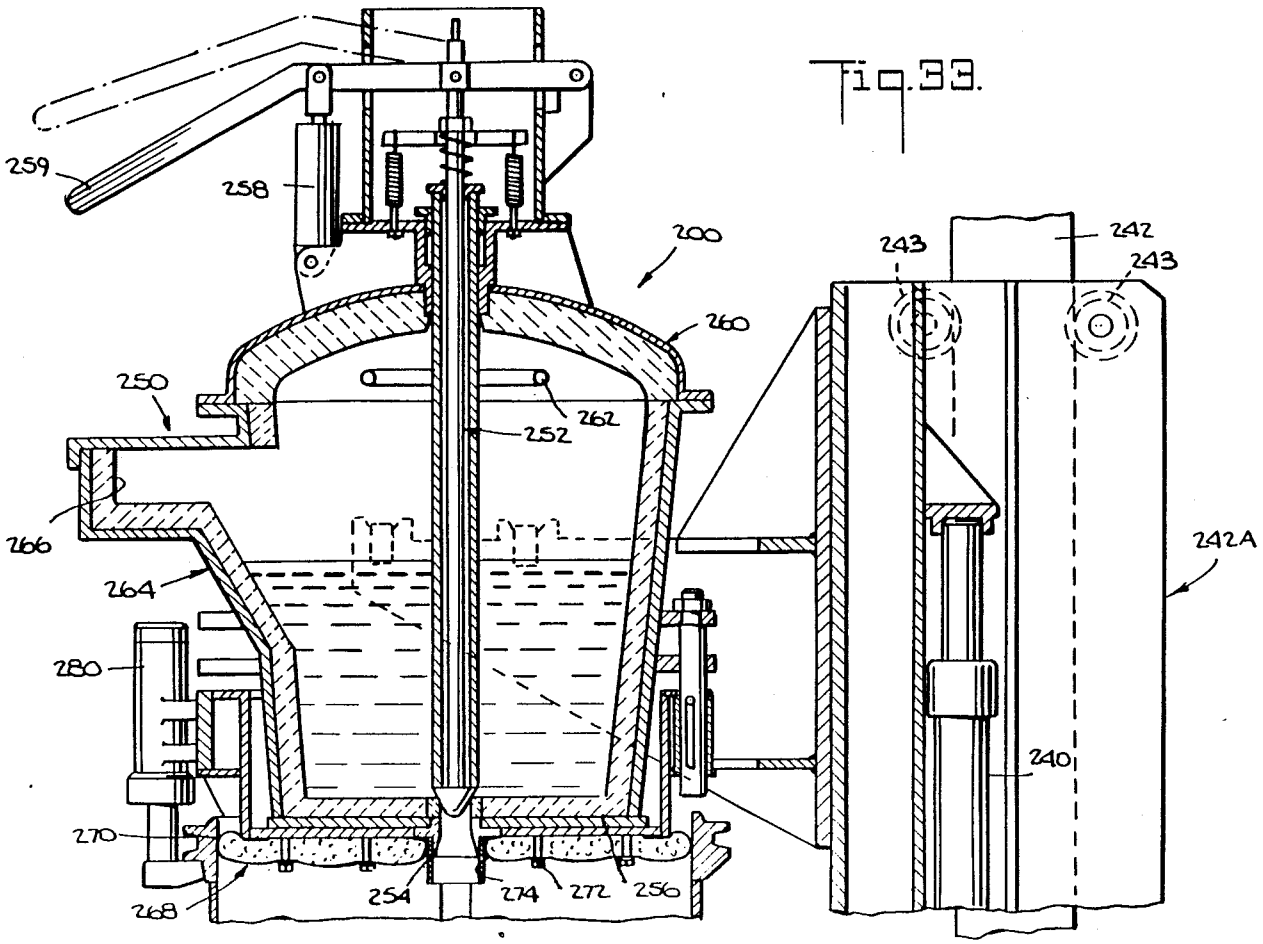
FIG. 33 is a detailed sectional view of the molten metal pouring vessel shown in FIG. 32.

In an alternative embodiment, as shown in FIGS. 30F and 30G, the vibrators may be disposed inside the pouring box container. The two groups of vibrators, 700A and 700B, are disposed within the container 710 and preferably comprise three separate vibrators each. Each separate vibrator is isolated from the others and the container 710 itself by elastic (e.g., rubber) membranes 702, while the container 710 in this embodiment is preferably fully rigid unlike the segmented container 10 of the external vibrator embodiment of the present invention. The molding medium fills the pouring container 710 through tubular members 712 as described previously while the vibrator groups, 700A and 700B vibrator sets are energized consecutively in order to compact the molding medium as each vibrator set section of the container 710 is filled. The corresponding vibrator sets can be powered in a predetermined sequence by a vibrator energizer assembly 704 as its tips 708 move in and out of the vibrator groups 700A and 700B in the direction of arrow 706. As the tips 708 of the energizer assembly 704 enter the isolated sets of vibrators of vibrator groups 700A and 700B, the corresponding sets of vibrators are energized and the molding medium in the container 710 is compacted in a planar manner around pattern 712 as was heretofore described. The vibrator groups 700A and 700B could be powered by energizer assembly 704 in a number of ways including by pressurized air lances or through rotating cam assemblies. The container 710 in this embodiment, once filled with molding medium, may also be covered and rotated while being internally vibrated so as to provide complete and uniform compaction of the molding medium. The disposition of the vibrators in the container 710 may be especially useful for containers of large size. Furthermore, a combination of internally disposed vibrators and external vibrators may also be used, as necessary to a particular application.

In the embodiment shown, the pouring container 10 has a substantially round cross section. The provision of such a container 10 having a round cross section allows for substantially uniform compaction of the molding medium around and inside cavities in the pattern. However, the container need not be round in cross section, and especially if internal vibrators are used, other cross sections can be provided as needed.

Essentially, the vibration performed by vibrators 168A and 168B causes the walls of the container 10 to deflect slightly in a horizontal direction so as to "flatten" the circular cross section into an oval shape. This is shown in FIGS. 30A–30D, greatly exaggerated. Vibrator groups 168A and 168B are operated in synchronism. Thus, during a first part of the vibrating cycle, as shown in FIGS. 30A and 30E, the container 10 is compressed in the x direction due to a compression force exerted by each of the vibrator pairs 168A and 168B directed toward the other pair. In a second part of the cycle, as shown in FIGS. 30C and 30E, a force directed outwardly, in the direction away from the container and the other vibrator pair, causes a horizontal compression of the container 10 in the y direction or an expansion in the x direction.

The compaction sequence used with the internal vibrator embodiment is not unlike the one followed in the external vibrator embodiment of the invention; however, the force induction does differ as shown in FIGS. 30H–30L, greatly exaggerated. In FIGS. 30H–30M the four phases of the internal vibration are shown. In this embodiment, while the container 710 stays rigid and relatively motionless, the molding medium is vibrated horizontally in the four directions as shown, causing the planar compaction of the molding medium in the horizontal regions of the container 710.

Figure 24:
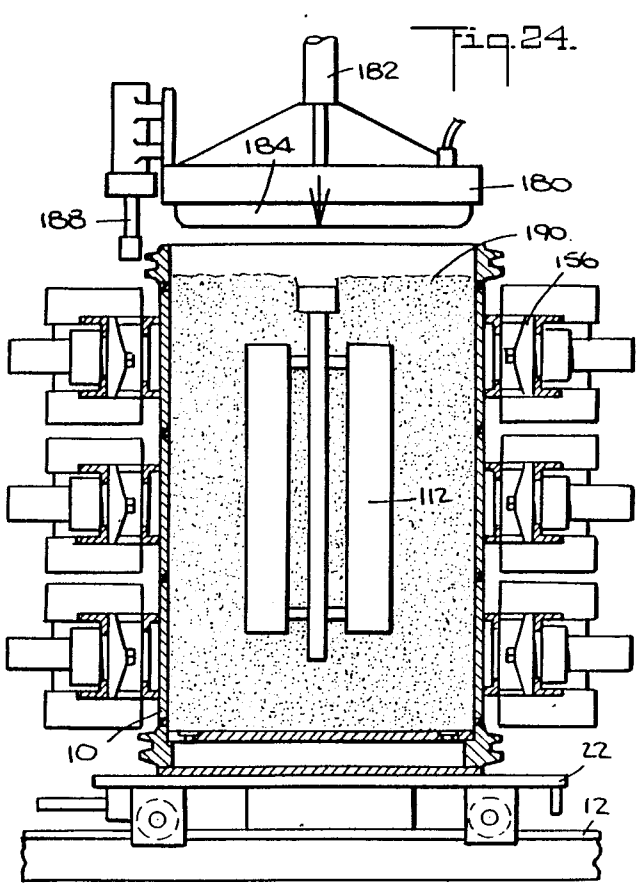
FIG. 24 is a sectional view of the pouring container filled with molding medium and the vibrating device shown in FIG. 1 while the compensating cover is being placed on top of the filled pouring container.
Figure 26:
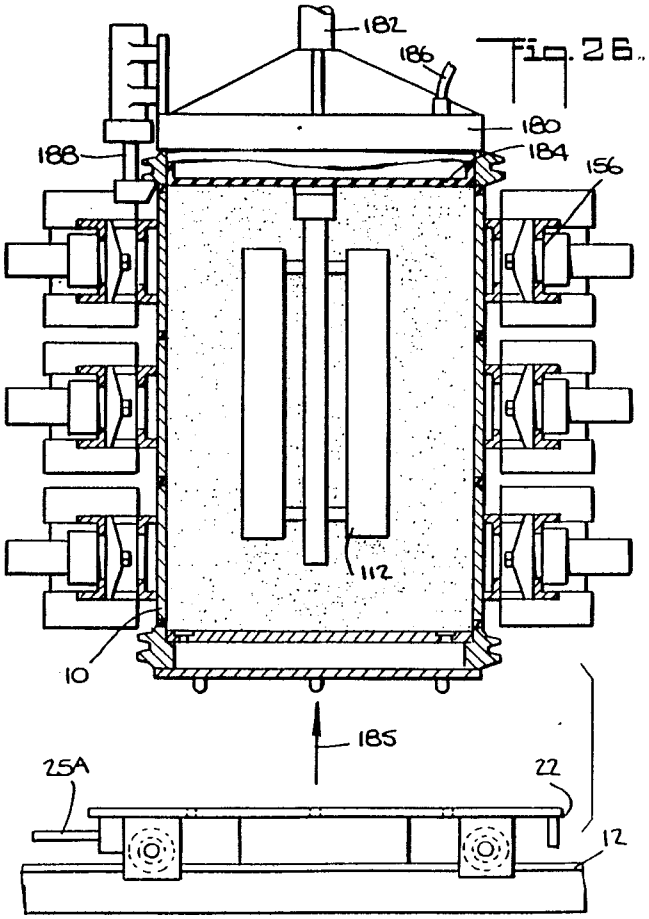
FIG. 26 is a sectional view indicating the upward movement of the filled and closed pouring container shown in FIG. 25 during a portion of the packing operation.
Figure 25:
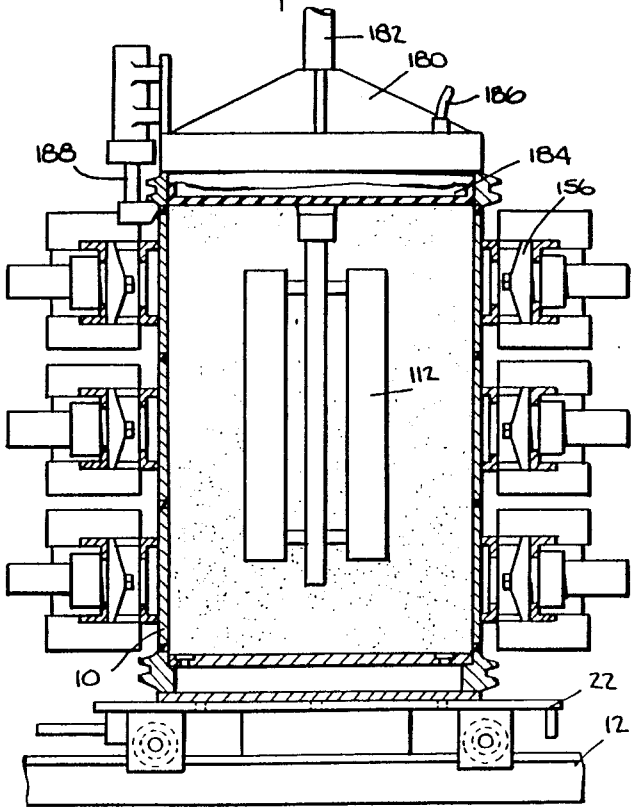
FIG. 25 is a sectional view of the pouring container shown in FIG. 24 after the compensating cover has been attached to the pouring container.
Figure 28:
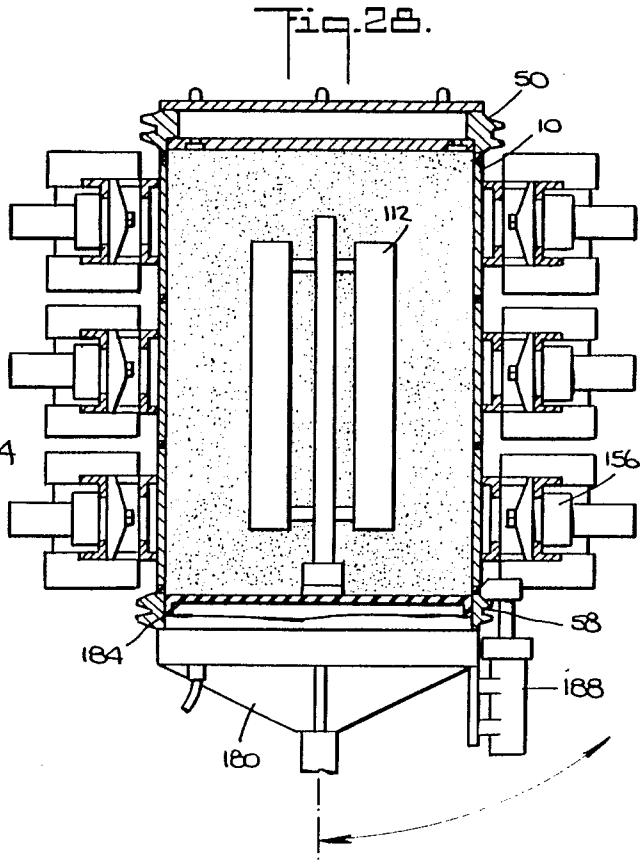
FIG. 28 is a sectional view of the filled and closed pouring container shown in FIG. 26 during a still further portion of the packing operation when rotated to a 180° position.
Figure 27:
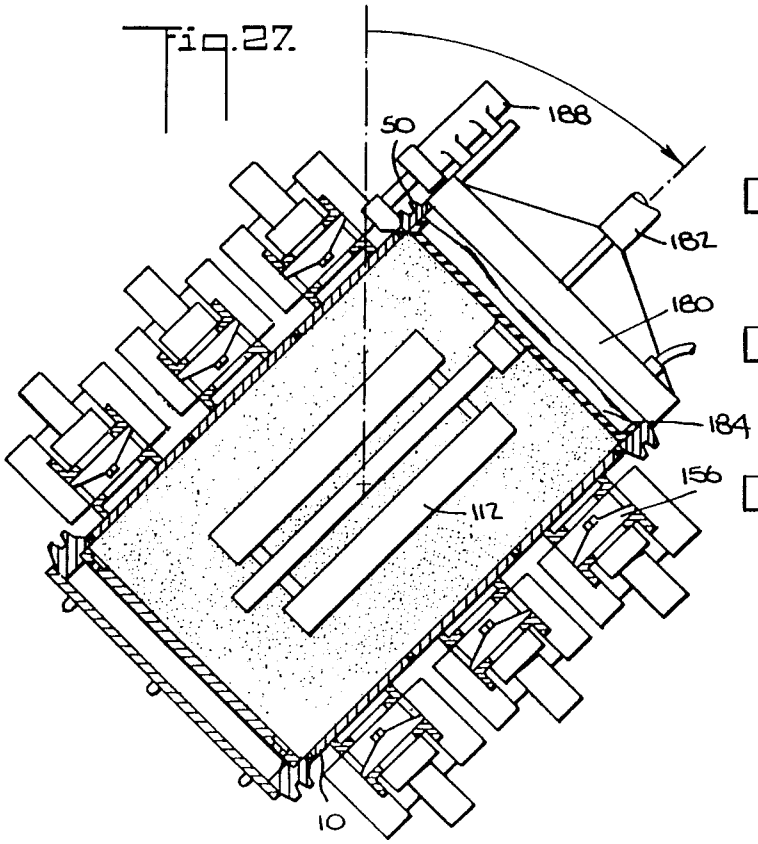
FIG. 27 is a sectional view indicating the rotational movement of the filled and closed pouring container shown in FIG. 26 during a further portion of the packing operation.
Figure 29:
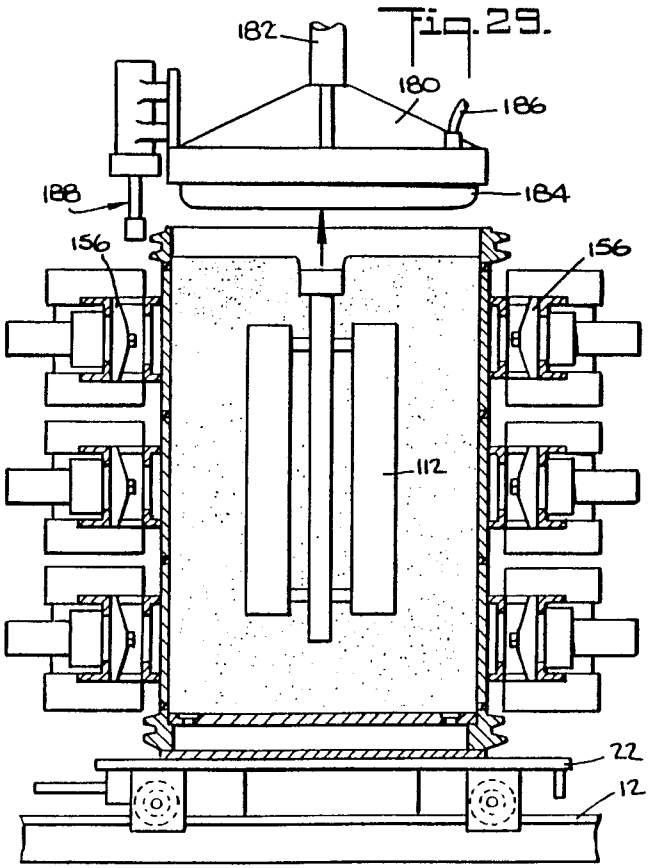
FIG. 29 is a sectional view indicating the removal of the compensating cover from the pouring container shown in FIG. 25 within which the molding medium has now been compacted.

Once the container 10 is filled with molding medium and the hopper 100 and cover 104 removed, as shown in FIGS. 23 and 24, a compensating cover or squeezer head 180 is moved into position by rotatable ram mechanism 182 over the top 58 of the pouring container 10. Squeezer head 180 includes an eslatic, e,g., rubber membrane 184 filled with an hydraulic fluid. As the squeezer head 180 is lowered into position on top 58 of the pouring container 10, the elastic membrane 184 comes into contact with the top surface 190 of the molding medium within the pouring container 10 and the squeezer head 180 is secured into place with a plurality of rotatable rams 188. The elastic membrane 184 is then pressurized through valve 186 so that the membrane 184 presses against the top surface 190 of the molding medium and conforms to the top surface 190. This keeps constant pressure on the molding medium in the container 10. As shown in FIG. 26, the pouring container 10, the attached squeezer head 180 and the connected vibrators 168A, 168B are then lifted up along vertical beam 102 as shown by arrow 185, off the conveyor pouring container base 22, far enough so that a rotation of the pouring container itself is possible. In that lifted position, the three separate sections 52, 54, and 56 of the pouring container 10 are again sequentially vibrated, as explained heretofore. Preferably, vibration is accomplished from bottom to top and in each section for fifteen to thirty seconds. As the three sections are sequentially vibrated, the rubber membrane 184 of the squeezer head 180 continues to exert pressure against the shifting molding medium, taking up any space as the medium compacts and flows in the pattern cavities. After this step is completed, the pouring container 10 is rotated in 45° increments and the same "planar" vibrational sequence is repeated. Once the pouring container 10 has been turned 180°, and sequentially vibrated in that position (FIG. 28), it is then turned back right side up and lowered down onto the plate 22. The vibrator connectors 156 are then released and rotated and the squeezer head 180 is removed.

Although in one embodiment the pouring container 10 is vibrated at 45° increments, the container can also be rotated and vibrated continuously or in any scheme of angular increments or planes. Furthermore, another embodiment could allow for multi-axial rotation of the container 10.

Figure 20:
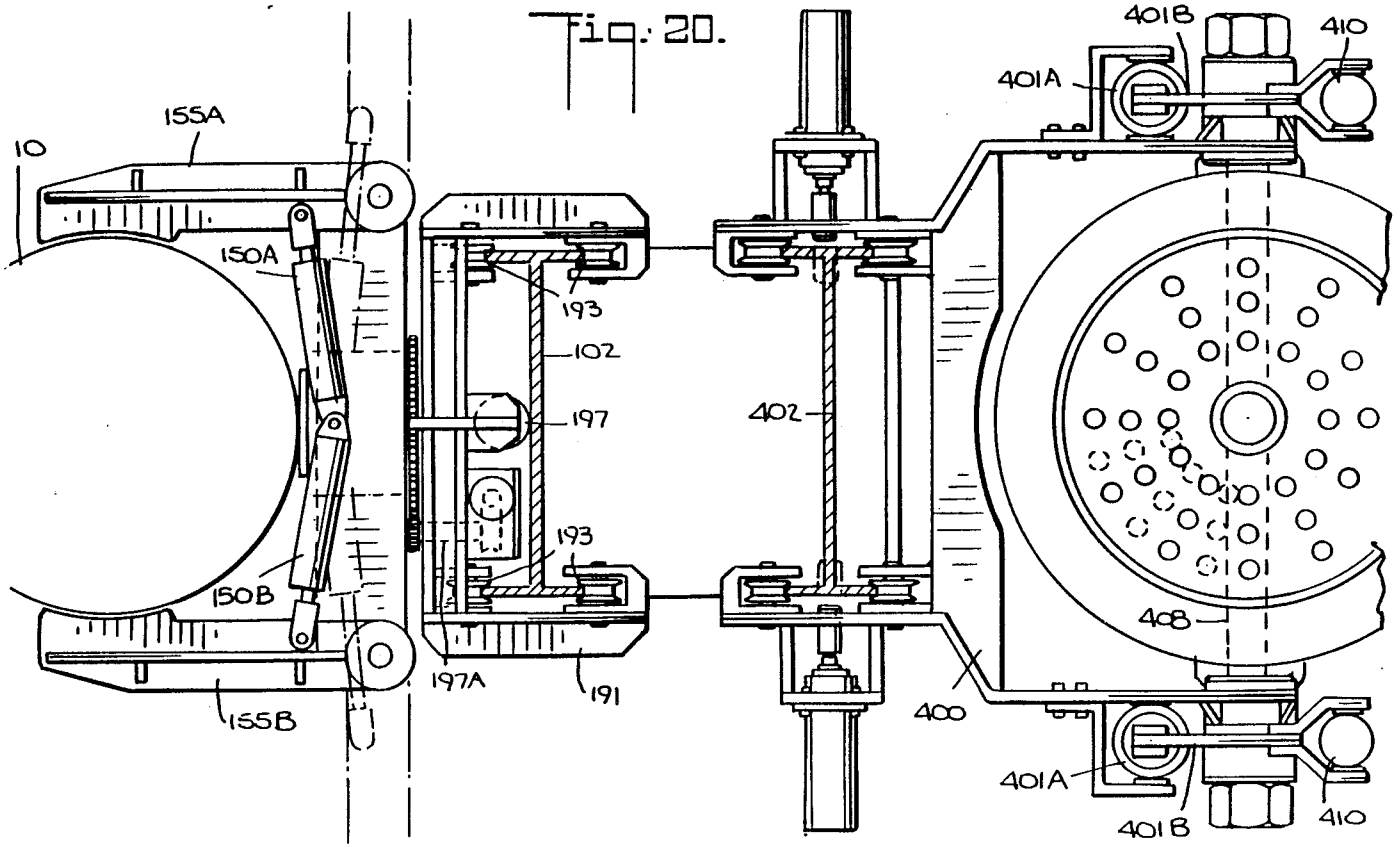
FIG. 20 is a partly sectional top view of the pouring container, the vibrating device, and the molding medium recovery and recycling station shown in FIG. 3.

The mechanism allowing lifting and rotation of container 10 is shown in cross sectional views in FIGS. 19 and 20. Container 10 along with arms 155A and 155B holding vibrator groups 168A, 168B, are vertically movable on beam 102 via a bracket 191 having wheels 193. A central pivot shaft 195 is provided for allowing rotation and an hydraulic ram 197 is provided for effecting vertical movement along beam 102. For providing rotation, shaft 195 is driven by a suitable motor 197A, e.g., through a gear drive 197B.

The above described compaction sequence results in a densely and uniformly compacted molding medium. In essence, the molding medium behaves like a fluid, filling all corners, crevices and internal cavities and galleries of the evaporative pattern 112. Substantially no deformation of the pattern results due to the uniform compaction. A suitable molding medium for use in the present invention is that described in U.S. Pat. No. 4,651,798 to Leslie D. Rikker, the applicant herein, although other molding media can also be used.

As shown in FIGS. 1 and 2, once the pattern 112 has been inserted into the container 10, and the molding medium compacted around it at operation station 1, the container 10 is transported as described previously along tracks 12 to operation station 2. FIGS. 31–34 show in greater detail the molten metal pouring operation which occurs at operation station 2 The filled pouring container 10 is transported to a point beneath a molten metal pouring vessel 200. The pouring container 10 is stopped in the correct position by the use of a switching mechanism 34 as described earlier. Once the pouring container 10 is in the correct position, a gas removal connection 204, similar to connection 198, is connected to the hollow frame 50 at the bottom of the pouring container 10. During the molten metal pouring process, a vacuum will be exerted in the pouring container 10 by a vacuum pump coupled to connection 204 and the gases 206 resulting from the evaporation of the pattern 112 by the molten metal will be evacuated from the pouring container 10 and into a gas recovery system.

The gas recovery system comprises a control unit 208, a modulating valve 210, a vacuum surge vessel 212 including a liquid effluent discharge 214, a vacuum pump 216, and a gas cleaner and condenser 218 including a blower 220, a natural gas source 222, burner 222A, a cooling system 224, a liquid effluent discharge 226, and a gas effluent stack 228. See FIG. 34. Operation of these components will be described hereinafter. Furthermore, the control unit 208 includes an input from a number of pressure probes 230 which monitor the pressure within the pouring container 10 as a molten metal pour takes place. The control unit 208 uses this information in order to control the modulating valve 210 and the vacuum surge vessel 212 so that the pressure within the pouring container 10 at the time of a pour can be closely controlled. The control of the pressure in turn controls the pouring rate of the molten metal itself. This is important, as will be explained below, in order to obtain consistent, reliable, defect-free castings.

Once the connection 204 is made to the pouring container 10, the molten metal pouring container 200 is lowered down onto the top 58 of the pouring container 10 by an hydraulic system 240 along beam 242. A bracket 242A is provided having wheels 243 for guidance on beam 242.

The pouring vessel 200 includes a molten metal filling port 250, a stopper rod 252 which fits within a hole 254 in the bottom 256 of the pouring vessel, which stopper rod 252 can be controlled by a hydraulic lifting mechanism 258. A manual lever 259 may also be provided. The pouring vessel 200 further contains a cover 260 and a heating element 262 for maintaining the required temperature in vessel 200. Typically, molten metal will be fed to filling port 250 from a furnace via a suitable transport mechanism.

The pouring vessel 200 itself is made of an outer steel covering 264 with an inner refractory layer 266. The bottom 256 of the pouring vessel has attached thereto a flexible refractory covered filler 268, which preferably is filled with steel shot 270. Filler 268 is attached to the pouring vessel by means of bolts 272. The flexible refractory covered filler 268 fully covers the bottom 256 of the pouring vessel and includes a hole 274 at the center thereof in alignment with a nozzle 255 having an opening 254 disposed at the bottom of the pouring vessel. As the pouring vessel assembly is lowered down on the top 58 of the pouring container 10, the flexible refractory covered filler 268 fits snugly over the contours of the top 190 of the compacted molding medium. This tight and contoured fit prevents any movement of the compacted molding medium during the pouring operation. Once a close fit has been established, the pouring vessel 200 is locked to the pouring container 10 by hydraulic rams 280 which are substantially the same as rams 188 described with reference to operation station 1. The nozzle 255 having aperture 254 is disposed through the center hole of the refractory covered filler 268, thus providing a guide for the molten metal in the pouring vessel 200 to the pattern in container 10. The molten metal pour can now take place and it is effected by moving stopper rod 252 upwardly. The resulting gases 206 generated by the gasification of the pattern 112 are withdrawn via connection 204 and environmentally disposed of as will be described in more detail with reference to FIG. 34.

Refractory covered filler 268 also provides a seal for the molten metal, having a ring 269 for contacting the exposed upper surface of the molding medium. Additionally, by compensating for the space between the molding medium and the bottom of the pouring vessel, it allows the full hydrostatic or metallostatic pressure head of the molten metal in the pouring vessel to be effective during the displacement of the pattern by the molding medium, thereby allowing the molten metal to reach all areas of the pattern. Furthermore, any shifting of the molding medium is also prevented by the filler 268, since it prevents any upward movement of the molding medium due to the pressure head.

The use of refractory covered filler 288 thus allows the molten metal in the vessel 200 to be a part of the gating system for the metal pouring operation. The full pressure head of the molten metal in the vessel insures that the molten metal reaches all areas of the mold and the "filler" action of the filler 268 means that there is a direct connection between the molding medium upper surface and the pouring vessel. The filler 268 is made flexible so that it conforms to the upper surface of the compacted molding medium. By taking up the space between the molding medium surface and the vessel 200, it is insured that the molten metal does not move the molding medium from its position around the evaporating pattern.

As soon as the molten metal has displaced the pattern 112 within the molding medium, the pour is finished and the stopper rod 252 is once again lowered into opening 254 in order to cut off the flow of molten metal. The pouring vessel 200 is now unlocked from the pouring container 10 by suitable operation of hydraulic rams 280 and the complete assembly 200 is lifted up by hydraulic mechanism 240 along beam 242 away from pouring container 10.

As noted earlier, control of the pour rate is established by modulating the escaping gases via modulation valve 210. Should the pour rate begin to exceed predetermined maximum limits, the pressure in the container 10 will have decreased. To decrease the pouring rate, valve 210 is closed, thereby increasing the pressure in container 10 and decreasing the pouring rate. Similarly, should the pour rate be too low, valve 210 is appropriately opened to decrease the pressure in the container 10 and increase the pouring rate.

Such control of the pouring rate is important in order to achieve consistent, reliable casting. If the pouring rate is outside defined limits, set largely by the type of metal being cast, casting imperfections may result. For example, if the pouring rate is too high, the form of the compacted molding medium as determined by the evaporating pattern can be impaired, resulting in imperfect castings. If the rate is too low, "cold spots" can occur in the casting, resulting in defects.

Figure 34:
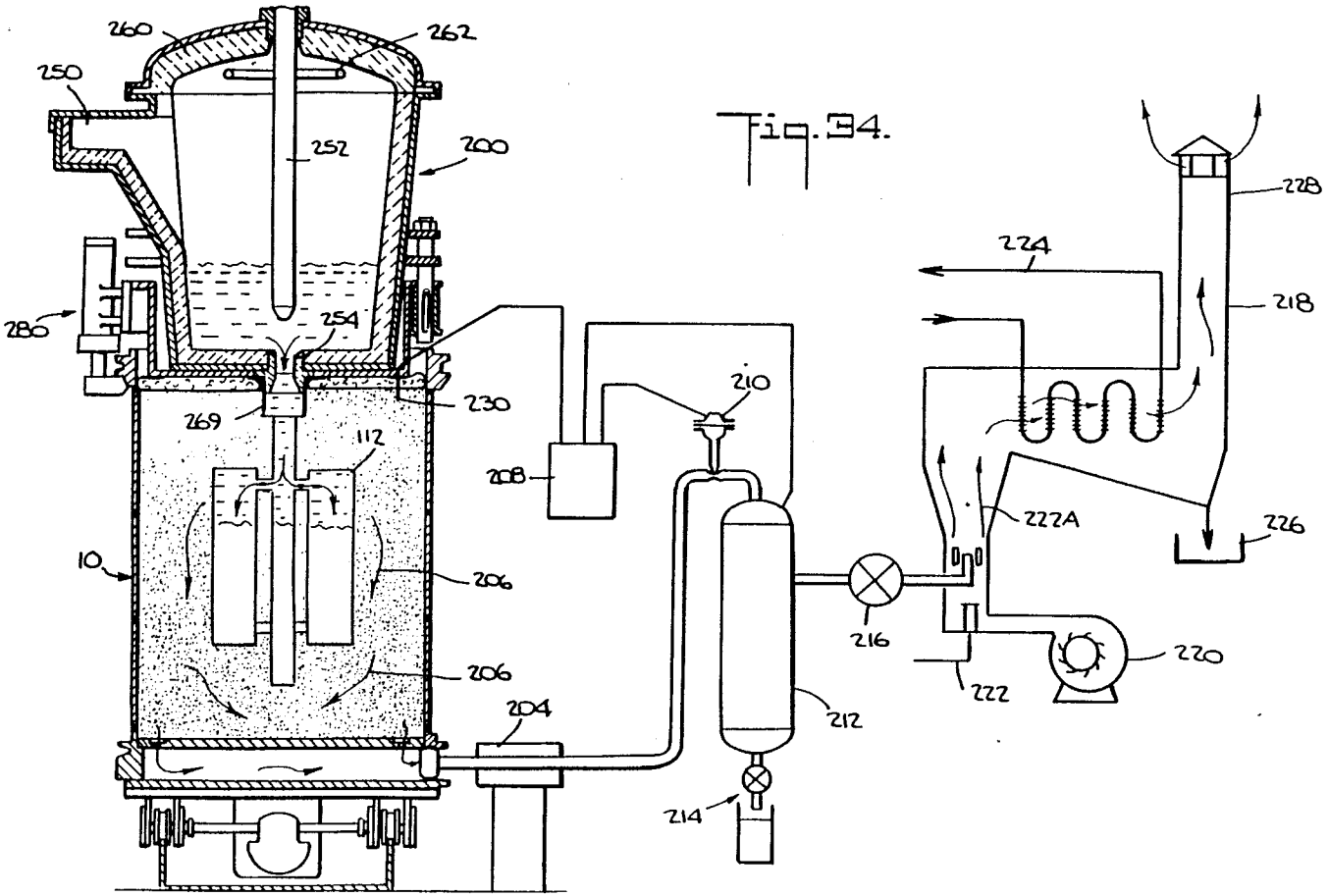
FIG. 34 is a combined sectional view of the molten metal pouring vessel placed on top of the pouring container shown in FIG. 32 and a schematic view of the gas capture, treatment and metal pouring control apparatus.
Figure 35:
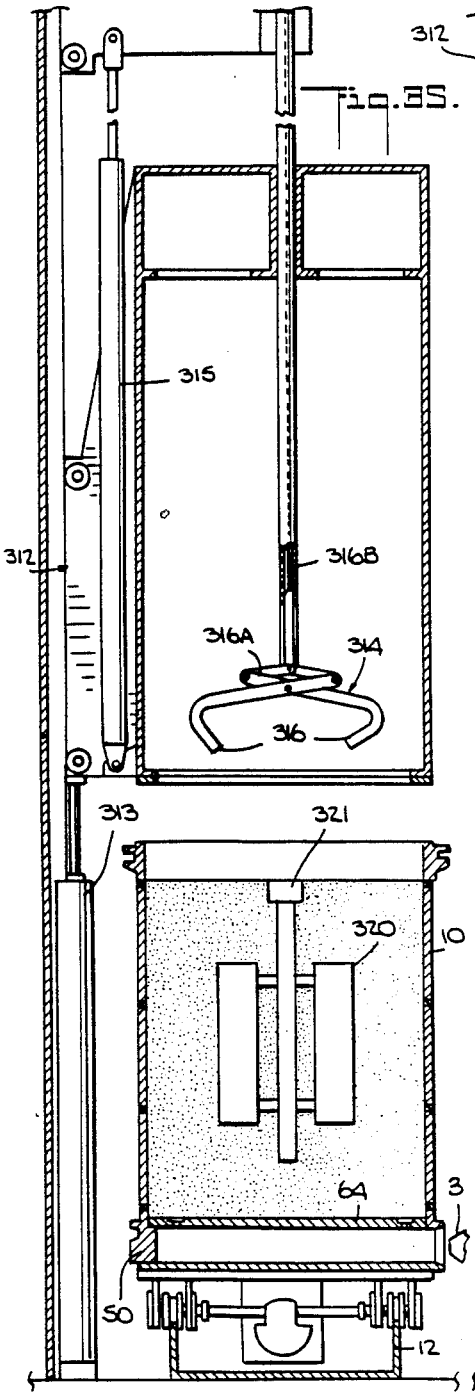
FIG. 35 is a sectional view of the casting removal station shown generally in FIG. 1 in position above the pouring container.
Figure 36:
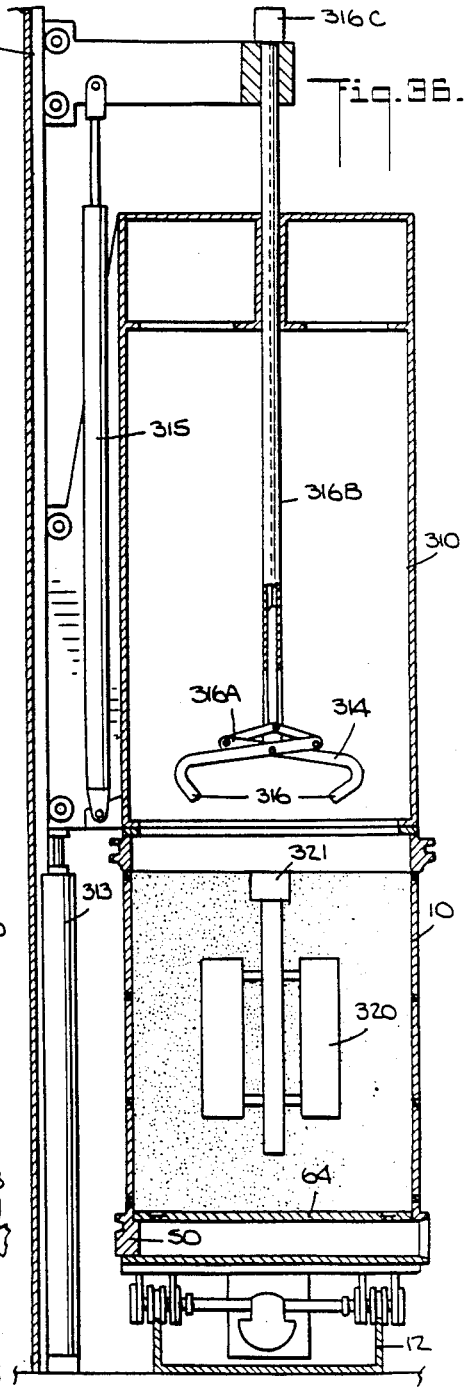
FIG. 36 is a sectional view of the casting removal station shown in FIG. 35 directly on top of the pouring container.
Figure 37:
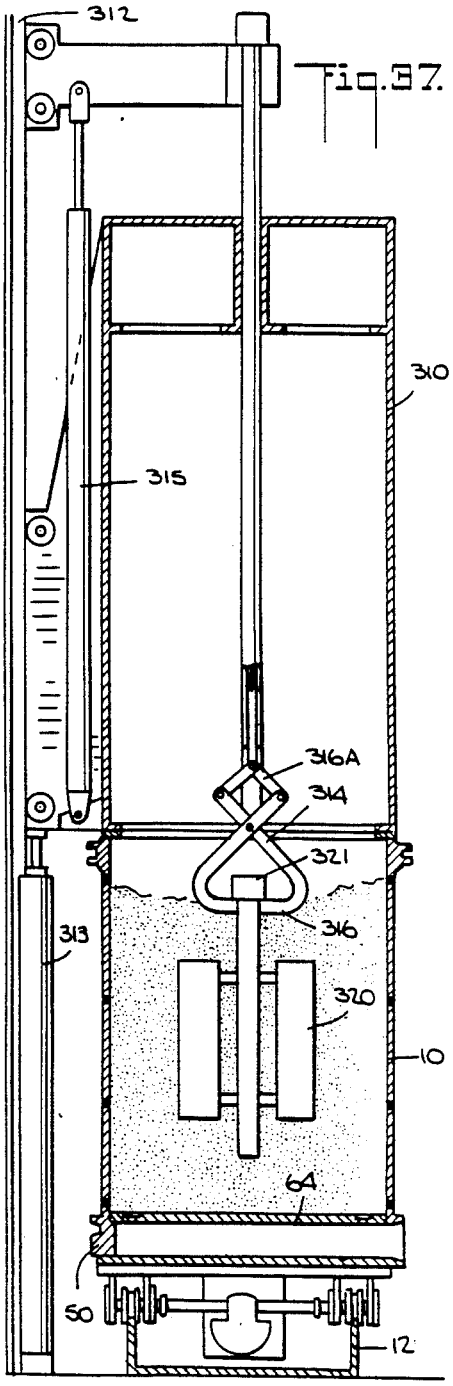
FIG. 37 is a sectional view of the casting removal station shown in FIG. 35 showing the casting being grasped by a removal device.
Figure 38:
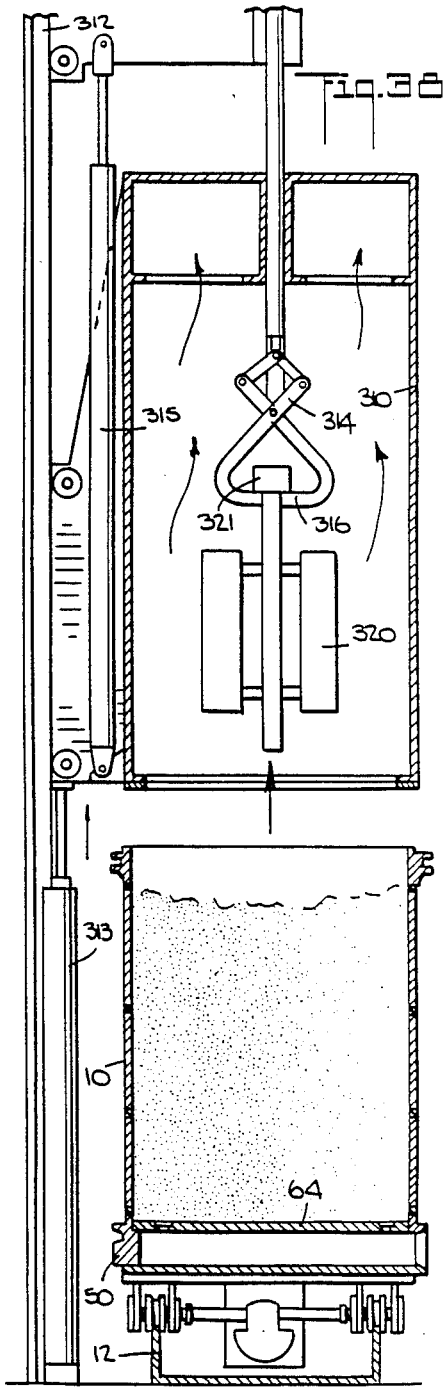
FIG. 38 is a sectional view of the casting removal station shown in FIG. 35 after the casting has been removed from the pouring container.
Figure 39:
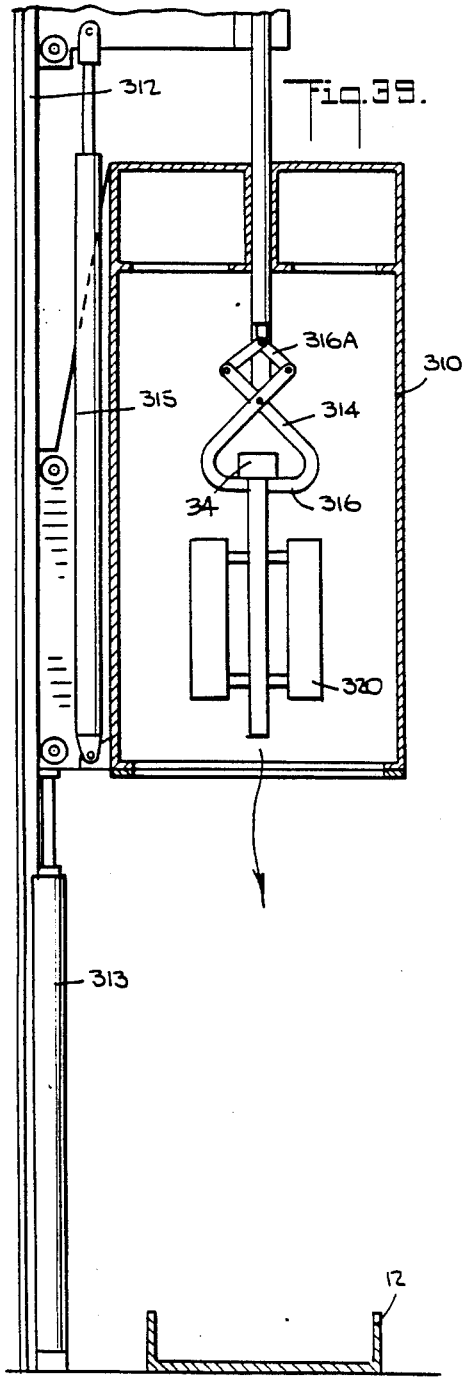
FIG. 39 is a sectional view of the casting removal station shown in FIG. 35 following the removal of the pouring container.
Figure 40:
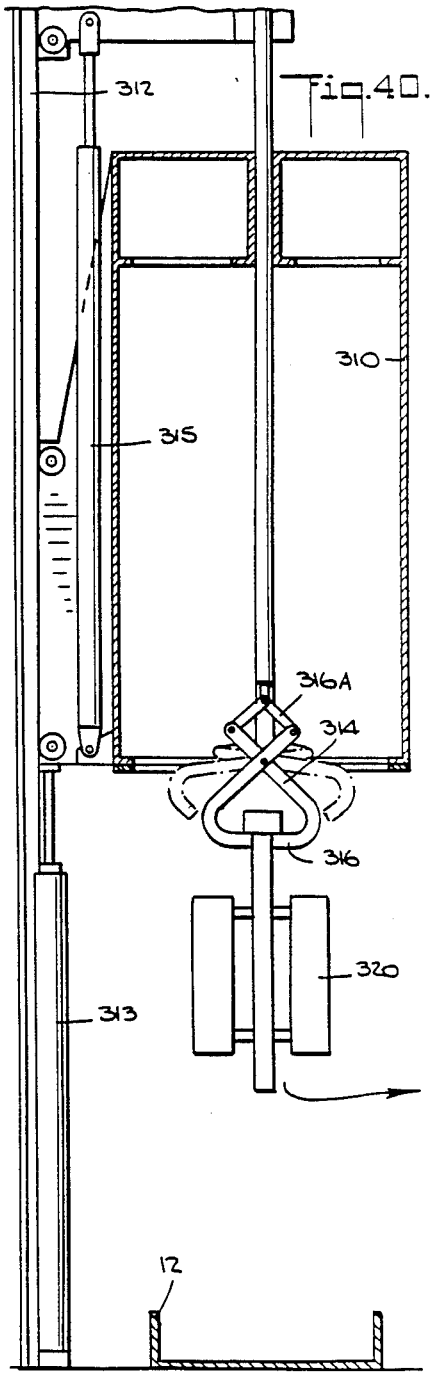
FIG. 40 is a sectional view of the casting removal station shown in FIG. 35 as the casting is removed.
Figure 41:
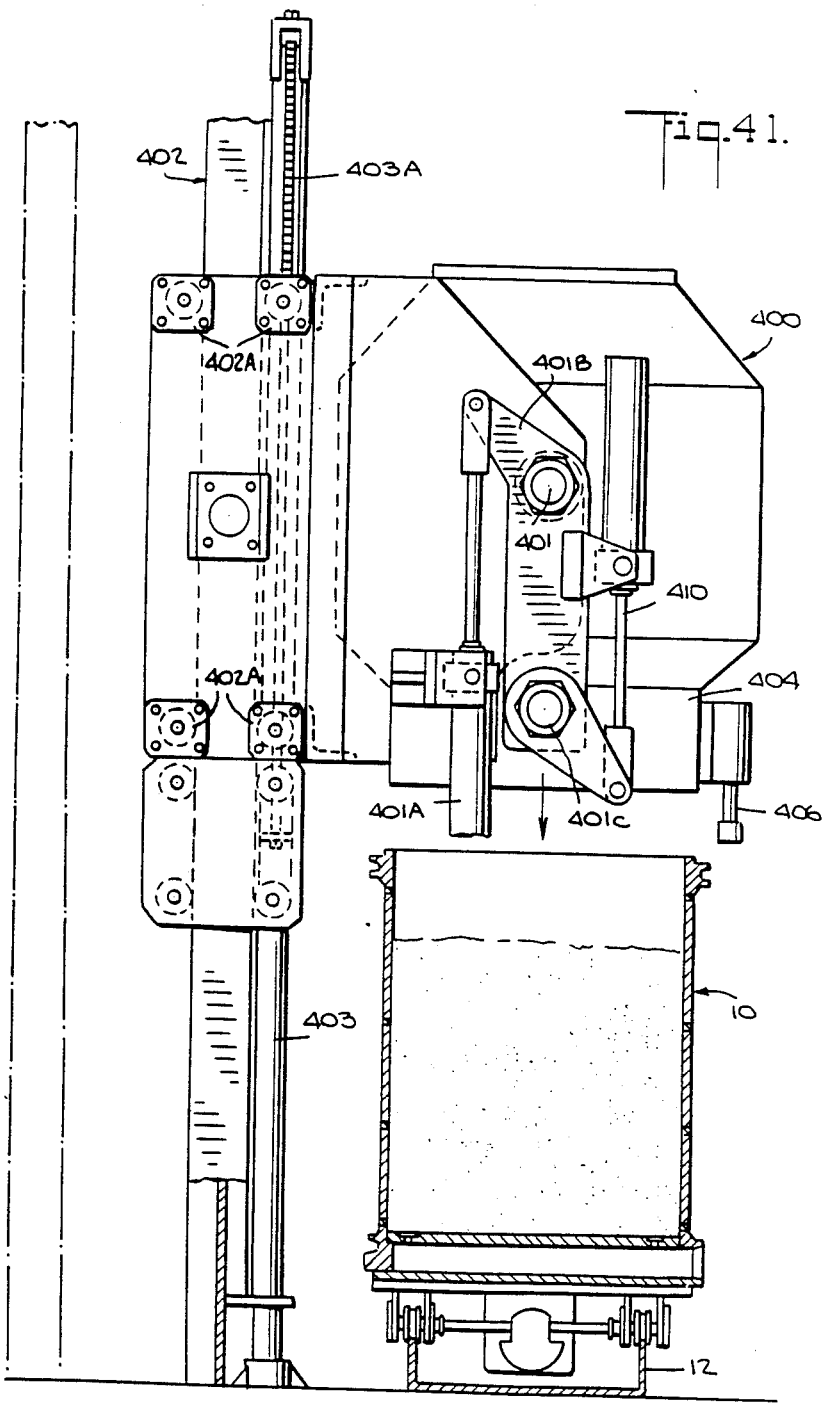
FIG. 41 is a side view of the molding medium recovery and recycling station of the apparatus shown in FIG. 1.
Figure 42:
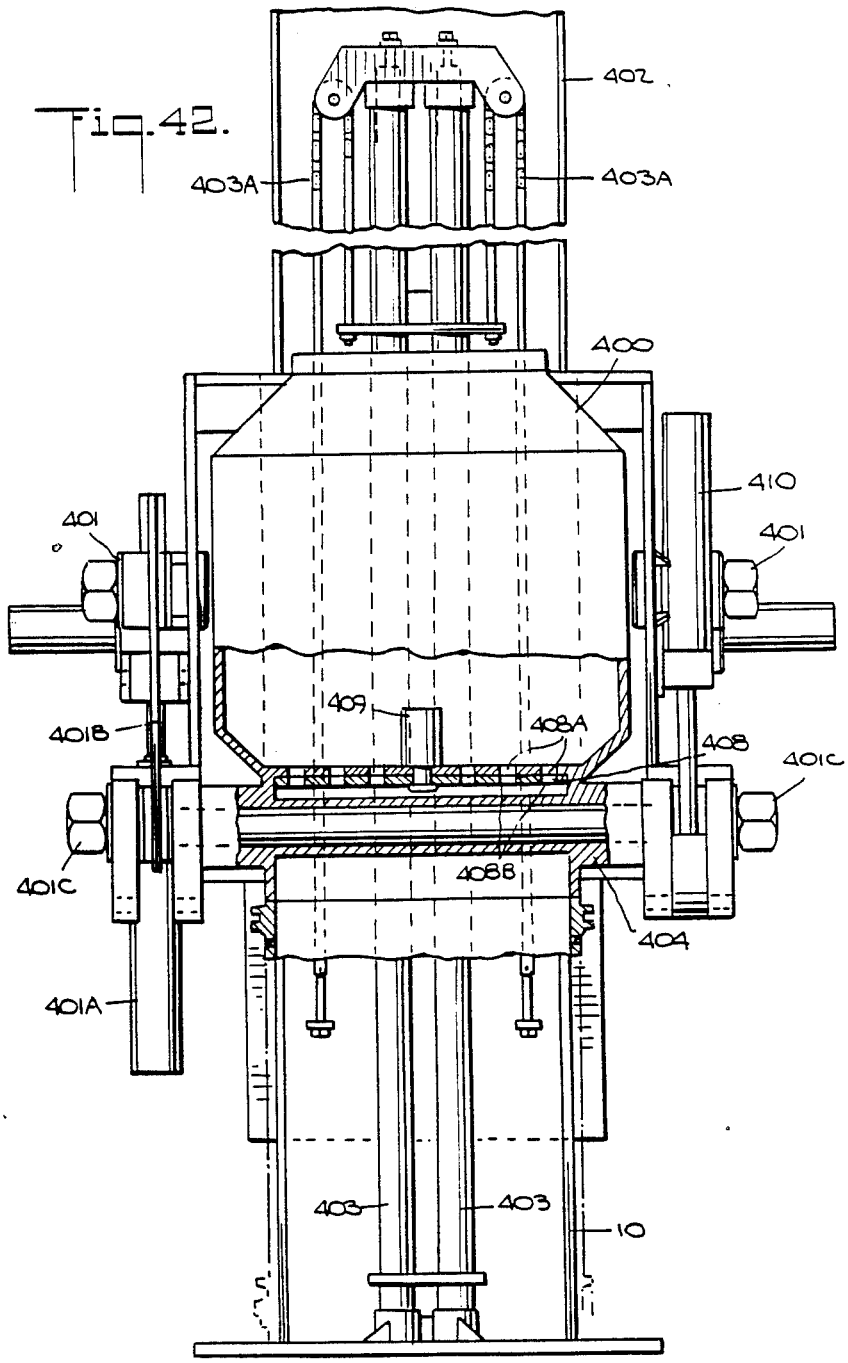
FIG. 42 is a front view of the molding medium recovery and recycling station of the apparatus shown in FIG. 41.

With reference to FIG. 34, gases generated by evaporation of the pattern on contact with the molten metal are supplied to the burner 222A by the vacuum pump 216. In the burner, the gases are combusted. The gases from combustion are cooled in a cooling unit 224. The extracted heat energy can be used, for example, to provide heat for maintaining the temperature of a pattern storage area or for other purposes. The cooled, environmentally safe byproducts of combustion are released through a condenser 218 to an exhaust stack 228. Condensed vapors are received in a liquid recovery tank 226.

The pouring container 10 can now proceed on its way along tracks 12 to station 3. Depending on the type of metal that was poured, a cooling time for the casting will be established. Accordingly, and with reference to FIG. 1, a cooling circuit 14 may be formed by tracks 12 before the pouring container 10 proceeds to operation station 3.

Operation station 3, or the casting removal station, is shown in greater detail in FIGS. 35–40. Once the pouring container 10 moves into operation station 3, it is brought to a stop in the proper position by a switching mechanism 34 as described earlier. At this time, a connection 300 similar to connection 204 is established to the hollow frame 50 of the pouring container 10. This connection 300 is coupled to an air compressor. Operation station 3 consists of a hood 310 which is mounted movably on beam 312 and encloses a gripping mechanism 314 including a pair of opposed tongs 316 which are also mounted for vertical movement on beam 312. A suitable hydraulic ram 313 can be provided to effect vertical movement of hood 310 and an hydraulic ram 315 provided for movement of gripping mechanism 314. Any suitable device can be utilized to move tongs 316 via a suitable linkage 316A and shaft 316B, for example, an hydraulic device 316C.

The hood 310 is cylindrically shaped in order to fit substantially airtight on top 58 of the cylindrical pouring container 10. Once the hood 310 is lowered along beam 312 on top 58 of the pouring container 10, the air compressor forces air through connection 300 into the hollow section 50 of the pouring container 10 and upwards through the perforated base 64, thus effectively fluidizing the molding medium. The gripping mechanism 314 is then lowered and using the opposed tongs 316, the sprue 321 upper portion of the casting 320 is grasped and the casting 320 is pulled upwards into the hood 310 and out of the fluidized molding medium. The fit between the hood 310 and the top 58 of the pouring container 10 is preferably air tight so that dust caused by the removal of the casting 320 from the fluidized molding medium is contained within the hood 310.

Once the casting 320 is removed from the fluidized molding medium, vibrated within the hood 310, thereby effectively removing most of any molding medium still adhering to the casting, the pouring container 10 proceeds on its way along tracks 12 to operation station 4. The casting is then lowered down out of the hood 310 and can be moved to a casting cleaning facility. Preferably, the dust in the hood 310 is collected by an exhaust fan coupled to a dust and fume collector. The pouring container 10, filled with used molding medium only, is now moved to operation station 4.

Figure 3:
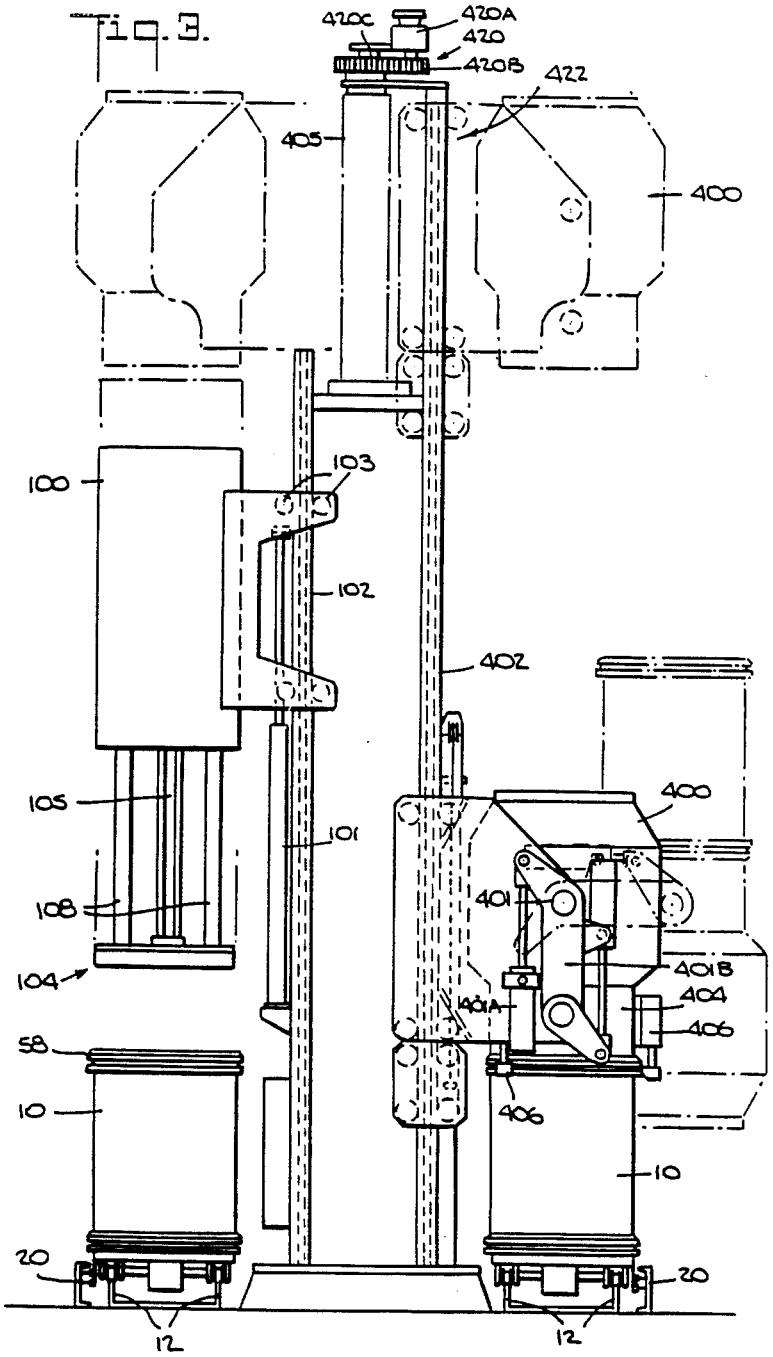
FIG. 3 is a side view of the pattern insertion and molding medium dispensing and packing station and the molding medium recovery and recycling station of the apparatus shown in FIG. 1.
Figure 5:
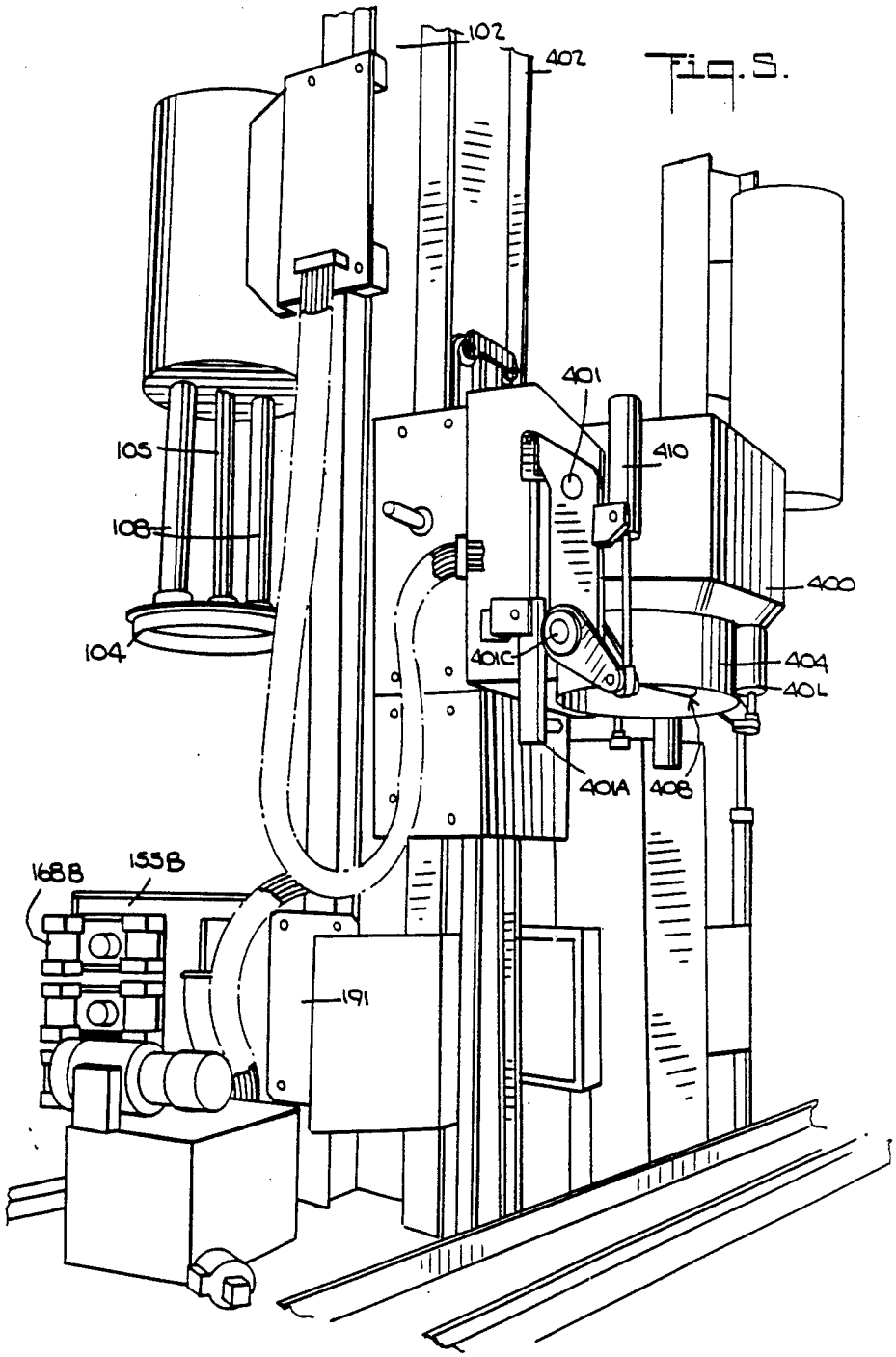
FIG. 5 is a perspective view of the pattern insertion and molding medium dispensing and packing station and the molding medium recovery and recycling station of the apparatus shown in FIG. 3.
Figure 46:
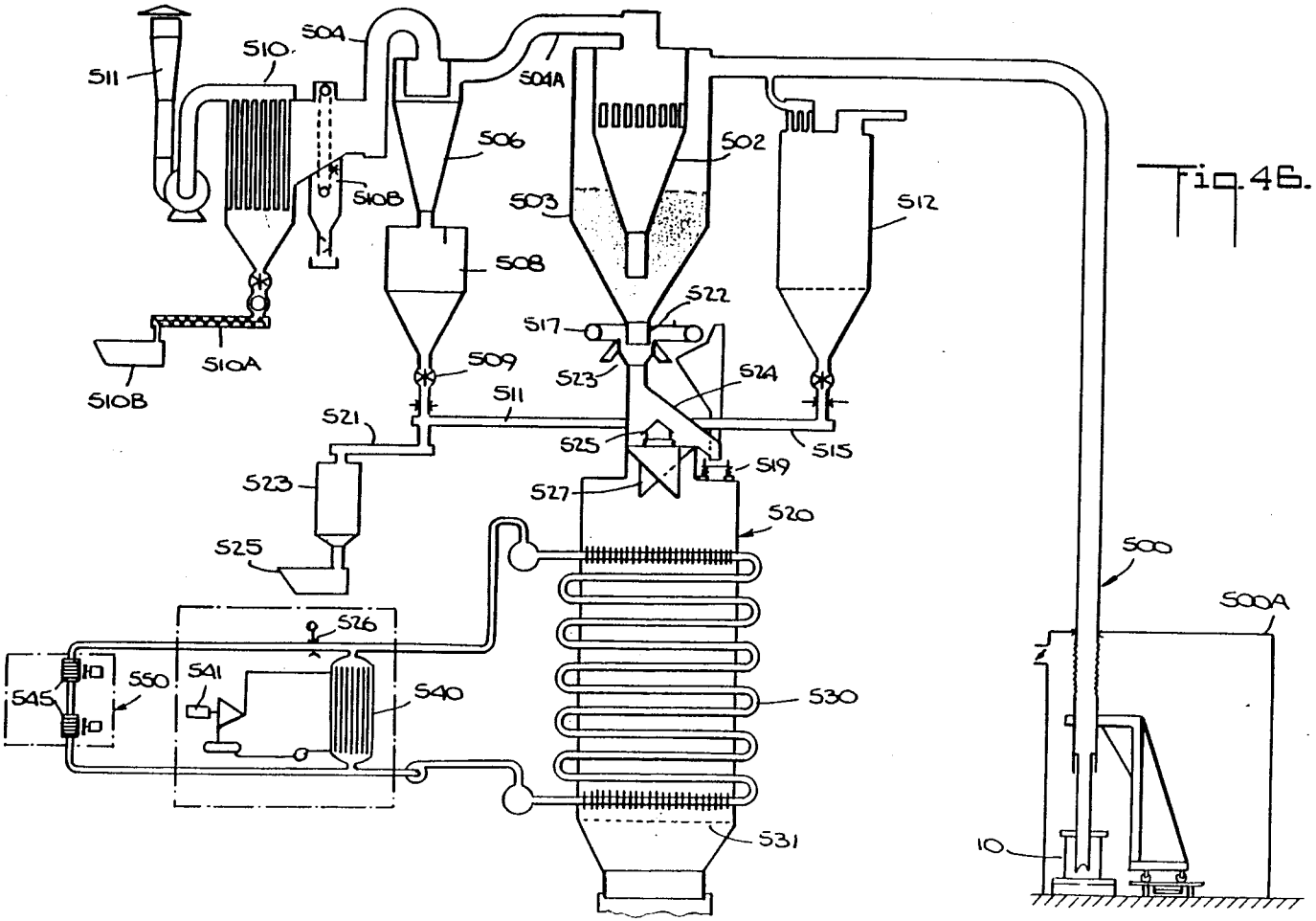
FIG. 46 is a schematic view of a molding medium heat recovery and pollution control station in an alternative embodiment of the invention.

An overall view of operation station 4 or the molding medium recovery and recycling station is shown in FIGS. 1, 3, and 5. This mechanism is shown in greater detail in FIGS. 20 and 41–45 while the treatment of the molding medium is shown in FIG. 46. With reference now specifically to FIGS. 41 to 45, the molding medium recovery and recycling system is composed of a hood 400 which is movably mounted on wheels 402A on a vertical beam 402. Suitable hydraulic rams 403 can be provided to effect vertical movement. The hood 400 rotates about two pivot points 401 and 401C as shown by arrows 401D and 401E in FIG. 43. Rotation of hood 400 will be explained below. The hood 400 includes a lower portion 404 which fits over the top 58 of the pouring container 10 and which can be locked into place using hydraulic rams 406 similar to rams 188 described earlier with reference to station 1. Once the hood 400 is locked into place above the pouring container 10, the joined assembly is rotated 180 about the two pivot points as shown in FIG. 43, allowing the molding medium to fall by gravity into the hood 400.

Rotation of hood 400 is accomplished as follows. Hydraulic ram 401A is first operated to rotate hood 400 via bellcrank 401B about pivot 401 by approximately 90° as shown in FIG. 43 by arrow 401D. Then, hydraulic ram 410 is actuated to rotate hood 400 about pivot point 401C by another approximately 90 as shown by arrow 401E in FIG. 43. A sliding circular valve 408 is actuated at the same time by a suitable motor 409, allowing perforations 408A in the hood 400 to align with perforations 408B in the sliding valve plate 408. As the hood 400 with attached container 10 is rotated, the molding medium falls from the pouring container 10 through apertures 408A and 408B into the hood 400. Valve 408 has a plurality of apertures 408B, thus preventing segregation of the molding medium in the hood 400. Once the transfer of the molding medium into the hood has taken place, the sliding valve 408 is closed, the combined assembly is righted by suitable reverse activation of rams 401A and 410 and the now empty pouring container 10 is returned to the base plate 22. The hydraulic rams 406 are unlocked and the filled hood 400 is moved upward (FIG. 44) in order to allow the empty pouring container 10 to move along tracks 12 to repeat the casting process starting at operation station 1.

With reference now to FIGS. 3, 5, 44, and 45, the filled hood 400 continues upward along beam 402 until it reaches a turning mechanism 420 disposed at the top of beam 402. Beam 402 is extended by a smaller beam 422 in alignment therewith. Once at the top, the turning mechanism 420 comprising a motor 420A and gears 420B and 420C rotates the filled hood 400 and the smaller beam 422 in a horizontal plane 180° about shaft 405 so that the filled hood 400 is now over the top of operation station 1 and above the molding medium hopper 100. See FIG. 45. The hood 400 is then lowered down along beam 422 directly on top of the molding medium hopper 100 creating a tight fit with the top of the molding medium hopper 100. At this time, the valve 408 in the bottom portion 404 of the hood 400 is once again opened and the molding medium is allowed to fall by gravity as shown by the arrows 411 in FIG. 45 into the open top of molding medium hopper 100 so that it can be reused for filling another pouring container 10. Once this operation is completed, the hood 400 is once again rotated by turning mechanism 420 back to its position above beam 402 and lowered down above the next pouring container 10.

According to a further aspect of the invention, the molding medium recovered from operation station 4 can be processed through a heat energy recovery and pollution control system such as shown in FIG. 46 prior to reuse. As shown, the molding medium which has absorbed much heat energy from the casting is aerated and lifted by vacuum out of the pouring container 10 into pipe 500. The exhauster 511 generates sufficient vacuum to move air through dust collector 510, connection pipe 504, fines cyclone 506, connection pipe 504A, course cyclone 502, through pipe 500 and pick up molding medium from the pouring box 10 within collection hood 500A. The dust that is generated will be entrapped in dust collector 510 and any unburned broken up styrene parts will be picked up by collector 510B to prevent the dust collector 510 from filling up with such debris.

The main fraction of the molding medium will be pulled off the air stream in cyclone 502 and collected in its bottom where a metering device 522 will distribute it over screening device 524. The feed rate of the discharge from cyclone 502 will be controlled by the molding medium demand of the molding line, the cooling rate as sensed by meter 526, and a blending formula that will take into consideration the fine and new molding medium additions. The reusable fine material will be separated as required by its mesh size and then collected in cyclone 506 and discharged to collecting hopper 508. The feed stream of feeder 509 of the fines hopper 506 will be controlled to a proportion of the feed stream of feeder 523 of the course hopper 503 and through conduit 511 will feed the fines material to a distributing conveyor 525.

The distribution conveyor 525 is designed in such a way as to distribute the molding medium across the entire width of the cooling device 520 and it will discharge into splitting device 527 which is mounted below screening device 524. With this "double cross" splitting, a uniform sand distribution will be achieved. The new molding medium with its own antisegregation bin 512 will be metered through feeder 513 in constantly measured quantities and transferred to conveyor 525 through conduit 515. The splitting of the medium is accomplished as described earlier. The over-size particles from screen 524 and, if a magnetic separator device is used, screen 517 are removed by conveyor 519. The overflow of fines is discharged through conveyor 521 into holding hopper 523 and hauled away in container 525. The dust is removed from the collector system via screw conveyer 510A to a container 510B. The dust can be disposed of by standard methods such as pelletizing.

After the medium has been reblended, it is important that the blended grain distribution be maintained. To meet this requirement, a combination of contact cooling device and anti-segregation gate device 531 is used. The heat energy contained in the molding medium can be captured by a liquid coolant (e.g., water) through a heat exchanger 530. The coolant can then vaporize a volatile liquid such as ammonia in evaporator 540 and the ammonia gases generated can then be expanded through an expansion engine 541 which converts the waste heat energy retained in the molding medium into mechanical and then electrial energy. In this way, part of the heat energy exerted to melt down the metal can be recouped and the imporant process step of molding medium cooling can be accomplished with considerable energy saving. The condensed ammonia can then be returned into evaporator 540 and once again be boiled off using the heat energy from the molding medium. Furthermore, some of the energy contained in the molding medium can eventually be used for drying purposes in the styrene storage controlled environmental area 550 by means of radiators 545. The regenerative process is only possible with unbonded molding medium since bonded molding medium cannot be made to flow uninterruptedly through the many labyrinths of the heat exchanger 530. In this described cooling arrangement, the cooling tower 520 also serves as the storage means for the returning molding medium and therefore its construction will require only the additional capital for the heat exchanger 530 which can be recouped from the resulting savings of energy.

Figure 49:
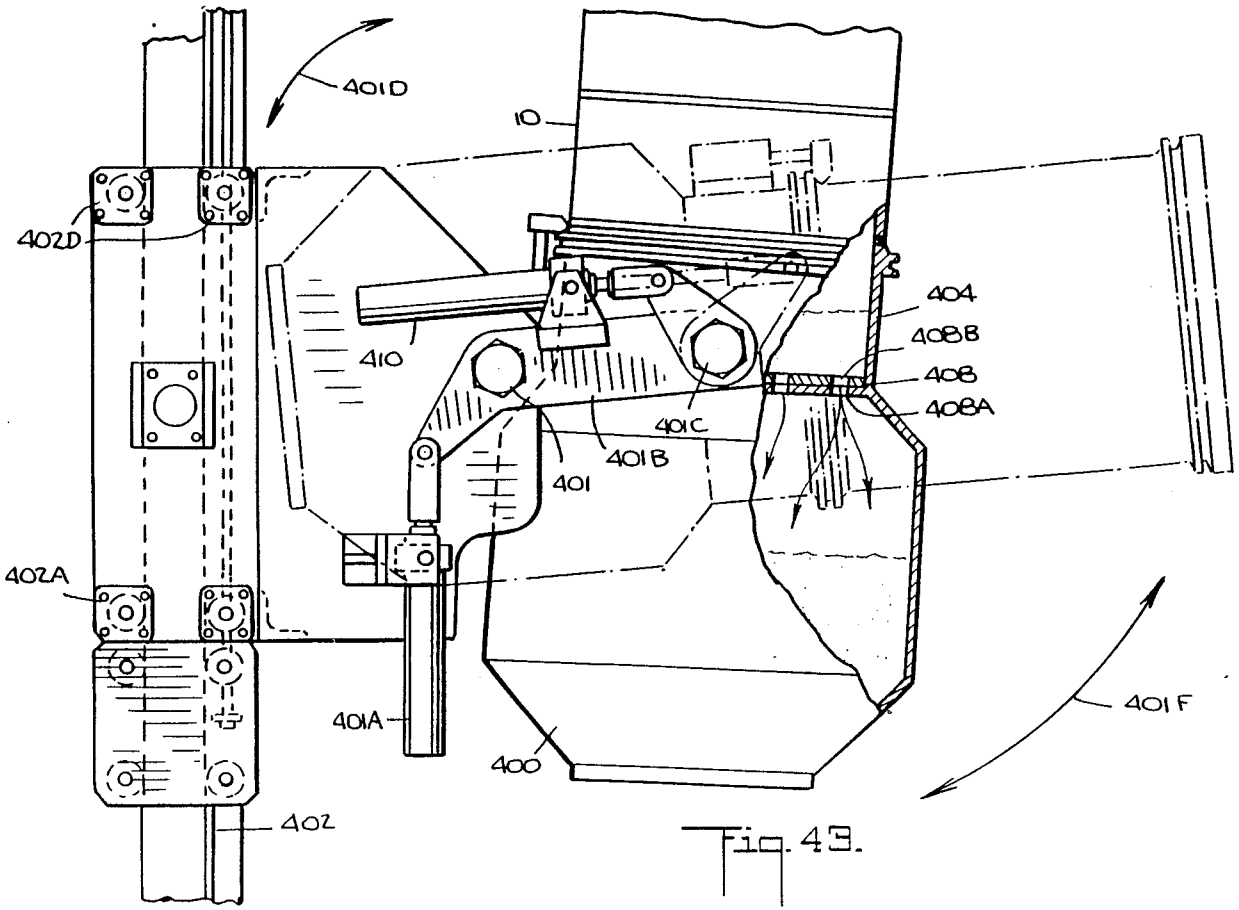
FIG. 49 is a sectional view of the apparatus shown in FIG. 48 as the molten metal is forced upward into the container, displacing the pattern.
Figure 44:
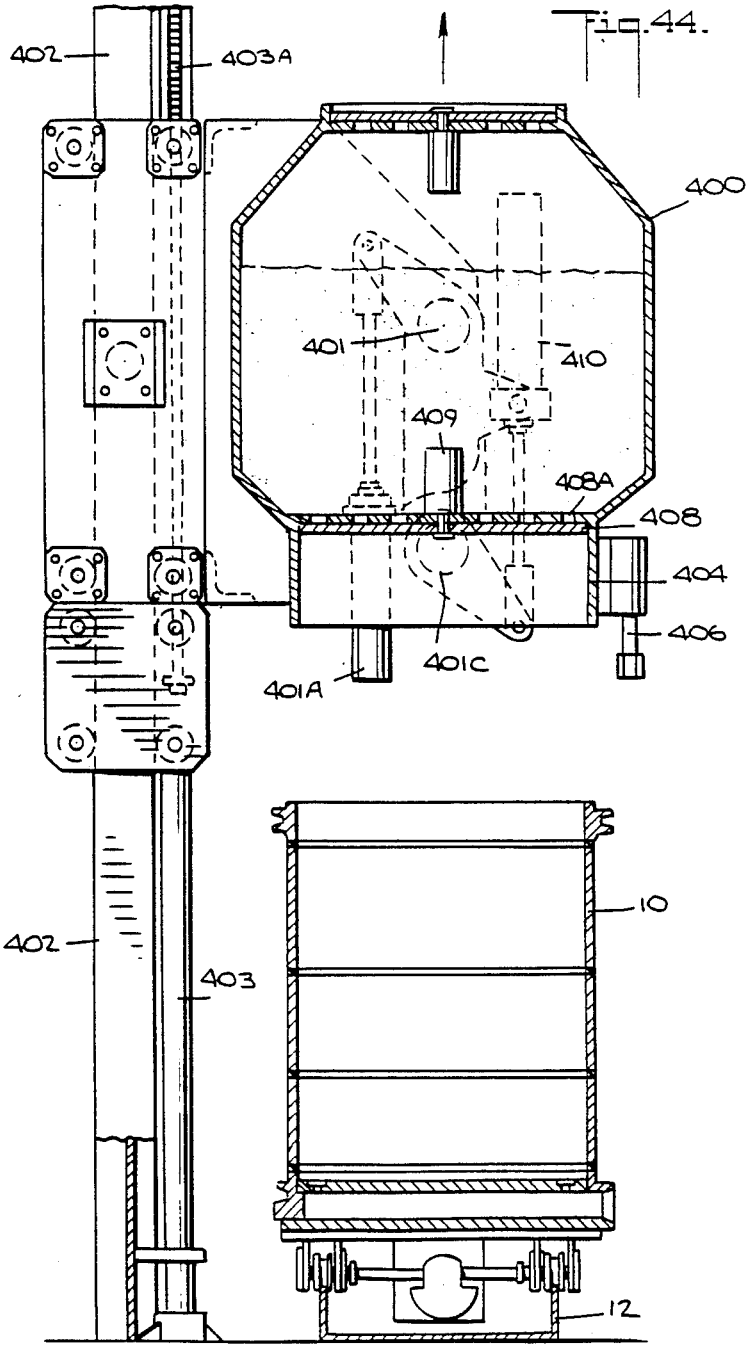
FIG. 44 is a sectional view of the molding medium recovery and recycling station of the apparatus shown in FIG. 41 after the now empty pouring container has been disengaged therefrom.
Figure 45:
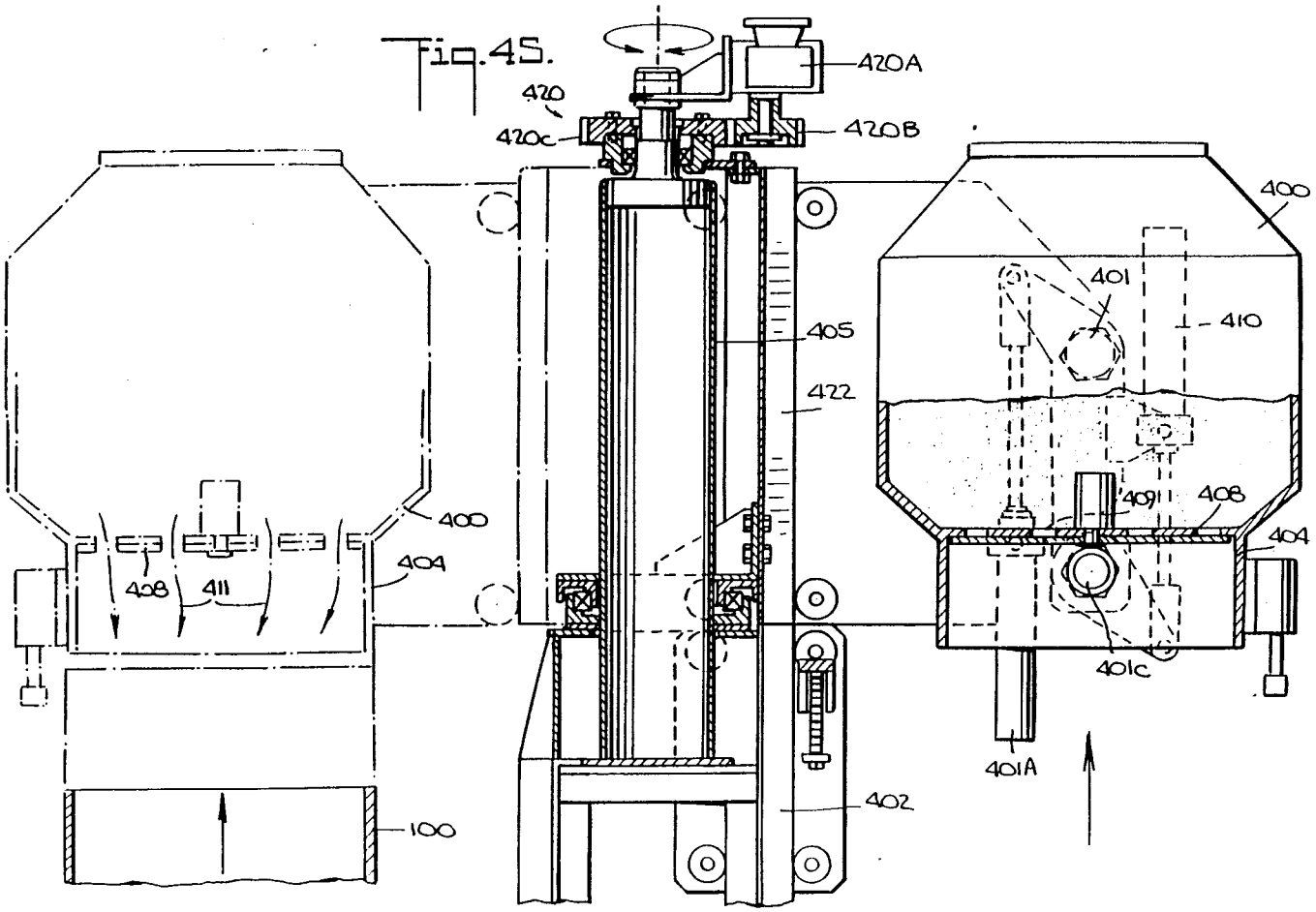
FIG. 45 is a sectional view of the molding medium recovery and recycling station of the apparatus of the invention, showing the rotating mechanism and a portion of the pattern insertion and molding medium dispensing and packing station shown in FIG. 3.

Yet another modification of the present invention uses a different method and apparatus for the displacement of the evaporative pattern in the molding medium by the molten metal. With reference now to FIGS. 47-50, the pattern 112, molding medium, and container 10 are prepared as earlier described. Then, however, a top 600 resembling the bottom portion of the pouring vessel 200 described earlier is fitted over the top of the filled container 10. The top assembly is clamped to the container 10 via hydraulic rams 605 to lock the top and container together. The top also contains a valve 608, which may be a sliding valve as shown having an opening 610. The valve 608 is made of a suitable refractory material. The top assembly also includes a flexible refractory filler 268, as earlier described with reference to FIGS. 31–34. The clamped assembly is then rotated 180° as shown in FIGS. 48 and 49 and a connection 602 in the top 600 is fitted onto nipple 604 which is at the top of a molten metal containing vessel 606. Molten metal is then pumped upward using, e.g., air pressure for iron or steel melts or an electromagnetic pump for aluminum melts, into the pattern or cluster 112 within the molding medium thereby forming a casting. Once the entire pattern or pattern cluster has been displaced by the molten metal and the casting completed, valve 608 is closed, the metal pumping source is turned off and the container 10 is righted. Once the container has been righted, the cover assembly is removed and the container with the semi-molten metal casting is transferred to a storage area for cooling. Once cooled, the removal and recovery operations are as described earlier.

The advantages of this embodiment lie in the fact that the upward pumping of the molten metal can be controlled more accurately than the gravity casting system described earlier. Furthermore, the gases generated when the molten metal contacts the evaporative pattern cannot, in this embodiment, get trapped within the formation casting but continue upwards ahead of the movement of the molten metal thus allowing for the forming of a purer and cleaner casting. This is important in the formation of certain metal castings, most notably iron and steel, since at the higher temperatures required for iron and steel casting there is a greater possibility of carbonization of the gases generated by the evaporating pattern in the casting being formed.

Additionally, it is not necessary to wait until the casting cools in order to right the container. The gate valve 608 is closed when the casting is completed, and righting of the container 10 may be performed immediately thereafter. This saves considerable time, as the next casting can be made without waiting for the prior casting to cool. Furthermore, this arrangement and method allows for the use of shorter sprues and eliminates the need for a valve on each pouring container itself, thus simplifying the required apparatus and ensuring better sealing. Shorter sprues on the pattern or pattern cluster can be utilized because it is not necessary to bury deeply the pattern or pattern cluster in the molding medium in order to develop a sufficient pressure head because the molten metal is pressure fed into the mold. It is anticipated that the sprue lengths can be decreased using this arrangement by about 50%.

Furthermore, it should be clear that any number of metal pouring stations can be put on-line so that one would not be limited to only one metal pouring station. As shown in FIGS. 1 and 2, these further pouring stations 800 could be located between operation station 1 and the cooling circuit 14. Furthermore, other arrangements of the conveyor system are possible and additional pattern insertion and molding medium compaction stations, as well as the pattern removal and molding medium recovery stations can be added. Furthermore, a straight line conveyor system or a circular system would also be within the scope of the invention. Additionally, spur tracks could be provided so as to shunt containers 10 off the main conveyor track for cooling, for example, so that the casting process is not impeded by the cooling times.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A method for evaporative pattern casting comprising the steps of:

inserting a pattern of an object to be cast and adapted to be gasified on contact with molten metal into a container;

supplying an unbound molding medium into said container and disposing said molding medium around said pattern, said step of disposing comprising dispensing said molding medium into said container and compacting said molding medium around said pattern in predetermined partial volumes of substantially the total volume of said container;

said step of compacting comprising at least compacting substantially each of said predetermined partial volumes one at a time whereby, during at least part of the disposing step, substantially only one of said partial volumes is compacted at a time;

displacing said pattern in said compacted molding medium with molten metal thereby forming a metal casting and releasing gaseous material from the evaporation of said pattern;

allowing the casting to cool; and removing the casting from said container.

2. The method recited in claim 1, further comprising the step of removing said unbound molding medium from said container.

3. The method recited in claim 2, further comprising the step of preparing the removed unbound molding medium for disposition around another pattern for forming a further casing.

4. The method recited in claim 1 further comprising the steps of evacuating the gaseous material generated by evaporation of the pattern and converting the gaseous material into an environmentally safe product.

5. The method recited in claim 1, wherein the step of removing the casting from the container comprises the steps of providing pressurized gas to said container, thereby fluidizing the molding medium in said container, grasping said casting in said container, and pulling said casting out of said container.

6. The method recited in claim 1, wherein said steps of supplying, disposing, dispensing and compacting comprise filling said container to a predetermined level with molding medium around said pattern in a defined volume of said container, vibrating the molding medium in said defined volume for a period of time, and filling an additional defined volume of said container with said molding medium and thereafter vibrating said additional defined volume for a further period of time, and thereafter repeating said steps of filling and vibrating until substantially said entire volume is filled, each of said defined volumes being vibrated substantially independently and only one defined volume being vibrated during any period of time.

7. The method recited in claim 3, wherein said step of preparing comprises transferring said molding medium from said container after removing the casting into a molding medium collection means.

8. The method recited in claim 1 wherein said step of compacting comprises vibrating said molding medium so as to provide balanced vibrational forces in horizontal planes, thereby eliminating any substantial relative vertical movement of the pattern and the container.

9. The method recited in claim 8, further comprising the steps of providing a cover on said container, rotating said container after said container has been completely filled and vibrating said container during said step of rotating.

10. A method for inserting an evaporative pattern of an object to be cast into a container and providing an unbound molding medium into the container and around the pattern comprising the steps of:

inserting the pattern into the container; and supplying the unbound molding medium into the container and around the pattern;

said step of supplying comprising vibrating partial volumes of substantially the whole volume of said container in sequential order as said container is being filled until the unbound molding medium fills said container and forms an upper surface therein, said step of vibrating partial volumes comprising at least vibrating substantially each of said partial volumes one at a time whereby, during at least part of the supplying step, substantially only one of said partial volumes is vibrated at a time.

11. The method recited in claim 10 further comprising the steps of:

covering said filled container with means for filling any space above the upper surface of said unbound molding medium and for providing a retaining pressure against said surface;

rotating said filled container and vibrating the partial volumes of said container in predefined sequential order to compact further said molding medium and allow said molding medium to flow into any cavities in said pattern; and after compaction, returning said container to an upright position.

12. The method recited in claim 11, wherein said step of rotating comprises rotating said container to defined angular positions and said step of vibrating comprises vibrating said container in each of said angular positions.

13. The method recited in claim 11, wherein said step of rotating comprises rotating said container continuously and vibrating said container continuously during said rotation.

14. The method recited in claim 11, wherein said step of covering comprises providing a cover having a membrane conforming to the upper surface of said molding medium and pressurizing said membrane so that said membrane exerts pressure against said upper surface of said unbound molding medium.

15. The method recited in claim 12, wherein said step of rotating comprises:

rotating said filled and covered container in 45° increments up to 180° and at each 45° increment stopping said rotation and vibrating the partial volumes of substantially the whole volume of said filled and covered container in a predetermined sequential order.

16. The method recited in claim 14, further comprising the steps of:

depressurizing said membrane; and removing said cover from atop said container.

17. The method recited in claim 10 wherein said step of supplying comprises dispensing said molding medium into said container by feeding said molding medium downwardly from a hopper and rotating a dispensing device to supply said molding medium centrifugally into said container.

18. The method recited in claim 10, further comprising the step of providing a vacuum in said container as said container is being filled with molding medium.

19. A method for producing a casting by the evaporative pattern casting process in unbound molding medium within a container, said method comprising the steps of:

inserting a pattern to be gasified on contact with molten metal of an object to be cast into the container;

disposing unbound molding medium around the pattern and compacting said molding medium by vibrating the container in defined subvolumes of the total volume of the container, said step of vibrating comprising at least vibrating substantially each of said defined subvolumes one at a time whereby, during at least part of the disposing step, substantially only one of said defined subvolumes is vibrated at a time;

displacing the pattern with molten metal to form a casting;

allowing the casting so formed to cool;

fluidizing the packed unbound molding medium by providing gas into said container;

gripping said casting with a movable set of jaws; and pulling said casting out of said fluidized unbound molding medium.

20. The method recited in claim 19, further comprising the steps of:

covering said container with a substantially airtight hood;

securing the hood to the container; and further wherein said casting is removed within said hood.

21. The method recited in claim 19, wherein said step of vibrating comprises vibrating said container as to vibrate the molding medium in substantially horizontal planes.

22. The method recited in claim 19, wherein said step of pulling the casting out of the container comprises the step of maintaining a fixed orientation of said casting with respect to said container so as to facilitate further automatic processing of said casting.

23. Apparatus for forming evaporative pattern castings comprising:

means for inserting a pattern to be gasified on contact with molten metal of an object to be cast into a container;

means for supplying an unbound molding medium into said container and disposing said molding medium around said pattern in a time period, said means for disposing comprising means for dispensing said molding medium into said container and means for compacting said molding medium around said pattern in predetermined partial volumes of substantially the total volume of said container, said means for compacting comprising means for at least compacting substantially each of said predetermined partial volumes of substantially the total volume of said container one at a time whereby, during at least part of the time period, substantially only one of said partial volumes is compacted at a time;

means for displacing said pattern with molten metal thereby forming a metal casting and releasing gaseous material from the evaporation of said pattern; and means for removing the casting, once cooled, from said container.

24. The apparatus recited in claim 23, further comprising means for removing said unbound molding medium from said container.

25. The apparatus recited in claim 24, further comprising means for preparing said removed unbound molding medium for disposition around another pattern for forming a further casting.

26. The apparatus recited in claim 23 further comprising means for evacuating the gaseous material generated by evaporation of the pattern and means for converting the gaseous material into an environmentally safe product.

27. The apparatus recited in claim 24, wherein the means for removing the casting from the container comprises means for providing pressurized gas to said container, thereby fluidizing the molding medium in said container, means for grasping said casting in said container, and means for pulling said casting out of said container.

28. The apparatus recited in claim 23, wherein said means for supplying, disposing, dispensing and compacting comprises means for filling said container to a predetermined level with molding medium around said pattern in a defined volume of said container and means for vibrating the molding medium in said defined volume for a period of time, said means for filling further filling an additional defined volume of said container with said molding medium and said means for vibrating thereafter vibrating said additional defined volume for a further period of time, said means for filling and means for vibrating thereafter repeating said filling and vibrating until substantially said entire volume is filled, each of said defined volumes being vibrated independently and only one defined volume being vibrated during any period of time.

29. The apparatus recited in claim 28 wherein said container comprises a plurality of sections, each section being separated by an elastic member.

30. The apparatus recited in claim 29 wherein said container has a substantially circular cross section.

31. The apparatus recited in claim 28 wherein said means for preparing comprises means for transferring said molding medium from said container into a molding medium collection means after said casting is removed from said container.

32. The apparatus recited in claim 23, wherein said means for compacting comprises means for vibrating said molding medium so as to provide balanced vibrational force in horizontal planes, thereby eliminating any substantial relative vertical movement of the pattern and container.

33. The apparatus recited in claim 32, further comprising a cover means for clamping to the top of said container, means for rotating said container after said container has been completely filled and covered, and means for vibrating said container during said rotation.

34. The apparatus recited in claim 23, further comprising conveyor means for transferring said container among locations adjacent said means for inserting, said means for displacing, said means for removing the casting and said means for removing the molding medium.

35. The apparatus recited in claim 34 wherein said conveyor means comprises a rectangular loop having turntable means at each corner of the rectangular loop for changing the direction of the container.

36. The apparatus recited in claim 35 wherein said container is disposed on cart means carried through said rectangular loop.

37. The apparatus recited in claim 34 wherein a section of said conveyor means comprises a cooling section wherein containers can be held for a defined cooling period after production of a casting.

38. Apparatus for inserting an evaporative pattern of an object to be cast into a container and providing an unbound molding medium into the container and around the pattern comprising:

means for inserting the pattern into the container; and means for supplying the unbound molding medium into the container and around the pattern in a time period;

said means for supplying comprising means for vibrating partial volumes of substantially the whole volume of said container in a sequential order as said container is being filled until the container is filled and the unbound molding medium forms an upper surface therein, said means for vibrating comprising means for at least vibrating substantially each of said partial volumes one at a time whereby, during at least part of the time period, substantially only one of said partial volumes is vibrated at a time.

39. The apparatus recited in claim 38 further comprising:

means for covering said filled container and for filling any space above the upper surface of said unbound molding medium and for providing a retaining pressure against said surface;

means for rotating said filled container, said means for vibrating further vibrating the partial volumes of said container in predefined sequential order to further compact said molding medium and allow said molding medium to flow into any cavities in said pattern; and means for returning said container to an upright position after compaction.

40. The apparatus recited in claim 39, wherein said means for rotating comprises means for rotating said container to defined angular positions and said means for vibrating comprises means for vibrating said container in each of said angular positions.

41. The apparatus recited in claim 40, wherein said means for rotating comprises means for rotating said container continuously and said means for vibrating comprises means for continuously vibrating said container during said rotation.

42. The apparatus recited in claim 39, wherein said means for covering comprises cover means having a membrane conforming to the upper surface of said molding medium and means for pressurizing said membrane so that said membrane exerts pressure against said upper surface of said unbound molding medium.

43. The apparatus recited in claim 39, wherein said means for rotating comprises:

means for rotating said filled and covered container in 45° increments up to 180° and means for stopping the rotation of the container at each 45° increment, said means for vibrating vibrating the partial volumes of substantially the whole volume of said filled and covered container in a predetermined sequential order.

44. The apparatus recited in claim 42, further comprising means for depressurizing said membrane and means for removing said cover means from atop said vibrated container.

45. The apparatus recited in claim 38 wherein said means for supplying comprises means for dispensing said molding medium into said container by feeding said molding medium downwardly from a hopper and means for rotating a dispensing device to supply said molding medium centrifugally into said container.

46. The apparatus recited in claim 38, further comprising means for providing a vacuum in said container as said container is being filled with molding medium.

47. The apparatus recited in claim 45 wherein said means for dispensing comprises a vertically movable hopper holding said molding medium, a cover for said container and a tubular member extending through said cover into said container and moveable with said hopper, said tubular member having a passageway for conveying molding medium from said hopper and said dispensing device being disposed at a lower end of said tubular member, said tubular member being movable so that as said molding medium fills said container, said dispensing device moves upwardly ahead of the rising molding medium.

48. The apparatus recited in claim 47, further comprising sensor means for detecting the level of the rising molding medium.

49. The apparatus recited in claim 48 wherein the sensor means comprises means for detecting the rotational speed of said dispensing device.

50. Apparatus for producing a casting by the evaporative pattern casting process in unbound molding medium within a container, said apparatus comprising:

means for inserting a pattern to be gasified on contact with molten metal of an object to be cast into the container;

means for disposing unbound molding medium around the pattern in a time period and for compacting the molding medium by vibrating the container in defined subvolumes of the total volume of the container, said means for compacting comprising means for at least vibrating the container substantially in each defined subvolume one at a time whereby, during at least part of the time period, substantially only one of said defined subvolumes is vibrated at a time;

means for displacing the pattern with molten metal to form a casing;

means for allowing the casting so formed to cool;

means for fluidizing said packed unbound molding medium by providing gas into said container; and means for gripping said casting and pulling said casting out of said fluidized unbound molding medium.

51. The apparatus recited in claim 50, further comprising:

a substantially airtight hood for covering said container;

means for securing the hood to said container, said casting being removed while in said hood.

52. The apparatus recited in claim 50, wherein said means for compacting comprises means for vibrating said container in substantially horizontal planes.

53. The apparatus recited in claim 50 wherein said means for pulling the casting out of the container comprises means for maintaining a fixed orientation of said casting with respect to said container so as to facilitate further automatic processing of said casting.

54. A method for evaporative pattern casting comprising the steps of:

inserting a pattern of an object to be cast and adapted to be gasified on contact with molten metal into a container;

supplying an unbound molding medium into said container and disposing said molding medium around said pattern, said step of disposing comprising dispensing said molding medium into said container and compacting said molding medium around said pattern in predetermined partial volumes of substantially the whole volume of said container;

providing a cover on said container, rotating said container after said container has been completely filled and compacting said container during said step of rotating;

displacing said pattern in said compacted molding medium with molten metal thereby forming a metal casting and releasing gaseous material from the evaporation of said pattern;

allowing the casting to cool; and removing the casting from said container.

55. The method recited in claim 54, further comprising the step of removing said unbound molding medium from said container.

56. The method recited in claim 55, further comprising the step of preparing the removed unbound molding medium for disposition around another pattern for forming a further casting.

57. The method recited in claim 54, further comprising the steps of evacuating the gaseous material generated byevaporation of the pattern and converting the gaseous material into an environmentally safe product.

58. The method recited in claim 54, wherein the step of removing the casting from the container comprises the steps of providing pressurized gas to said container, thereby fluidizing the molding medium in said container, grasping said casting in said container, and pulling said casting out of said container.

59. The method recited in claim 54, wherein said steps of supplying, disposing, dispensing and compacting comprise filling said container to a predetermined level with molding medium around said pattern in a defined volume of said container, vibrating the molding medium in said defined volume for a period of time, and filling an additional defined volume of said container with said molding medium and thereafter vibrating said additional defined volume for a further period of time, and thereafter repeating said steps of filling and vibrating until substantially said entire volume is filled, each of said defined volumes being vibrated substantially independently and only one defined volume being vibrated during any period of time.

60. The method recited in claim 56, wherein the step of preparing comprises transferring the molding medium from said container after removing the casting into a molding medium collection means.

61. The method recited in claim 54, wherein said step of compacting comprises vibrating said molding medium so as to provide balanced vibrational forces in horizontal planes, thereby eliminating any substantial relative vertical movement of the pattern and the container.

62. The method recited in claim 54, wherein said step of rotating said container comprises rotating said container to defined angular positions and said step of compacting comprises vibrating said container in each of said angular positions.

63. A method for inserting an evaporative pattern of an object to be cast into a container and providing an unbound molding medium into the container and around the pattern comprising the steps of:

inserting the pattern into the container; and supplying the unbound molding medium into the container and around the pattern;

said step of supplying comprising vibrating partial volumes of substantially the whole volume of said container in sequential order as the container is being filled until the unbound molding medium fills said container and forms an upper surface therein; and further comprising the step of covering said filled container with means for filling any space above the upper surface of said unbound molding medium and for providing a retaining pressure against said surface;

rotating said filled container and vibrating the partial volumes of said container in predefined sequential order to compact further said molding medium and allow said molding medium to flow into any cavities in said pattern; and after compaction, returning said container to an upright position.

64. The method recited in claim 63, wherein said step of rotating comprising rotating said container to defined angular positions and said step of vibrating comprises vibrating said container in each of said angular positions.

65. The method recited in claim 63, wherein said step of rotating comprises rotating said container continuously and vibrating said container continuously during said rotation.

66. The method recited in claim 63, wherein said step of covering comprises providing a cover having a membrane conforming to the upper surface of said molding medium and pressurizing said membrane so that said membrane exerts pressure against said upper surface of said unbound molding medium.

67. The method recited in claim 64, wherein said step of rotating comprises:

rotating said filled and covered container in 45° increments up to 180° and at each 45° increment stopping said rotation and vibrating the partial volumes of substantially the whole volume of said filled and covered container in a predetermined sequential order.

68. The method recited in claim 66, further comprising the steps of:

depressurizing said membrane; and removing said cover from atop said container.

69. The method recited in claim 63, wherein said step of supplying comprises dispensing said molding medium into said container by feeding said molding medium downwardly from a hopper and rotating a dispensing device to supply said molding medium centrifugally into said container.

70. The method recited in claim 63, further comprising the step of providing a vacuum in said container as said container is being filled with molding medium.

71. Apparatus for forming evaporative pattern castings comprising:

means for inserting a pattern to be gasified on contact with molten metal of an object to be cast into a container;

means for supplying an unbound molding medium into said container and disposing said molding medium around said pattern, said means for disposing comprising means for dispensing said molding medium into said container and means for compacting said molding medium around said pattern in predetermined partial volumes of substantially the total volume of said container;

cover means for clamping to the top of said container;

means for rotating said container after said container has been completely filled and covered;

said means for compacting further comprising means for compacting said container during said rotation;

means for displacing said pattern with molten metal thereby forming a metal casting and releasing gaseous material from the evaporation of said pattern; and means for removing the casting once cooled from said container.

72. The apparatus recited in claim 71, further comprising means for removing said unbound molding medium from said container.

73. The apparatus recited in claim 72, further comprising means for preparing said removed unbound molding medium for disposition around another pattern for forming a further casting.

74. The apparatus recited in claim 71, further comprising means for evacuating the gaseous material generated by evaporation of the pattern and means for converting the gaseous material into an environmentally safe product.

75. The apparatus recited in claim 72, wherein the means for removing the casting from the container comprises means for providing pressurized gas to said container, thereby fluidizing the molding medium in said container, means for grasping said casting in said container, and means for pulling said casting out of said container.

76. The apparatus recited in claim 71, wherein said means for supplying, disposing, dispensing and compacting comprises means for filling said container to a predetermined level with molding medium around said pattern in a defined volume of said container and means for vibrating the molding medium in said defined volume for a period of time, said means for filling further filling an additional defined volume of said container with said molding medium and said means for vibrating thereafter vibrating said additional defined volume for a further period of time, said means for filling and means for vibrating thereafter repeating said filling and vibrating until substantially said entire volume is filled, each of said defined volumes being vibrated independently and only one defined volume being vibrated during any period of time.

77. The apparatus recited in claim 76 wherein said container comprises a plurality of sections, each section being separated by an elastic member.

78. The apparatus recited in claim 77 wherein said container has a substantially circular cross section.

79. The apparatus recited in claim 73 wherein said means for preparing comprises means for transferring said molding medium from said container into a molding medium collection means after said casting is removed from said container.

80. The apparatus recited in claim 71, wherein said means for compacting comprises means for vibrating said molding means so as to provide balanced vibrational forces in horizontal planes, thereby eliminating any substantial relative vertical movement of the pattern and container.

81. The apparatus recited in claim 71, further comprising conveyor means for transferring said container among locations adjacent said means for inserting, said means for displacing, said means for removing the casting and said means for removing the molding medium.

82. The apparatus recited in claim 81 wherein said conveyor means comprises a rectangular loop having turntable means at each corner of the rectangular loop for changing the direction of the container.

83. The apparatus recited in claim 82 wherein said container is disposed on cart means carried through said rectangular loop.

84. The apparatus recited in claim 81 wherein a section of said conveyor means comprises a cooling section wherein contains can be held for a defined cooling period after production of a casing.

85. Apparatus for inserting an evaporative pattern of an object to be cast into a container and providing an unbound molding medium into the container and around the pattern comprising:

means for inserting the pattern into the container;

means for supplying the unbound molding medium into the container and around the pattern;

said means for supplying comprising means for vibrating partial volumes of substantially the whole volume of said container in a sequential order as said container is being filled until the container is filled and the unbound molding medium forms an upper surface therein;

means for covering said filled container and for filling any space above the upper surface of said unbound molding medium and for providing a retaining pressure against said surface;

means for rotating said filled container, said means for vibrating further vibrating the partial volumes of said container in predefined sequential order to further compact said molding medium and allow said molding medium to flow into any cavities in said pattern; and means for returning said container to an upright position after compaction.

86. The apparatus recited in claim 85, wherein means for rotating comprises means for rotating said container to defined angular positions and said means for vibrating comprises means for vibrating said container in each of said angular positions.

87. The apparatus recited in claim 86, wherein means for rotating comprises means for rotating said container continuously and said means for vibrating comprises means continuously vibrating said container during said rotation.

88. The apparatus recited in claim 142, wherein said means for covering comprises cover means having a membrane conforming to the upper surface of said molding medium and means for pressurizing said membrane so that said membrane exerts pressure against said upper surface of said unbound molding medium.

89. The apparatus recited in claim 88, wherein said means for rotating comprises:

means for rotating said filled and covered container in 45° increments up to 180° and means for stopping the rotation of the container at each 45° increment, said means for vibrating vibrating the partial volumes of substantially the whole volume of said filled and covered container in a predetermined sequential order.

90. The apparatus recited in claim 88, further comprising means for depressurizing said membrane and means for removing said cover means from stop said vibrated container.

91. The apparatus recited in claim 88, wherein said means for supplying comprises means for dispensing said molding medium into said container by feeding said molding medium downwardly from a hcpper and means for rotating a dispensing device to supply said molding medium centrifugally into said container.

92. The apparatus recited in claim 85, further comprising means for providing a vacuum in said container as said container is being filled with molding medium.

93. The apparatus recited in claim 91, wherein said means for dispensing comprises a vertically movable hopper holding said molding medium, a cover for said container and a tubular member extending through said cover into said container and moveable with said hopper, said tubular member having a passageway for conveying molding medium from said hopper and said dispensing device being disposed at a lower end of said tubular member, said tubular member being movable so that as said molding medium fills said container, said dispensing device moves upwardly ahead of the rising molding medium.

94. The apparatus recited in claim 93, further comprising sensor means for detecting the level of the rising molding medium.

95. The apparatus recited in claim 94, wherein the sensor means comprises means for detecting the rotational speed of said dispensing device.

* * * * *